US006017684A

United States Patent [19]

Miyake

[11] Patent Number: 6,017,684

[45] Date of Patent: Jan. 25, 2000

[54] SILVER HALIDE COLOR PHOTOGRAPHIC LIGHT-SENSITIVE MATERIAL AND A METHOD OF FORMING COLOR IMAGES

[75] Inventor: Kiyoteru Miyake, Kanagawa, Japan

[73] Assignee: Fuji Photo Film Co., Ltd., Kanagawa, Japan

[21] Appl. No.: 08/982,517

[22] Filed: Dec. 2, 1997

[30] Foreign Application Priority Data

Dec. 2, 1996 [JP] Japan ..... 8-336386
Dec. 2, 1996 [JP] Japan ..... 8-336387

[51] Int. Cl.[7] ..... G03C 5/16; G03C 7/00

[52] U.S. Cl. ..... 430/351; 430/203; 430/383; 430/405; 430/567

[58] Field of Search ..... 430/567, 380, 430/351, 354, 203, 405, 249, 484, 254, 383

[56] References Cited

U.S. PATENT DOCUMENTS

| | | | |
|---|---|---|---|
| 4,933,272 | 6/1990 | McDugle et al. | 430/567 |
| 5,503,971 | 4/1996 | Daubendiek et al. | 430/567 |
| 5,773,560 | 6/1998 | Asami | 430/203 |
| 5,843,628 | 12/1998 | Taguchi et al. | 430/351 |

FOREIGN PATENT DOCUMENTS

| | | |
|---|---|---|
| 0 541 067 A1 | 5/1993 | European Pat. Off. . |
| 0 828 188 A1 | 3/1998 | European Pat. Off. . |
| 0 846 982 A2 | 6/1998 | European Pat. Off. . |

*Primary Examiner*—Thorl Chea
*Attorney, Agent, or Firm*—Sughrue, Mion, Zinn Macpeak & Seas, PLLC

[57] ABSTRACT

The present invention provides a silver halide color photographic light-sensitive material including a substrate having a photographic constituent layer coated thereon including at least one light-sensitive layer which includes a light-sensitive silver halide emulsion, a developing agent, a compound capable of forming a dye by a coupling reaction with the oxidation product of the developing agent, and a binder, the light-sensitive material after the exposure thereof being put together with a processing material including a substrate having a constituent layer coated thereon including a processing layer comprising a base and/or a base precursor, in the presence of water supplied to the light-sensitive layer of the light-sensitive material or to the processing layer of the processing material in an amount ranging from 1/10 to the equivalent of an amount which is required for the maximum swelling of the entire coating layers of these materials, so that the light-sensitive layer and the processing layer face each other, and being heated for the purpose of heat development to form a color image in the light-sensitive material, in which the light-sensitive silver halide emulsion contains at least one ion selected from the group consisting of a metal ion and a metal complex ion which are each an electron trap having a depth of 0.6 eV or less, and contains at least one kind of tabular grain having an average aspect ratio ranging from 4 to 100.

7 Claims, No Drawings

SILVER HALIDE COLOR PHOTOGRAPHIC LIGHT-SENSITIVE MATERIAL AND A METHOD OF FORMING COLOR IMAGES

BACKGROUND OF THE INVENTION

1. Field of the Invention

The present invention relates to a silver halide color photographic light-sensitive material and a method of forming color images utilizing the said light-sensitive material.

2. Description of the Related Art

Owing to remarkable development of light-sensitive materials for color photography utilizing silver halides, high-quality color images are now easily obtainable. For example, according to ordinary color photography, a color-print is obtained by the process comprising taking a photograph utilizing a color negative film, developing the film, and printing the image information, which is recorded in the color negative film, on color photographic paper in an optical way. Recently, this process has made remarkable progress, and large-scale, color development laboratories, in which a large quantity of color prints are produced in a very efficient way, have spread along with the so-called mini-laboratories which are small-sized and simple printer processor in shops. Therefore, anybody can enjoy color photography easily.

The color photography, now in common use, reproduces color by the subtractive color process. Generally, a color negative film comprises a transmittable substrate and light-sensitive layers thereon utilizing a silver halide emulsion as a light-sensitive component having a sensitivity to the blue, green or red wavelength region of light, and a so-called color coupler capable of producing a yellow, magenta or cyan dye as a complementary hue of the sensitive wavelength region of the layer and thereby a colored image can be formed by the combination of the above light-sensitive layer capable of forming a dye. A color negative film, which has been exposed imagewise while taking a photograph, is developed in a color developer containing an aromatic primary amine developing agent. In this process, the developing agent develops, i.e., reduces the exposed silver halide grains, and the oxidation product of the developing agent, which are formed concurrently with the forgoing reduction, undergoes the coupling-reaction with the color coupler to form a dye. The silver (developed silver) generated by the color development and the unreacted (unexposed) silver halide are removed by means of a bleaching process and fixing process. This creates a color image on the color negative film. Consequently, a color photographic paper which comprises a reflective substrate and light-sensitive layers formed thereon having the same combinations of light-sensitive wave length region and hue to be produced as in the color negative film, is subjected to exposure through the developed negative film, and color-developing, bleaching and fixing processes in the same manner as in the case of the negative film to obtain a color print having a color image as a reproduction of an original scene thereon.

Although these systems for forming color prints are widely adopted at the present time, there is a growing demand for a simpler system. First reason for this is that expertise and skilled operation are necessary, due to the requirement of strict control of the composition and the temperature of the processing solution in a processing bath for the above-mentioned procedure consisting of color development, bleaching and fixing. Second reason for this is that closed equipment exclusively for the use in the developing process is often required, due to substances, such as a developing agent and,as a bleaching agent, an iron chelate compound, the discharge of which is regulated from the standpoint of environmental protection, contained in the processing solution. Third reason for this is that the currently available system does not perfectly fulfill the requirement for a rapid reproduction of image, as the above-mentioned developing process still requires a long time, although the time is shorted by the recent advance in technology.

Based on this background, there has been a strong demand for a simpler and more rapid system which does not utilize the developing agent and bleaching agent now in use for a conventional color image forming system and which accordingly minimizes the adverse effect on the environment.

In recent years, to fulfill the above-mentioned requirements, many improved techniques have been proposed. For example, IS & T's 48th Annual Conference Proceedings, pp. 180, discloses a system in which the dye formed in the developing reaction is transferred to a mordant layer and thereafter stripping a light-sensitive material containing developed silver and unreacted silver halide from an image receiving material bearing the mordant layer to separate the developed silver and unreacted silver halide from an image formed by the dye without the use of a bleaching-fixing bath which has been indispensable to a conventional photographic process. However, this proposed technique cannot perfectly solve the environmental problems, because it still needs a developing process by use of a processing bath containing a developing agent.

Fuji Photo Film Co., Ltd. has proposed a Pictrography Color System which dispenses with a processing solution containing a developing agent. In the Pictrography Color System, a dye formed by a developing reaction is fixed in a dye-fixing layer and the fixed dye in the layer is viewed. In the Pictrography Color System, a small amount of water is supplied to a light-sensitive material containing a base precursor which reacts with water to generate a base. The light-sensitive material and an image receiving material are placed face to face and heated to promote the developing reaction. This system does not use the aforementioned processing bath and, in this regard, is advantageous with respect to environmental protection. It appears that an application of the system to a photographic recording system can solve the aforementioned problems.

In the Pictorography Color System, a previously prepared dye is contained in a light-sensitive material and the dye is transferred to an image receiving material to form colored images thereon. However, with this system, a level of resolution equal to that required of photographic material cannot be obtained. From the view point of resolution, a system in which an image is formed not on the image receiving material but on the light-sensitive material is advantageous.

Further, since the previously prepared dye is contained in the light-sensitive material, part of the exposed light is absorbed by the dye (filter effect), which is disadvantageous in terms of sensitivity and results in the sensitivity enhancement required for light-sensitive materials not being obtained. From the view point of sensitivity, the system in which a coupler capable of forming a dye at the time of development by a coupling reaction with an oxidation product of a developing agent is contained in the light-sensitive material is more advantageous than the system in which a dye has been previously formed.

However, in a system in which an image is formed on the light-sensitive material by utilizing a coupling reaction, when a rapid image formation by heat development was attempted using a high-sensitivity for photographing emulsion and supplying a small amount of water, resultant serious problems were that ununiformity occurred in the image and fogging of a practically unacceptable level was liable to occur during storage of the light-sensitive material. The ununiformity in image did not occur in the aforementioned Pictrography Color System. If the light-sensitive material having ununiformity in image is used to obtain a color print image for the reproduction of an original scene, the resultant image cannot be utilized for enjoyment. Although it is theoretically possible to read the light-sensitive material having ununiformity by such means as a scanner and to correct the image information so as to reproduce the original scene in a hard copy, this procedure requires an enormous amount of time and therefore is not practicable. Accordingly, the ununiformity in image has presented a significant impediment to the processing of a photographic light sensitive material in a rapid way without adversely affecting the environment. In addition, since it is essential to design a way of maintaining the high sensitivity of a photographic light sensitive material and to ensure the stability during storage of the light-sensitive material, the fogging was a serious problem in the processing of a photographic light sensitive material in a simple and rapid way while minimizing the adverse effects on environment.

SUMMARY OF THE INVENTION

As evident from the foregoing, a task of the present invention is to solve the problems associated with above art and to achieve the following objects. One object of the present invention is to provide a silver halide color photographic light-sensitive material which is well suited for a simple and rapid process causing little harm to the environment, and which has a high sensitivity and produces a high-quality image without ununiformity in the developing process. Moreover, it is also an object of the present invention to provide a method for forming an image which can decrease adverse effects on the environment and can simply and rapidly provide a high-quality image without ununiformity by using the above-mentioned silver halide color photographic light-sensitive material.

In addition, another object of the present invention is to provide a silver halide color photographic light-sensitive material for photographing which is well suited for a simple and rapid process causing little harm to the environment, and which has a high sensitivity and a superior storage stability. Moreover, it is also an object of the present invention to provide a method for forming an image which can decrease adverse effects on the environment and can simply and rapidly provide an image by using the above-mentioned silver halide color photographic light-sensitive material.

The objects of the present invention as described above are achieved by the following means:

(1) A silver halide color photographic light-sensitive material comprising a substrate having a photographic constituent layer coated thereon including at least one light-sensitive layer which comprises a light-sensitive silver halide emulsion, a developing agent, a compound capable of forming a dye by a coupling reaction with the oxidation product of the developing agent, and a binder, the silver halide color photographic light-sensitive material after the exposure thereof being put together with a processing material comprising a substrate having a constituent layer coated thereon including a processing layer comprising a base and/or a base precursor, in the presence of water supplied to the light-sensitive layer of the silver halide color photographic light-sensitive material or to the processing layer of the processing material in an amount ranging from 1/10 to the equivalent of an amount which is required for the maximum swelling of the entire coating layers of these materials, so that the light-sensitive layer and the processing layer face each other, and being heated for the purpose of heat development to form a color image in the silver halide color photographic light-sensitive material, in which the light-sensitive silver halide emulsion contains at least one ion selected from the group consisting of a metal ion and a metal complex ion having respectively an electron trap depth of 0.6 eV or less, and contains at least one kind of tabular grains having an aspect ratio ranging from 4 to 100.

(2) A method for forming a color image, comprising putting together a silver halide color photographic light-sensitive material after the exposure thereof and a processing material comprising a substrate having a constituent layer coated thereon including a processing layer comprising a base and/or a base precursor, in the presence of water supplied to the light-sensitive layer of the silver halide color photographic light-sensitive material or to the processing layer of the processing material in an amount ranging from 1/10 to the equivalent of an amount which is required for the maximum swelling of the entire coating layers of these materials, so that the light-sensitive layer of the silver halide color photographic light-sensitive material and the processing layer face each other, and heating these materials for the purpose of heat development to form a color image in the silver halide color photographic light-sensitive material, in which the silver halide color photographic light-sensitive material is the silver halide color photographic light-sensitive material described above.

DESCRIPTION OF THE PREFERRED EMBODIMENTS

The light-sensitive silver halide emulsion to be used in the silver halide color photographic light-sensitive material is described below.

The light-sensitive silver halide emulsion contains at least one ion selected from the group consisting of a metal ion and a metal complex ion having respectively a shallow electron trap depth.

Heretofore, it is an art-recognized technique to incorporate a metal ion and/or a metal complex ion (hereinafter referred to as "metal ions etc." upon occasion) into silver halide emulsion grains. However, this technique utilizes the above-mentioned metal ions etc. for processing a photographic light-sensitive material requiring the use of a processing solution containing a developing agent or for the heat development of a light-sensitive material for print for the purpose of the realization of a high sensitivity, adjustment of the law of reciprocity, control of gradation, improvement of the storage stability of a latent image and reduction of the temperature dependence at the time of exposure. This technique, however, is entirely different from the technique of the present invention of the silver halide color photographic light-sensitive material.

Accordingly, nowhere is disclosed the effect of the present invention that consists in obtaining a high-quality image characterized by high sensitivity and freedom from ununiformity in a developing process by adjusting the depth of the electron trap of metal ions etc. in a photographic high-sensitivity light-sensitive silver halide emulsion designed for heat development. This effect of the present invention was found only after the studies conducted by the inventors.

In the present invention, the depth of the shallow electron trap is preferably 0.6 eV or less (a maximum of 0.6 eV), more preferably 0.4 eV or less (a maximum of 0.4 eV), and most preferably 0.2 eV or less (a maximum of 0.2 eV).

If metal ions etc., such as $[RhCl_5(H_2O)]^{2-}$, $[RhCl_4(H_2O)_2]^-$, $[RuCl_5(NO)]^{2-}$, $[Cr(CN)_6]^{3-}$, $[RhCl_6]^{3-}$ and $[RhBr_6]^{3-}$, which have each an electron trap depth greater than 0.6 eV, are used, undesirable effects are that the improvement of the temperature dependence in the developing process is insufficient, that the reduction in sensitivity is significant and that ununiformity in the image becomes liable to occur in a developing process at a high temperature. On the other hand, if metal ions etc. which have each a shallow electron trap depth of 0.6 eV or less are used, the above-mentioned undesirable effects are prevented and the desirable effects are that a favorable influence is exerted in the exposure step, that the light sensitive material is influenced less by the fluctuation in the conditions of the developing process and that a large latent image can be formed. This is presumably because the metal ions etc. which are each an electron trap having an appropriate depth prevent the dispersion of the latent image and therefore the latent image becomes larger. In addition, the use of an electron trap having a shallow depth of 0.6 eV or less increases the sensitivity of the light-sensitive material and makes it possible to obtain a high-quality image without ununiformity. This desirable effect is significant if the depth is 0.4 eV or less and preferably 0.2 eV or less.

A metal ion and a metal complex ion which can become the above-mentioned shallow electron trap depth are given below.

Examples of a metal ion and a metal complex ion which can act as shallow electron traps having a depth of 0.2 ev or less are $Pb^{2+}$ and $[M(CN)_xL_yN_z]$, where M is selected from the group consisting of $Re^+$, $Os^{2+}$, $Ru^{2+}$, $Fe^{2+}$, $Ir^{3+}$ and $Co^{3+}$, x is an integer of from 4 to 6, L and N are an inorganic ligand such as halide ions (for example, a fluoride ion, a chloride ion, a bromide ion and an iodide ion), $SCN^-$, $NCS^-$ and $H_2O$, or an organic ligand such as pyridine, phenanthroline, imidazole and pyrazole, y and z are numerals determined so as to satisfy the equation x+y+z=6. The coordination number is usually 6 when a ligand is present.

Examples of a metal ion and a metal complex ion which may act as a shallow electron traps having a depth ranging from 0.2 eV to 0.6 eV include ions containing a halide ion ligand or a thiocyanate ion ligand and Ir or Pd. Among these ions, for example, $[IrCl_6]^{3-}$, $[IrBr_6]^{-3}$, $[Ir(SCN)_6]^{3-}$, $[IrI_6]^{3-}$ and the like may be preferably used.

The light-sensitive silver halide emulsion may contain at least one ion selected from the group consisting of a metal ion and a metal complex ion which act as each a relatively deep electron trap in addition to at least one ion selected from the group consisting of a metal ion and a metal complex ion which act as each a shallow electron trap.

If the light-sensitive silver halide emulsion contains at least one ion selected from the group consisting of a metal ion and a metal complex ion having respectively a shallow electron trap depth together with at least one ion selected from the group consisting of a metal ion and a metal complex ion which act as each a relatively deep electron trap, the depth of the shallow electron trap is preferably 0.2 eV or less (a maximum of 0.2 eV) and more preferably 0.1 eV or less (a maximum of 0.1 eV).

On the other hand, the depth of the relatively deep electron trap is preferably 0.35 eV or more (a minimum of 0.35 eV) and more preferably 0.5 eV or more (a minimum of 0.5 eV).

Examples of a metal ion or metal complex ion which may act as a relatively deep electron trap include ions containing a halide ion ligand or a thiocyanate ion ligand and Ir, Rh, Ru or Pd, ions containing at least one nitrosyl ligand and Ru, and ions containing a cyano ligand and Cr. Among these ions, for example, $[IrCl_6]^{3-}$, $[IrBr_6]^{-3}$, $[Ir(SCN)6]^{3-}$, $[IrI_6]^{3-}$, $[RhCl_5(H_2O)]^{2-}$, $[RhCl_4(H_2O)_2]^-$, $[(RuCl_5(NO)]^{2-}$, $[Cr(CN)_6]^{3-}$, $[RhCl_6]^{3-}$, $[RhBr_6]^{3-}$, $[PdCl_6]^{5-}$ and the like may be preferably used.

A value of the depth of the electron traps caused by the metal ions and metal complex ions may be obtained by means of dynamic measurement using ESR, as described in R. S. Eachus, R. E. Grave and M. T. Olm, Phys. Stat. Sol (b), vol. 88, (1978), p.705.

The depth of the electron trap may vary depending on the central metal ion, the ligand, the symmetry of the point group of the complex (Oh, D4h, C4v, etc.), and the halogen composition of the substrate. The depth of the electron trap may be determined depending on whether the energy level of the lowest non-occupied orbital of the electron of the metal ion or metal complex ion is lower or higher than that of the minimum conduction band of the silver halide.

When the energy level of the lowest non-occupied orbital of the metal ion is higher than that of the conduction band of the silver halide, a shallow electron trap may be obtained, since an electron is loosely bound by the Coulomb force of the central metal ion.

When the energy level of the lowest non-occupied orbital of the metal ion is lower than that of the conduction band of the silver halide, the difference in energy levels of the conduction band and the lowest non-occupied orbital of the metal ion corresponds to the depth of the electron-trap and a relatively deep electron trap may be obtained.

The use of a metal ion or a metal complex ion in a light-sensitive silver halide emulsion is well known in an emulsion, particularly in a tabular emulsion, designed for a photographic light-sensitive material requiring the use of a processing solution containing a developing agent, as disclosed in, for example, Japanese Patent Application Laid-Open (JP-A) No. 8-101,474, European Patent No. 0,699,947 and JP-A No. 4-211,144, and the effects of the use of the metal ion or the metal complex ion include the realization of a high sensitivity, improvement of the law of reciprocity, adjustment of sensitivity, and improvement in stability of the emulsion.

However, nowhere is disclosed the effect that the increase in Dmin during the storage of a silver halide color photographic light-sensitive material of the present invention, which is a photographic light-sensitive material containing a developing agent, can be minimized while maintaining a high-sensitivity, if a combination of a metal ion or a metal complex ion which are each a shallow electron trap and a metal ion or a metal complex ion which are each a relatively deep electron trap is used in the silver halide color photographic light-sensitive material.

Meanwhile, JP-A Nos. 1-116,637, 2-236,542 and 5-181,246, Japanese Patent Application No. 7-122,733, and U.S. Pat. No. 5,434,043 disclose a method in which Ir is incorporated in the silver halide emulsion of a light-sensitive material containing a developing agent for heat development in order to diminish the fogging due to the heat development, a method in which an iron ion is incorporated in the silver halide emulsion of a light-sensitive material containing a developing agent for heat development in order to impart stability against the fluctuation of exposure, a method in which a polyvalent ion is incorporated in the silver halide emulsion of a light-sensitive material containing a developing agent for heat development in order to diminish fogging and to increase sensitivity, a method in which Ir or Rh is incorporated in the silver halide emulsion having a high silver chloride content of a light-sensitive material containing a developing agent for heat development in order to obtain a contrasty image even by a high-illumination exposure, and a method in which Ir is incorporated in the silver iodobromide of a light-sensitive material containing a developing agent, for example, a light-sensitive material such as so-called dry silver in order to make the light-sensitive material suitable to a high level of illumination. However, these techniques of prior art are designed for the light-sensitive materials for use in print or in printing materials, and therefore are entirely different from the technique of the present invention in which the storage stability of the light-sensitive material is improved while maintaining the high sensitivity in the silver halide color photographic light-sensitive material containing a developing agent and using an emulsion composed of tabular grains. Accordingly, the mere application of these techniques of prior art cannot lead to the achievement of the objectives of the present invention.

After studies, the present inventors have found that the increase in Dmin due caused inside the developing agent during storage can be minimized while high-sensitivity is increased, if a metal ion and/or a metal complex ion which are each a shallow electron trap are used in combination with a metal ion and/or a metal complex ion which are each a relatively deep electron trap.

The phenomenon that a metal ion and/or a metal complex ion which are each a relatively deep electron trap inhibits the increase in Dmin in the developing agent system during storage of a silver halide color photographic light-sensitive material is presumably caused by making ineffective the electrons which are injected from the developing agent into the silver halide during the storage and which cause Dmin to increase.

An amount of the above described metal ion or metal complex ion added to the light-sensitive silver halide emulsion is approximately in the range of $10^{-9}$ to $10^{-2}$ mole per one mole of silver halide.

In the light-sensitive silver halide grains, the metal ions and/or metal complex ions (hereinafter to be referred to as "metal ions etc.") may be incorporated uniformly or locally within the grains, or incorporated on the surface of grains in an exposed state, or they may be localized in the vicinity of the surface of the grains without being exposed to the surface of the grains.

Epitaxial grains may be crystals of substrate or crystals of junctions. In light-sensitive silver halide emulsion having a plurality of phases each containing different halogen composition, metal ions to be incorporated may be changed corresponding to the halogen compositions.

More concretely, for example, preferable embodiments include the formation of an epitaxial junction between an AgBr crystal containing an Ir ion and a base of AgCl tabular grains containing potassium ferrocyanide, the concentration of the metal ions etc. which are the aforementioned shallow electron trap and/or relatively deep electron trap to the portion to which the dislocation lines concentrate in the fringe-type high-density dislocation silver iodobromide grains having in the vicinity of the surface thereof a region where a high silver iodide content is localized, and the formation of an epitaxial junction crystal containing the aforementioned metal ions etc. which are a shallow trap to a silver iodobromide base containing the aforementioned metal ions etc. which are a relative deep trap. Further, the silver halide grains may have the regions, for example, a region where the two kinds of the metal ions etc. are present together, a region where the metal ions etc. which are a shallow trap are present alone, a region where the metal ions etc. which are a relatively deep trap are present alone, a region where the two kinds of the metal ions etc. are present together along with a region where the metal ions etc. which are a shallow trap are present alone and/or a region where the metal ions etc. which are a relatively deep trap are present alone. Furthermore, the silver halide grains may have a region where absolutely none of the metal ions etc. is present together with any one of the foregoing five regions.

Addition of the above described metal ions etc. may be carried out (1) by mixing a solution of the metal salt containing the metal ion etc. with an aqueous solution of silver salt or an aqueous solution of a halide compound used in grain formation, and continuously adding the resultant mixture to another mixture containing other components to be used in the grain formation, or (2) by adding, to an emulsion, light-sensitive silver halide fine grains in which the metal ions etc. are doped, or (3) by adding directly, to an emulsion, an aqueous solution of the metal salt containing the metal ions prior to, during, or after grain formation.

When the metal salt is dissolved in a suitable solvent such as water, methanol, acetone, or the like, a method of adding an aqueous solution of hydrogen halide (for example, HCl, HBr), thiocyanic acid or salts thereof, or alkali halide (for example, KCl, NaCl, KBr, NaBr, etc.) for stabilization of the solution. It is, further, preferable in the stabilization of the solution to add, if necessary, acid, alkali, or the like.

The amount of said metal ions etc. in the light-sensitive silver halide emulsion may be measured by, for example, atomic-absorption spectroscopy, polarization Zeeman spectroscopy, ICP analysis, etc. The presence of ligands of metal complexes ions such as $CN^-$, $SCN^-$, $NO^-$, etc. in the light-sensitive silver halide emulsion may be confirmed by IR-absorption (especially, FT-IR).

The silver halide composition in the tabular grains of the light-sensitive silver halide emulsion of the present invention is preferably any of silver chloride, silver iodochloride, silver chlorobromide, silver iodochlorobromide and silver iodobromide. In addition, other silver salt, such as silver thiocyanate, silver sulfide, silver selenide, silver carbonate and silver phosphate, or an organic silver compound, such as a silver/benzotriazole compound, may make up a solute portion in the silver halide grains or may be adjoined to the silver halide grains.

The above-mentioned halide composition may be uniform or different between the grain interior and the grain surface. In the latter case, the silver halide grain is a multilayered or laminate-structured grain and the like. Further, grains of a silver halide emulsion having a different composition may be adjoined by an epitaxial junction to the silver halide grains.

A silver halide emulsion having a high silver chloride content generally has a feature that the developing activity is high. It has also the feature that the deterioration of the image information is insignificant at the time when the processed light-sensitive material without fixation thereof is read by a scanner, because little haze is generated.

In the present invention, it is possible to use silver halide in which a localized phase in a layer or non-layer state having a different composition is present in a silver halide grain interior and/or surface. The halogen composition of the localized phase can be analyzed by, for example, X-ray diffraction and electron microprobe analysis. For example, the application of the X-ray diffraction to silver halide is described in C. R. Berry and S. J. Marino, "Photographic Science and Technology", vol. 2, pp.149 (1955) and vol. 4, pp.22 (1957). Although the localized phase may be present in the interior, edges of the surface, corners or faces of the grain, it is present preferably in the form of an epitaxial junction to a corner of the grain, as described in JP-A Nos. 58-108,526, 59-133,540, 59-119,350, 6-194,768 and European Patent No. 0,699,944.

As in the case of conventional photographic light-sensitive material, silver chloride may be contained even in a light-sensitive silver halide emulsion composed mainly of silver iodobromide in the present invention. In this case, however, the silver chloride content is preferably 8 mol % or less and more preferably 3 mol % or less.

In the present invention, it is preferable to use light-sensitive silver halide emulsion containing silver iodobromide grains having a laminate structure composed of a plurality of layers of different halogen compositions such that the grain has at least one layer which has a silver iodide content higher than that of other adjacent layers on the side facing the interior thereof and also than that of another adjacent layer on the side facing the exterior surface thereof.

In the case where use is made of a light-sensitive silver halide emulsion composed of silver chlorobromide or silver chloride, the emulsion may contain silver iodide, too. In this case, however, the silver iodide content is preferably 6 mol % or less and more preferably 2 mol % or less.

Although a silver halide emulsion having a high silver chloride content is not favorable to the adsorption of a sensitizing dye, the adsorption of dye can be enhanced by use of grains whose surfaces are rendered rich in silver iodide or silver bromide.

The halogen composition in the surface of the light-sensitive silver halide grains may be measured by X-ray electron spectroscopy for chemical analysis (ESCA).

The halogen composition distribution (silver bromide content, silver iodide content and silver chloride content) among the light-sensitive silver halide emulsion grains is preferably narrow. The variation coefficient of the halogen composition distribution is preferably 3 to 30%, more preferably 3 to 25% and most preferably 3 to 20%. The variation coefficient means a value of a dispersion (standard deviation) divided by the average.

The halogen composition distribution of an individual light-sensitive silver halide emulsion can be obtained by use of, for example, an electron probe X-ray microanalyzer (EPMA)

In a tabular particle of the light-sensitive silver halide emulsion, if the principal faces (outer faces having a larger area and made up of parallel planes) are made up of a (111) plane, the shape of the grain is a parallel multiple twin crystal having two or more parallel twin planes, and, if the outer faces are made up of a (100) plane, no twin plane is present. The distance between the twin planes can be 0.012 μm or less, as described in U.S. Pat. No. 5,219,720. Also, the distance between principal (111) planes divided by the distance between twin planes can be 15 or more as described in JP-A No. 5-249,585.

If the principal planes are a (111) plane, the grain of the light-sensitive silver halide emulsion is in a triangular or hexagonal shape, or in a more round shape indicative of a circle or an ellipse, when viewed from above.

Even if the principal planes are (111) planes, the side planes linking the principal planes may be a (111) plane or a (100) plane, or a mixture of both, or may even include planes of a higher index.

If the outer face is a (100) plane, the grain of the light-sensitive silver halide emulsion is in a rectangular shape, when viewed from above.

In the light-sensitive silver halide emulsion used in the present invention, the percentage of the projected area taken up by the tabular grains in the total projected area of all the grains is preferably 80 to 100%, more preferably 90 to 100%, and even more preferably 95 to 100%.

The average grain thickness of the tabular grains in the light-sensitive silver halide emulsion used in the present invention is preferably 0.005 to 0.2 μm, and more preferably 0.01 to 0.15 μm. As used herein, the average grain thickness means the calculated mean grain thickness of all the tabular grains in the light-sensitive silver halide emulsion.

The equivalent-circle diameter of the average projected area of the tabular grains in the light-sensitive silver halide emulsion is preferably 0.2 to 8 μm, more preferably 0.3 to 5 μm, and most preferably 0.4 to 4 μm.

In the light-sensitive silver halide emulsion, the ratio of the equivalent-circle diameter to the average thickness of the tabular grain is called the aspect ratio. The average aspect ratio of the tabular grains of the light-sensitive silver halide emulsion in the present invention is preferably 4 to 100, and more preferably 6 to 80. If the aspect ratio is less than 4, the sensitivity is adversely affected. On the other hand, if the aspect ratio exceeds 100, the pressure resistance of the grains is undesirably reduced and therefore the grain size distribution tends to be a polydispersion. As used herein, the average aspect ratio means a calculated average of the aspect ratios of the all tabular grains contained in the light-sensitive silver halide emulsion.

If the plane of projection of the tabular grains of the light-sensitive silver halide emulsion is hexagonal, the proportion of the projected area of the hexagonal tabular grains in which the ratio of the length of the longest side to the length of the shortest side is in the range of 1 to 2 is preferably 50 to 100%, more preferably 70 to 100%, of the total projected area of all the grains contained in the light-sensitive silver halide emulsion. A hexagon-shaped tabular grain in which the ratio is in the vicinity of 1 is preferable.

If the plane of projection of the tabular grains of the light-sensitive silver halide emulsion is rectangular, the proportion of the projected area of the rectangular tabular grains in which the ratio of the length of the longest side to the length of the shortest side is in the range of 1 to 2 is preferably 50 to 100%, more preferably 70 to 100%, of the total projected area of all the grains contained in the light-sensitive silver halide emulsion. A square tabular grain in which the ratio is in the vicinity of 1 is preferable.

The shapes of the grains of the light-sensitive silver halide emulsion can be measured under a transmission electron microscope by means of a carbon replica method in which the sample silver halide grains and referential latex spheres acting as a size standard are simultaneously subjected to shadowing treatment with, for example, a heavy metal.

In the present invention, it is preferable to use a monodispersed light-sensitive silver halide emulsion having a narrow grain size distribution. As used herein, a monodispersed light-sensitive silver halide emulsion means a light-sensitive silver halide emulsion whose grain size distribution has a variation coefficient of 30% or less. The use of the monodispersed light-sensitive silver halide emulsion is described in Trevor maternaghan, "Surfactant Science Series (Technological Applications of Dispersions)", vol.52, pp.373 (1994).

Besides, it is also possible to use a polydispersed light-sensitive silver halide emulsion having a broad grain size distribution.

As disclosed i n JP-A Nos.1-67,743 and 4-223,463, for the purpose of the adjustment of gradation, two or more monodispersed light-sensitive silver halide emulsions may be used together which are each sensitive to the same color but have different grain sizes. The two or more monodispersed light-sensitive silver halide emulsions may be mixed in the same layer, or these emulsions may form separate layers. it is also possible to use a combination of two or more polydispersed light-sensitive silver halide emulsions or a combination of a monodispersed light-sensitive silver halide emulsion and a polydispersed light-sensitive silver halide emulsion.

Methods for preparing silver bromide emulsions, silver (iodo)bromide emulsions and silver (chloro)bromide emulsions composed of tabular grains made up of a (111) plane are disclosed in, for example, JP-A Nos. 55-142,329, 58-113,926, 58-113,927 and 58-113,928, U.S. Pat. Nos. 4,914,014 and 4,942,120, JP-A No. 2-222,940, and U.S. Pat. Nos. 5,013,641 and 4,414,306. Among these methods, the methods for preparing tabular grains by use of a polyalkyloxide compound described in U.S. Pat. Nos. 5,147,771 to 5,147,773, 5,171,659, 5,210,013 and 5,252,453 are preferable.

In order to prepare tabular grains having a high average aspect ratio in a light-sensitive silver halide emulsion, it is important to grow small twin nuclei. For this purpose, it is desirable to form the nuclei at low temperature, high pBr, low pH, and with a smaller amount of gelatin, or gelatin having a smaller methionine content, or gelatin having a smaller molecular weight, or a phthalated gelatin derivative and over a shorter time period.

After the formation of the nuclei, physical ripening is carried out to selectively grow tabular grain nuclei (nuclei having multi-parallel twin planes) alone by eliminating other nuclei, i.e., nuclei of regularly-structured crystals, nuclei having a single twin plane and nuclei having non-parallel multiple twin planes. Then, a combination of a soluble silver salt and a soluble halogen salt, or a silver halide emulsion composed of fine grains having a smaller grain size is added to the obtained nuclei to grow the grains, and an emulsion comprising tabular grains is prepared after the growth of the grains.

Methods for preparing silver bromide tabular grains or silver (chloro)bromide tabular grains made up of a (100) plane are described in U.S. Pat. No. 4,063,951 issued to T. G. Bogg and in JP-A No.58-95,337 issued to A. Mignot.

Tabular grains of silver halide emulsion having a high silver chloride content and made up of a (111) plane are described in, for example, U.S. Pat. Nos. 4,399,215, 4,400,463 and 5,217,858 and in JP-A No.2-32. Since the silver halide grain having a high silver chloride content generally has a (100) plane as the exterior face in the absence of an adsorbed substance, a light-sensitive silver halide emulsion containing tabular grains is prepared by a procedure comprising forming twin nuclei by use of an adsorptive substance which will be selectively adsorbed on a (111) plane, selectively obtaining nuclei having multi-parallel twin planes by eliminating nuclei of regularly-structured crystals, nuclei having a single twin plane and nuclei having non-parallel multiple twin planes in a physical ripening stage, and growing the selectively obtained nuclei.

An empirical rule of the growth of the tabular grains having a (111) plane of a silver halide emulsion having a high silver chloride content is described in "Journal of Photographic Science", vol. 36, pp.182 (1988)

Tabular grains of silver halide emulsion having a high silver chloride content and made up of a (100) plane are described in, for example, U.S. Pat. Nos. 4,946,772, 5,275,930, 5,264,337 and in JP-A Nos.5-281,640 and 5-313,273, and European Patent No. 0,534,395A1. The key to the preparation of the tabular grains is the growth of the nuclei which grow in a tabular shape. For this purpose, it is effective to add a bromide ion or an iodide ion or to add a compound which is adsorbed selectively onto a specific plane at an early stage of the grain formation. After the formation of the nuclei, a light-sensitive silver halide containing tabular grains is prepared by physical ripening and growth of the grain. The grains are grown by the addition of a combination of a soluble silver salt and a soluble halogen salt, or a silver halide emulsion composed of fine grains having a smaller grain size.

The tabular grains are advantageous for sensitivity, since surface area is large and an amount of the sensitizing dye which is adsorbed by the tabular grains are large compared to normal crystals having the same volume.

Accordingly, when comparing with the same sensitivity, the volume of tabular grains is smaller than that of normal crystals. When comparing with the same sensitivity and the same amount used (in weight), the number of tabular grains used is greater than that of the normal crystals used. Therefore, the number of points at which development can start increases and graininess, which is an important quality in light-sensitive material, is excellent.

Further, the amount of silver coated may be reduced due to excellent graininess and radiation fogging which is a disadvantageous problem for high sensitive photographic light-sensitive material may be significantly inhibited.

Further, the reduction in the amount of coated silver is effective in decreasing haze which is responsible, at the time of scanning, for degradation of images recorded on a light-sensitive material which has not been subjected to a fixing process after development.

Moreover, the tabular grains have high developing activity because of large surface area thereof.

Further, the tabular grains may enable the layer of light-sensitive material to be thin and may be excellent in sharpness, since they are oriented at the time of coating.

From the above description, the tabular grains are essential for photographic light-sensitive materials.

In so far as the pressure resistance of the grains and the monodispersion of the grain size distribution are not impaired, a larger value of the average aspect ratio of the tabular grains is desirable from the viewpoint of sensitivity, graininess, activity, reduction of the coated amount of silver, and the like.

The tabular grains in the light-sensitive silver halide emulsion used in the present invention may have dislocation lines. As used herein, the dislocation lines means linear lattice defects present in the boundary, on the slip planes of crystals, between a region which has already slipped and a region which has not yet slipped.

With respect to the dislocation lines of light-sensitive silver halide crystals, there are references such as (1) C. R. Berry, J. Appl. Phys., 27,636(1956), (2) C. R. Berry, D. C. Skilman, J. Appl. Phys., 35,2165(1964), (3) J. F. Hamilton, Phot. Sci. Eng., 11,57(1967), (4) T. Shiozawa, J. Soc. Phot. Sci. Jap., 34,16(1971), (5) T. Shiozawa, J. Soc. Phot. Sci. Jap., 35,213 (1972), etc. The dislocation lines of silver halide crystals may be analyzed by x-ray diffractiometry or by direct observation method under a low temperature transmission electron microscope.

When the dislocation lines are directly observed under a transmission electron microscope, a sample of silver halide grain is picked up from light-sensitive silver halide emulsion meticulously so as not to apply pressure that causes the said dislocation lines in the light-sensitive silver halide grains, and is put on a mesh for electron microscopic observation to observe the sample by the transmission method while the sample is cooling to prevent damage by electron rays (for example, print-out).

In this case, the thicker the silver halide grains become, the less electron beams transmit. Clear observation may be achieved by making use of a high-pressure type electron microscope (for example, more than or equal to 200 kV for 0.25 mm in thickness) Japanese Patent Application Laid-Open (JP-A) No. 63-220,238 discloses an invention related to introducing dislocation lines into silver halide grains.

It is shown that tabular grains into which dislocation lines have been introduced are superior to those without dislocation lines in photographic characteristics such as sensitivity, reciprocity law, etc.

In tabular grains, the position and number of dislocation lines of each grain observed from the vertical direction to the principal plane may be obtained from photography of grains taken by the aforesaid electron microscope.

When tabular grains in the light-sensitive silver halide emulsion used in the present invention have dislocation lines, the dislocation lines may be introduced optionally into the apex or fringe portions of grains or over the whole principal plane, but it is particularly preferable to restrict them to the fringe portion.

As used herein, the term "fringe portion" refers to the outer periphery of the tabular grain, and specifically, the portion of the grain at the outer side of a line which is determined as follows. A plurality of lines are drawn from the center of the grain, and for each line, the content of silver iodide at each of plural points along the line is measured. A graph is prepared illustrating the distribution of the silver iodide content along the length of the line. The graphed distribution is observed from the point corresponding to the outermost end of the line (i.e., the end opposite the center), and the point at which the distribution first intersects a line representing the average silver iodide content in the graph is noted. The position of the line drawn in the grain which position corresponds to this intersection is noted. This process is repeated for each line, and the determined positions are connected by a line. The portion of the grain at the outer side of this line is known as the fringe portion.

In the present invention, when the tabular grain has dislocation lines, the density of said dislocation lines is optional and may be suitably selected from, for example, more than or equal to 10 lines, 30 lines, 50 lines, or the like per grain.

Next, an explanation is given below on the light-sensitive silver halide emulsion containing tabular grains and other light-sensitive silver halide emulsion to be used in combination therewith. Hereinafter, both emulsions are referred to as "silver halide emulsion".

For general silver halide grain formation, reference will be made, for example, to P. Glafkides, Chimie et Physique Photographique, Paul Montel, 1967, G. F. Duffin, Photographic Emulsion Chemistry, Focal Press , 1966, V. L. Zelikman et al., Making and Coating Photographic Emulsion, Focal Press, 1964, and the like. Latent images can be formed at the surface of the silver halide grains, within the grains or in the vicinity of grain surface. That is, a method for preparing silver halide emulsions may be selected from an acidic method, a neutral method and an ammonia method. PH of a liquid phase for the formation of silver halide can be high to the extent of no occurrence of fogging. Further, any method selected from a single jet method, a double jet method and a combination thereof may be used as a method for reacting a soluble silver salt with a soluble halides.

A method in which grains are formed in the presence of an excess of silverion (a reversed method) can also be employed. A so-called controlled double jet method in which pAg of the liquid phase for the formation of silver halide is kept constant can also be employed as a double jet method. According to this method, it is possible to obtain a silver halide emulsion which has a regular crystal system and whose grain size distribution and halogen composition are nearly uniform.

As described in U.S. Pat. No. 4,879,208, it is also preferable to add an emulsion which is composed of extremely fine grains and which is prepared on site when the above-mentioned silver halide emulsion is being prepared to the emulsion preparing tank, and then to grow the grains by means of physical ripening. The emulsion which is composed of extremely fine grains may be prepared in advance.

When the silver halide emulsion is being prepared, it is preferable to adjust pAg and pH in the process. The adjustment of pAg and pH is described in "Photographic Science and Engineering", vol. 6, pp.159–165 (1962), "Journal of Photographic Science", vol.12, pp.242–251 (1964), U.S. Pat. No. 3,655,394 and British Patent No.1,413,748.

As a protective colloid used at the time of preparation of the emulsion in the present invention, a gelatin may be preferably used, but other hydrophilic binders may also be used. The hydrophilic binders may be used singly or in combination with gelatin. Examples of the hydrophilic binders include, for example, derivatives of gelatin, graft polymers of gelatin and other polymers, proteins such as albumin, casein, and the like, cellulose derivatives such as hydroxyethyl cellulose, cellulose sulfate, and the like, sodium alginate, derivatives of starch, polysaccharides, carrageenans, synthetic hydrophilic polymers such as homopolymers and copolymers (polyvinyl alcohol, modified alkyl polyvinyl alcohol, polyvinyl/N-pyrrolidone, polyacrylic acid, polymethacrylic acid, polyacrylamide, polyvinyl imidazole, polyvinyl pyrazole) and thioether polymers described in U.S. Pat. No. 3,615,624.

As the gelatin, derivatives of gelatin such as lime-treated gelatin, acid-treated gelatin, delimed gelatin, phthalated gelatin, carbamoyl gelatin, esterified gelatin or low molecular weight gelatin may be preferably used at the time of formation of tabular grains. It is also known that gelatin treated with oxidizing agents such as hydrogen peroxide is effective at the time of formation of tabular grains. A gelatin treated with an enzyme described in Bull. Soc. Photo. Japan. No. 16, p.30 (1966) maybe used as low molecular weight gelatin. A hydrolysis or enzyme decomposition product of gelatin may also be used.

It is preferable to use a solvent for silver halide at the time of preparation of the silver halide emulsion. Examples of a solvent for silver halide include thiocyanates (described in U.S. Pat. Nos. 2,222,264, 2,448,534, and 3,320,069), thioether compounds (described in U.S. Pat. Nos. 3,271,157, 3,574,628, 3,704,130, 4,297,439, and 4,276,347), thion compounds (described in Japanese Patent Application Laid-Open (JP-A) Nos. 53-144,319, 53-82,408, and 55-77,737), imidazole compounds (described in Japanese Patent Application Laid-Open (JP-A) No. 54-100,717), benzimidazole (described in Japanese Patent Application Publication (JP-B) No. 60-54,662) and amine compounds (described in Japanese Patent Application Laid-Open (JP-A) No. 54-100, 717).

Ammonia may be used in combination with the solvent for silver halide in an amount that does not produce adverse effects. Nitrogen-containing compounds as described in Japanese Patent Application Publication (JP-B) No. 46-7, 781 and Japanese Patent Application Laid-Open (JP-A) Nos. 60-222,842 and 60-122,935 may be added at the time of forming silver halide grains. Examples of solvents for silver halide are described on pages 12 to 18 of Japanese Patent Application Laid-Open (JP-A) No. 62-215,272.

When grains of the silver halide emulsion are formed, the speed up of grain formation can be made by increasing the adding rate, the adding amount or the adding concentration of the silver salt solution (for example, $AgNO_3$ aqueous solution) and the halogen compound solution (for example, KBr aqueous solution). Methods for rapidly forming silver halide grains in the above-mentioned manner are described in British Patent No.1,335,925, U.S. Pat. Nos. 3,672,900, 3,650,757 and 4,242,445, JP-A Nos. 55-142,329, 55-158, 124, 58-113,927, 58-113,928, 58-111,934 and 58-111,936.

During the grain forming process or after the formation of grains of the silver halide emulsion, the halogen of the silver halide grains may be substituted with a halogen which produces silver halide grains having a low solubility (halogen substitution). This halogen substitution process is described in "Die Grundlagen der Photographischen Prozesse mit Silverhalogeniden", pp. 662–669 and "The Theory of Photographic Process", 4th edition, pp.97–98. This process may be performed by using a solution of a soluble halide or a silver halide emulsion having fine grains.

Thiosulfonates, dichalcogen compounds described in U.S. Pat. Nos. 5,219,721 and 5,364,754, lipoic acid, cysteine, elemental sulfur or an inorganic metal complex such as a cobalt ammonium complex may be added to an emulsion during and/or after formation of grains.

In the step of formation of silver halide grains or physical ripening, metal salts (including complexes) may coexist. Examples of metal salts include salts or complexes of cadmium, zinc, thallium, platinum, gallium, copper, nickel, manganese, indium, tin, calcium, strontium, barium, aluminum, bismuth, etc. These compounds may be used singly or in a combination of more than or equal to two types thereof. These compounds may be added approximately in the range of $10^{-9}$ to $10^{-3}$ mole per mole of silver halide. These metals may be preferably used as water-soluble salts such as anammonium salt, acetate, nitrate, sulfate, phosphate, hydroxide, a six-coordinate complex, a four-coordinate complex, and the like, Bromide ions, chloride ions, cyanide ions, nitrosyl ions, thiocyanide ions, thionitrosyl ions, water, ammonium, oxo, carbonyl, and the like, and a combination thereof may be preferably used as a complex ion and coordinate compound. The amount of addition depends on the object, but may be, in general, in the range of $10^{-9}$ to $10^{-2}$ per mole of silver halide. These metal salts may be incorporated uniformly in silver halide grains, or localized on the surface or inside of grains, or incorporated in a phase where silver bromide grains are localized or in a substrate of grains containing silver chloride in high concentration. Addition of these compounds may be carried out (1) by mixing a solution of the metal salt with an aqueous solution of silver salt or an aqueous solution of a halide compound used in grain formation, and continuously adding the resultant mixture to another mixture containing other components to be used in the grain formation, or (2) by adding, to an emulsion, silver halide fine grains in which the metal ions are doped, or (3) by adding directly, to an emulsion, an aqueous solution of the metal salt prior to, during, or after grain formation.

It may be advantageous to add chalcogenide compounds as described in U.S. Pat. No. 3,772,031 during a preparation of emulsion. Apart from S, Se, and Te, cyanate, thiocyanate, selenocyanate, carbonate, phosphate or acetate may be present.

In the process for preparing the light-sensitive silver halide emulsion used in the present invention, it is preferable that a salt removing process be conducted in order to remove excessive salt. For the removal of salt, employable methods include a Noodle water-washing method in which a salt is removed by the gelation of gelatin and a flocculation method which utilizes such material as an inorganic salt comprising a polyvalent anion (e.g., sodium sulfate), an anionic surfactant, an anionic polymer (e.g., sodium polystyrene sulfonate) or a gelatin derivative (e.g., aliphatic-acylated gelatin, aromatic-acylated gelatin and aromatic-carbamoylated gelatin). A method utilizing an ultrafiltration apparatus such as those described in U.S. Pat. Nos. 4,758,505 and 4,334,012, Japanese Patent Application Laid-Open (JP-A) No.62-113,137 and Japanese Patent Application Publication (JP-B) No.59-43,727, a spontaneous flocculation method and a centrifugation method may be used. A flocculation method is usually preferably used.

In the present invention, a light-sensitive silver halide emulsion may be used without chemical sensitization but is normally chemically sensitized. A sensitizing method by means of chalcogen, such as sulfur sensitization, selenium sensitization or tellurium sensitization, a sensitizing method by means of a rare metal, such as gold, platinum or palladium, and a sensitizing method by means of reduction may be used alone or in combination thereof as a chemical sensitizing method of the light-sensitive silver halide emulsion used in the present invention (see, for example, Japanese Patent Application Laid-Open (JP-A) Nos. 3-110,555 and 5-241,267). A chemical sensitization according to any of the above-mentioned methods can be effected in the presence of a nitrogen-containing heterocyclic compound (Japanese Patent Application Laid-Open (JP-A) No. 62-253,159). Besides, an anti-fogging agent, which is described later, may be added to a silver halide emulsion after the chemical sensitization thereof. More concretely, the methods, which are described in Japanese Patent Application Laid-Open (JP-A) Nos. 5-45,833 and 62-40,446, can be used.

The above-described chemical sensitization can be performed at any stage of the manufacturing process of the light-sensitive silver halide emulsion. A variety of emulsions can be prepared by differentiating the manufacturing stage at which the chemical sensitization is performed. The types of the sensitization include a type in which nuclei of chemical sensitization are embedded in the grain interior, a type in which nuclei of chemical sensitization are embedded in a region close to the surface of the grain and a type in which nuclei of chemical sensitization are formed on the grain surface. Also, it is possible to form nuclei of chemical sensitization in grain interior or surface or in a shallow region in the vicinity of the grain surface. For example, although nuclei of a reductive sensitizer are preferably formed in the grain interior, and nuclei of a chalcogen sensitizer and/or a gold chalcogen sensitizer are preferably formed on the grain surface. A variety of combinations are possible depending on demands.

A sulfur sensitizer is composed of an unstable sulfur compound. As a sulfur sensitizer, known sulfur compounds can be used, and the examples include thiosulfates (such as hyposulfite), thiourea (such as diphenylthiourea, triethylthiourea and allylthiourea), allylisothiocyanate, cystine, p-toluene thiosulfonate, rhodanines and mercapto compounds. The amount added of the sulfur sensitizer is an amount which effectively increases the sensitivity of a light-sensitive silver halide emulsion, and an appropriate amount varies depending on conditions such as pH, temperatures, relationship to other sensitizer and grain sizes of the light-sensitive silver halide emulsion, but a standard amount is $10^{-9}$ to $10^{-1}$ mol per mol of the light-sensitive silver halide.

In the case of selenium sensitization, known unstable selenium compounds are used, and the examples include colloidal metallic selenium, selenourea (such as N,N-dimethylselenourea and N,N-diethylselenourea), selenoketones, selenoamides, aliphatic isoselenocyanates (such as allylisoselenocyanate) selenocarboxyl acid and esters thereof, selenophosphates, selenides such as diethylselenide and diethyldiselenide and phosphine selenide. Although the amount added varies depending on conditions as in the case of the sulfur sensitizer, a standard amount is preferably $10^{-10}$ to $10^{-1}$ mol per mol of the light-sensitive silver halide.

Besides the above-mentioned chalcogen sensitization, sensitization by a precious metal is also possible in the present invention. In the case of gold sensitization, the valency of gold may be +1 or +3, and a variety of gold compounds can be used. Typical examples of the gold compounds as a sensitizer include chloroauric acid, potassium chloroaurate, auric trichloride, potassium aurithiocyanate, potassium iodoaurate, tetraauric acid, ammonium aurothiocyanate, pyridyltrichlorogold, gold sulfide, gold selenide and gold telluride.

Although the amount of gold sensitizer added varies depending on conditions, a standard amount is preferably $10^{-10}$ to $10^{-1}$ mol per mol of the silver halide.

The timing of adding the gold sensitizer may be simultaneous with the sensitization by sulfur, selenium or tellurium. It may be during or before the sensitization by sulfur, selenium or tellurium, or it may be after the sensitization by sulfur, selenium or tellurium. Alternatively, it is also possible to perform the gold sensitization singly.

When the sensitization of an emulsion is performed by sulfur, selenium, tellurium or by gold in the present invention, the pAg and the pH of the emulsion are not particularly limited. However, preferably the pAg is in the range of 5 to 11 and the pH is in the range of 3 to 10, and more preferably the pAg is in the range of 6.8 to 9.0 and the pH is in the range of 5.5 to 8.5.

When a metal ion in the form of a cyano-complex is used at the time of grain formation and gold sensitization is performed, in order to achieve a high level of sensitization, it is preferable to add a metal ion such as a zinc ion which forms a coordinate bond with gelatin at a stage before chemical sensitization or at the time when gelatin is dispersed.

In the present invention, a precious metal other than gold can also be used as a chemical sensitizer. Examples of compounds as a sensitizer of precious metal other than gold include salts and complexes of platinum, palladium, iridium and rhodium.

Palladium compounds in the form of salts having a valency of 2 or 4, can be used. For example, $K_2PdCl_4$, $Na_2PdCl_6$ and the like are preferable.

A gold compound and a precious metal compound may be used in combination with a thiocyanate or selenocyanate.

In the present invention, it is further possible to carry out a reductive sensitization of the silver halide emulsion. The reductive sensitization is preferably carried out during grain formation, before or during the chemical sensitization but after the grain formation or after the chemical sensitization.

As used herein, reductive sensitization means any of the following methods: a method in which a reductive sensitizer is added to a light-sensitive silver halide emulsion; a silver ripening method in which grains of the emulsion are grown or ripened in a low-pAg environment of pAg 1 to 7; and a high-pH ripening method in which grains of the emulsion are grown or ripened in a high-pH environment of pH 8 to 11. Two or more of these methods can be employed together.

The reductive sensitizers to be used in the present invention are known compounds, examples of which include sulfites, ascorbic acid, stannous salts, amines and polyamines, hydrazine derivatives, formamidinesulfinic acid, silane compounds and borane compounds. In the present invention, these known compounds may be used alone or in a combination of two or more of them. Preferable reductive sensitizers are stannous chloride, thiourea dioxide, dimethylamine borane, L-ascorbic acid and aminoiminomethanesulfinic acid. The alkynylamine compounds described in U.S. Pat. No. 5,389,510 are also effective compounds. Although the amount of the reductive sensitizer added varies depending on the conditions of emulsion, a proper amount is in the range of $10^{-9}$ to $10^{-2}$ mol per mol of the silver halide.

Besides the addition of the reductive sensitizers, the reductive sensitization can also be performed by introduction of hydrogen gas or by use of hydrogen evolving from electrolysis.

The reductive sensitization can be performed alone, but it can also be performed in combination with the aforementioned chalcogen or gold sensitization.

The reductive sensitizer is solved in a solvent, such as water, alcohol, gycol, ketone, ester or amide, and the solution is added to the light-sensitive silver halide emulsion during the grain formation and/or after the grain formation. When added during the grain formation, although the reductive sensitizer may be placed in a reaction vessel in advance, it is preferable that the reductive sensitizer be added to the emulsion at an appropriate stage of the grain formation. It is also possible to add the reductive sensitizer either to an aqueous solution of a halide or to an aqueous solution of a silver salt so as to precipitate the grains of a light-sensitive silver halide emulsion when these solutions are blended. Further, the solution of the reductive sensitizer may be divided into portions so that these portions are added several times, or the solution of the reductive sensitizer may be added continuously over a long period of time.

The coated amount of the light-sensitive silver halide emulsion is in the range of 1mg to 10 g/$m^2$ based on the weight of silver.

It is preferable to use an oxidant of silver during the manufacturing process of the light-sensitive silver halide emulsion of the present invention. As used herein, an oxidant of silver means a compound which causes the metallic silver to change to a silver ion. Particularly effective is a compound which converts very fine silver grains, generated as a by-product particularly in the grain forming stage or chemical sensitization stage of the light-sensitive silver halide emulsion, into a silver ion. The silver ion thus formed may form a silver salt having a low solubility in water such as silver halide, silver sulfide or silver selenide, or it may form a silver salt having high solubility in water such as silver nitrate. The oxidant to silver may be an inorganic substance or an organic substance.

Examples of the inorganic oxidant include ozone, hydrogen peroxide and adducts thereof (such as $NaBO2.H_2O_2.3H_2O$, $2NaCO_3.3H_2O_2$, $Na_4P_2O_7.2H_2O_2$ and $2Na_2SO_4.H_2O_2.2H_2O$), oxygen acid salts, for example, peroxy acid salts (such as $K_2S_2O_8$, $K_2C_2O_6$, $K_2P_2O_8$), peroxy complex compounds (such as $K_2[Ti(O_2)C_2O_4].3H_2O$, $4K_2SO_4.Ti(O_2)OH.SO_4.2H_2O$, $Na_3[VO(O_2)(C_2H_4)_2].6H_2O$), permanganates (such as $KMnO_4$) and chromates (such as $K_2Cr_2O_7$), halogen elements such as iodine and bromine, perhalogenic acid salts (such as potassium periodate), salts of metals having a higher valency (such as potassium hexacyanoferrate (III)), and thiosulfonates.

Examples of the organic oxidant include quinones such as p-quinone, organic peroxides such a peracetic acid and perbenzoic acid, and compounds capable of releasing active halogen (such as N-bromosuccinimide, chloramine T and chloramine B).

In the present invention, preferable examples of the oxidant to the aforementioned silver are ozone, hydrogen peroxide and adducts thereof, inorganic oxidants such as halogen elements and thiosulfonates, and organic oxidants such as quinones. The disulfide compounds described in European Patent No.0,627,657A2 are also preferable compounds.

It is a preferred mode to use the aforementioned reductive sensitizer in combination with the oxidant to silver For example, the reductive sensitization can be performed after the use of the oxidant, or a reversal of the order is possible, or otherwise the oxidant and the reductive sensitizer may be present at the same time. Any of these methods may be employed in the grain forming stage or in the chemical sensitization stage.

In order to prevent the fogging or to stabilize the photographic characteristics during the manufacturing process, storage or photographic processing of the photographic light-sensitive silver halide emulsion used in the present invention, a variety of compounds may be added to the emulsion. These compounds are known as anti-fogging agents or as stabilizers, and examples of these compounds include thiazoles, such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetraazoles (1-phenyl-5-mercaptotetrazole in particular), mercaptopyrimidines, mercaptotriazines, thioketone compounds such as oxazoline, and azaindenes such as tirazaindenes, tetraazaindenes (4-hydroxy-substituted (1,3,3a,7) tetraazaindenes in particular) and pentaazaindenes. These are described in, for example, U.S. Pat. Nos. 3,954,474 and 3,982,947, and Japanese Patent Application Publication (JP-B) No. 52-28,660. One of the preferable compounds is the compound described in JP-A No. 63-212,932.

Depending on purposes, the anti-fogging agent and the stabilizer may be added at an appropriate stage, for example, before grain formation, during grain formation, after grain formation, at the rinsing stage, at the dispersing stage after rinsing, before chemical sensitization, during chemical sensitization, after chemical sensitization or before coating. In addition to the main purpose of preventing fogging and of affording stabilization, the anti-fogging agent and the stabilizer may be added to the emulsion for other purposes such as control of grain habit, reduction of the grain size, reduction of the solubility of the grains, control of chemical sensitization and control of the arrangement of dyes.

In order to exhibit the effect of the present invention, it is preferable that the photographic light-sensitive silver halide emulsion to be used in the present invention undergo a spectral sensitization by a methionine dye or the like. Examples of employable dyes include cyanine dyes, merocyanine dyes, complex cyanine dyes, complex merocyanine dyes, holopolar cyanine dyes, hemicyanine dyes, styryl dyes and hemioxonol dyes. Particularly useful dyes are cyanine dyes, merocyanine dyes and complex merocyanine dyes. Any of the nuclei, which are usually used as a basic heterocyclic ring in a cyanin dye, are applicable to the above-mentioned dyes. That is, examples of applicable nuclei include a pyrroline nucleus, an oxazoline nucleus, a thiozoline nucleus, a pyrrol nucleus, an oxazole nucleus, a thiazole nucleus, a selenazole nucleus, an imidazole nucleus, a tetrazole nucleus, a pyridine nucleus, a nucleus having an alicyclic hydrocarbon ring fused to any of the foregoing nuclei, and a nucleus having an aromatic hydrocarbon ring fused to any of the foregoing nuclei such as an indolenine nucleus, a benzindolenine nucleus, an indole nucleus, a benzoxazole nucleus, a naphthooxazole nucleus, a benzothiazole nucleus, a naphthothiazole nucleus, a benzoselenazole nucleus, a benzimidazole nucleus and a quinoline nucleus. These nuclei may be linked as a subsituent to a carbon atom.

A 5- or 6-membered heterocyclic nucleus, such as a pyrazoline-5-on nucleus, a thiohydantoin nucleus, a 2-thiooxazolidine-2,4-dion nucleus, a thiazolidine-2,4-dion nucleus, a rhodanine nucleus and a thiobarbituric acid nucleus, is applicable as a nucleus having a ketomethylene structure to a merocyanine dye or a complex merocyanine dye.

Although these sensitizing dyes may be used alone, they may also be used in a combination thereof. A combination of these sensitizing dyes is often used particularly for the purpose of supersensitization. Typical examples of the use of these dyes are described in, for example, U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patent Nos. 1,344,281 and 1,507,803, JP-B Nos.43-4,936 and 53-12,375, JP-A Nos.52-110,618 and 52-109,925.

The light-sensitive silver halide emulsion to be use in the present invention may contain a compound which is a dye having no spectral sensitization effect itself or a compound substantially incapable of absorbing a visible light but which exhibits a supersensitization effect.

The above-mentioned sensitizing dye may be added to the emulsion at any stage hitherto known as effective in the manufacturing process of the emulsion. As a practice most usually employed, the sensitizing dye is added to the emulsion at a stage after the completion of chemical sensitization but before coating. However, the above-mentioned sensitizing dye may be added to the emulsion at the stage of chemical sensitization so that spectral sensitization is performed simultaneously with the chemical sensitization as described in U.S. Pat. Nos. 3,628,969 and 4,225,666. Alternatively, as described in JP-A No.58-113,928, the above-mentioned sensitizing dye may be added to the emulsion before chemical sensitization, or it may be added before the completion of the formation of the precipitate of the silver halide particles so that spectral sensitization starts at this stage. Further, as described in U.S. Pat. No. 4,225,666, the above-mentioned sensitizing dye may be divided into portions to be added separately so that a portion is added to the emulsion before chemical sensitization and the rest is added to the emulsion after chemical sensitization. Furthermore, as described in U.S. Pat. No. 4,183,756 and other publications, the above-mentioned sensitizing dye may be added to the emulsion at any stage during the formation of the light-sensitive silver halide grains.

Although the amount added is generally in the range of $4\times10^{-6}$ to $8\times10^{-3}$ mol per mol of silver halide, a more effective amount is in the range of about $5\times10^{-5}$ to $2\times10^{-3}$ mol per mol of silver halide in the case where the grain size of the silver halide emulsion is in the range of 0.2 to 1.2 $\mu$m which is a preferable grain size range.

The light-sensitive silver halide emulsion may contain a variety of additives as described above, and other additives may also be used depending on purposes.

More details of these additives are described in Research Disclosure (RD) Item Nos. 17,643 (December, 1978), 18,716 (November, 1979) and 308,119 (December, 1989). The relationship in the description is shown below.

| Kinds of additives: | RD 17,643 | RD 18,716 | RD 308,119 |
|---|---|---|---|
| 1. Chemical sensitizer | pp. 23 | pp. 648, RC | pp. 996 |
| 2. Sensitivity enhancer | pp. 23 | pp. 648, RC | pp. 996 |
| 3. Spectral sensitizer/ Supersensitizer | pp. 23–24 | pp. 648, RC ~pp. 649, RC | pp. 996, RC ~pp.998, RC |
| 4. Brightening agent | pp. 24 | | pp. 998, RC |
| 5. Anti-fogging agent and Stabilizer | pp. 24–25 | pp. 649, RC | pp.998, RC ~pp.1000, RC |
| 6. Light absorber/ Filter dye/ Ultraviolet ray absorber | pp. 25–26 | pp. 649, RC ~pp. 650, LC | pp. 1003, LC ~pp. 1003, RC |
| 7. Stain inhibitor | pp.25, RC | pp.650, LC-RC | pp.1002, RC |
| 8. Dye image stabilizer | pp. 25 | | pp. 1002, RC |
| 9. Film hardener | pp. 26 | pp. 651, LC | pp. 1004, RC ~pp.1005, LC |
| 10. Binder | pp. 26 | pp. 651, LC | pp. 1003, RC ~pp. 1004, RC |
| 11. Plasticizer/Lubricant | pp. 27 | pp. 650, RC | pp. 1006, LC ~pp. 1006, RC |
| 12. Coating aid/ Surfactant | pp. 26–27 | pp. 650, RC | pp. 1005, LC ~pp.1006, LC |
| 13. Antistatic agent | pp. 27 | pp. 650, RC | pp. 1006, RC ~pp. 1007, LC |
| 14. Matting agent | | | pp. 1008, LC ~pp. 1009, LC |

(RC: right column, LC: left column)

European Patent No. 0,565,096A1 (laid open on Oct. 13, 1993) and patents cited therein disclose various items of techniques, which can be used in the light-sensitive silver halide emulsion and also in the silver halide color photographic material utilizing the light-sensitive silver halide emulsion, including items of techniques such as the arrangement of layers, light-sensitive silver halide emulsions, dye forming couplers, functional couplers such as a DIR coupler, additives and developing processes. The places in the description of these items are shown below.

1. Layer structure: lines 23–35 on pp.61, line 41 on pp.61~line 14 on pp.62
2. Intermediate layer: lines 36–40 on pp.61
3. Multilayered functional layer: lines 15–18 on pp.62
4. Halogen composition of silver halide: lines 21–25 on pp.62
5. Grain habit of silver halide: lines 26–30 on pp.62
6. Grain size of silver halide: lines 31–34 on pp.62
7. Method for preparing emulsion: lines 35–40 on pp.62
8. Grain size distribution of silver halide: lines 41–42 on pp.62
9. Tabular grain: lines 43–46 on pp.62
10. Inner structure of grain: lines 47–53 on pp.62
11. Latent image forming type of emulsion: line 54 on pp.62~line 5 on pp.63
12. Physical ripening/chemical ripening of emulsion: lines 6–9 on pp.63
13. Use of a mixture of emulsions: lines 10–13 on pp.63
14. Fogged emulsion: lines 14–31 on pp.63
15. Non-light-sensitive emulsion: lines 32–43 on pp.63
16. Coated amount of silver: lines 49–50 on pp.63
17. Photographic additive: Research Disclosure (RD)
18. Formaldehyde scavenger: lines 54–57 on pp.64
19. Mercapto-based anti-fogging agent: lines 1–2 on pp.65
20. Fogging agent releasing compound: lines 3–7 on pp.65
21. Dye: lines 7–10 on pp.65
22. Color coupler in general: lines 11–13 on pp.65
23. Yellow, magenta and cyan couplers: lines 14–25 on pp.65
24. Polymer coupler: lines 26–28 on pp.65
25. Diffusive dye forming coupler: lines 29–31 on pp.65
26. Colored coupler: lines 32–38 on pp.65
27. Functional coupler in general: lines 39–44 on pp.65
28. Bleach promoter releasing coupler: lines 45–48 on pp.65
29. Development promoter releasing coupler: lines 49–53 on pp.65
30. Other DIR coupler: line 54 on pp.65~line 4 on pp.66
31. Method for dispersing coupler: lines 5–28 on pp.66
32. Antiseptic/Antimold: lines 29–33 on pp.66
33. Kinds of light-sensitive materials: lines 34–36 on pp.66
34. Thickness of light-sensitive layer and rate of swelling: line 40 on pp.66~line 1 on pp.67
35. Back layer: lines 3–8 on pp.67
36. Developing process in general: lines 9–11 on pp.67
37. Developing solution and developing agent: lines 12–30 on pp.67
38. Additive to developing solution: lines 31–44 on pp.67
39. Reversing process: lines 45–56 on pp.67
40. Percentage of opening for developing solution: line 57 on pp.67~line 12 on pp.68
41. Developing time: lines 13–15 on pp.68
42. Bleach fixing/Bleach/Fixing: line 16 on pp.68~line 31 on pp.69
43. Automatic developer: lines 32–40 on pp.69
44. Water washing/Rinse/Stabilization: line 41 on pp.69~line 18 on pp.70
45. Replenishment of processing solution/Reuse: line 19–23 on pp.70
46. Incorporation of developing agent into light-sensitive material: lines 24–33 on pp.70
47. Temperature of developing process: lines 34–38 on pp.70
48. Utilization to film with lens: lines 39–41 on pp.70

The coated weight of the light-sensitive silver halide emulsion to be used in the present invention is preferably in the range of 1 mg to 10 g/m$^2$, and more preferably in the range of 500 mg to 5 g/m$^2$ based on the weight of silver.

Since the silver halide color photographic light-sensitive material of the present invention contains a color forming developing agent whose oxidation product generated by the development of silver is capable of forming color by reacting with a coupler that is described later, the light-sensitive material of the present invention does not require the use of a processing solution containing a color forming developing agent thereby enabling the reduction of adverse effects on the environment and the simple and rapid processing of the light-sensitive material of the present invention.

In order to enable the developing agent contained in the light-sensitive material of the present invention to exhibit the effect, it is preferable to carry out the color formation and development by a procedure comprising putting together the silver halide color photographic light-sensitive material after the exposure thereof and a processing material comprising a substrate having a processing layer comprising a base precursor and/or a base, which is described later, in the presence of water supplied to the light-sensitive layer of the silver halide color photographic light-sensitive material and/or to the processing layer of the processing material in an amount ranging from 1/10 to the equivalent of an amount which is required for the maximum swelling of the entire coating layers of these materials, so that the light-sensitive layer and the processing layer face each other, and heating these materials for the purpose of hot development to form a color image in the silver halide color photographic light-sensitive material. However, the silver halide color photographic light-sensitive material may be heated alone, or the silver halide color photographic light-sensitive material and the processing material may be put together entirely without the use of water and thereafter subjected to heat development.

The light-sensitive material of the present invention reduces the adverse effects on the environment that accompany the development which uses a developing solution. The light-sensitive material of the present invention, however, may also be developed by means of an activator process utilizing an alkaline processing solution or by means of a developing process utilizing a processing solution containing a developing agent and a base.

The developing agent may be added in the form of a liquid dispersion obtained by a procedure comprising mixing the developing agent with a high-boiling point solvent (e.g., alkyl esters of phosphoric acid and alkyl esters of phthalic acid) dissolving the mixture in a low-boiling point solvent (e.g., ethyl acetate and methyl ethyl ketone), and dispersing the solution into water by means of an emulsifying dispersion process known in the art. The developing agent may be added in the form of a solid dispersion obtained by a procedure described in JP-A No.63-271,339. It is also preferable to emulsify the developing agent together with a coupler (a compound that produces a color by reacting with the oxidation product of the developing agent) which is described later.

In the present invention, the amount added of the developing agent is preferably 0.01 to 20 mol, more preferably 0.1 to 10 mol, per mol of silver. Besides, the amount added of the developing agent is preferably 0.01 to 100 mol, more preferably 0.1 to 10 mol, per mol of coupler.

Although the developing agent is preferably incorporated in a light-sensitive layer which contains a light-sensitive silver halide emulsion, the developing agent may be incorporated in an intermediate layer.

In the present invention, it is preferable to use a compound, which is represented by one of the formulas (I), (II) (III) or (IV), as a developing agent.

General formula I

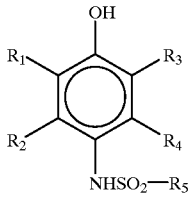

General formula II

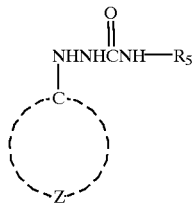

-continued

General formula III

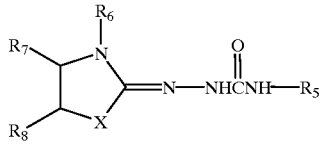

General formula IV

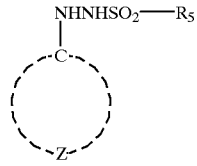

Details of these developing agents are described below.

The compounds represented by the formula (I) are generally called sulfonamide phenols and are known compounds in the art. In these compounds, preferably at least one of the substituents $R_1$ to $R_5$ has a ballast group having 8 or more carbon atoms in order to impart oil solubility to the compound.

In the formulas (I) to (IV), $R_1$ to $R_4$ each represent a hydrogen atom, a halogen atom (such as chlorine atom and bromine atom), an alkyl group (such as methyl, ethyl, isopropyl, n-butyl and t-butyl groups), an aryl group (such as phenyl, tolyl and xylyl groups), an alkylcarbonamide group (such as acetylamino, propionylamino and butyloylamino groups), an arylcarbonamide group (such as benzoylamino), an alkylsulfonamide group (such as methanesulfonylamino and ethanesulfonylamino groups), an arylsulfonamide group (such as benzenesulfonylamino and toluenesulfonylamino groups), an alkoxy group (such as methoxy, ethoxy and butoxy groups), an aryloxy group (such as phenoxy group), an alkylthio group (such as methylthio, ethylthio and butylthio groups), an arylthio group (such as phenylthio and tolylthio groups), an alkylcarbamoyl group (such as methylcarbamoyl, dimethylcarbamoyl, ethylcarbamoyl, diethylcarbamoyl, dibutylcarbamoyl, piperidylcarbamoyl and morpholylcarbamoyl), an arylcarbamoyl group (such as phenylcarbamoyl, methylphenylcarbamoyl, ethylphenylcarbamoyl and benzylphenylcarbamoyl groups), a carbamoyl group, an alkylsulfamoyl group (such as methysulfamoyl, dimethylsulfamoyl, ethylsulfamoyl, diethylsulfamoyl, dibutylsulfamoyl, piperidylsulfamoyl and morpholylsulfamoyl) an arylsulfamoyl group (such as phenylsulfamoyl, methylphenylsulfamoyl, ethylphenylsulfamoyl and benzylphenylsulfamoyl groups), a sulfamoyl group, a cyano group, an alkylsulfonyl group (such as methanesulfonyl and ethanesulfonyl groups), an arylsulfonyl group (such as phenylsulfonyl, 4-chlorophenylsulfonyl and p-toluenesulfonyl groups), an alkoxycarbonyl group (such as methoxycarbonyl, ethoxycarbonyl and butoxycarbonyl groups), an aryloxycarbonyl group (such as phenoxycarbonyl group), an alkylcarbonyl group (such as acetyl, propionyl and butyloyl groups), an arylcarbonyl group (such as benzoyl and alkylbenzoyl groups) or an acyloxy group (such as acetyloxy, propionyloxy and butyloyloxy groups). Among the $R_1$ to $R_4$ groups, $R_2$ and $R_4$ are each preferably a hydrogen atom. Further, the total of Hammett's constants $\sigma_p$ of $R_1$ to $R_4$ is preferably 0 or greater. In the formula (I) to (IV), $R_5$ represents an alkyl group (such as methyl, ethyl, butyl, octyl, lauryl, cetyl and stearyl groups), an aryl group (such as phenyl, tolyl, xylyl, 4-methoxyphenyl, dodecylphenyl, chlorophenyl, trichlorophenyl, nitrochlorophenyl, triisopropylphenyl, 4-dodecyloxyphenyl and 3,5-di-(methoxycarbonyl) groups) or a heterocyclic group (such as pyridyl group).

The compounds represented by the formula (II) are generally called carbamoylhydrazines and are known compounds in the art. In these compounds, $R_5$ or a substituent linked to a ring preferably has a ballast group having 8 or more carbon atoms.

In the formula (II), Z represents a group of atoms forming an aromatic ring. The aromatic group indicated by Z should be sufficiently electron-attractive in order to make the compound silver development activity. From this standpoint, preferably employed is a nitrogen-containing aromatic ring or an aromatic ring such as a benzene ring having an electron-attractive substituent. In this sense, preferred aromatic rings include a pyridine ring, a pyradine ring, a pyrimidine ring, a quinoline ring and a quinoxaline ring. In the case of a benzene ring, examples of the substituents include a halogen atom (such as chlorine atom and bromine atom), an alkylcarbamoly group (such as methylcarbamoyl, dimethylcarbamoyl, ethylcarbamoyl, diethylcarbamoyl, dibutylcarbamoyl, piperidylcarbamoyl and morpholynocarbamoyl), an arylcarbamoyl group (such as phenylcarbamoyl, methylphenylcarbamoyl, ethylphenylcarbamoyl and benzylphenylcarbamoyl groups), a carbamoyl group, an alkylsulfamoyl group (such as methysulfamoyl, dimethylsulfamoyl, ethylsulfamoyl, diethylsulfamoyl, dibutylsulfamoyl piperidylsulfamoyl and morpholylsulfamoyl), an arylsulfamoyl group (such as phenylsulfamoyl, methylphenylsulfamoyl, ethylphenylsulfamoyl and benzylphenylsulfamoyl groups), a sulfamoyl group, a cyano group, an alkylsulfonly group (such as methanesulfonyl and ethanesulfonyl groups), an arylsulfonyl group (such as phenylsulfonyl, 4-chlorophenylsulfonyl and p-toluenesulfonyl groups), an alkoxycarbonyl group (such as methoxycarbonyl, ethoxycarbonyl and butoxycarbonyl groups), an aryloxycarbonyl group (such as phenoxycarbonyl group), an alkylcarbonyl group (such as acetyl, propionyl and butyloyl groups) and an arylcarbonyl group (such as benzoyl and alkylbenzoyl groups). The total of Hammett's constant σ of the above substituents is preferably 1 or greater.

The compounds represented by the formula (III) are generally called carbamoylhydrazones. The compounds represented by the formula (IV) are generally called sulfonylhydrazines. Both of these compounds are known compounds in the art. In these compounds, preferably at least one of the substituents $R_5$ to $R_8$ has a ballast group having 8 or more carbon atoms.

In the formulas (III), $R_6$ represents alkyl group (such as methyl and ethyl group). X represents an oxygen atom, a sulfur atom, a selenium atom or an alkyl- or aryl-substituted tertiary nitrogen atom. Preferably, X represents an alkyl-substituted tertiary nitrogen atom. $R_7$ and $R_8$ each represent a hydrogen atom or a substituent (examples of which include the above examples of substituents on benzene ring for Z). $R_7$ and $R_8$ may join each other to form a double bond or a ring.

Among the compounds represented by the formulas (I) to (IV), the compounds represented by the formulas (I) and (II) are preferable from the viewpoint of superior storage stability of the raw light-sensitive material.

In the above compounds, the substituents $R_1$ to $R_8$ may each have a substituent, examples of which include the above examples of substituents on the benzene ring for Z.

Concrete examples of the compounds represented by the formulas (I) to (IV) are given below, but a developing agent used in the present invention are not limited to these examples.

D-7

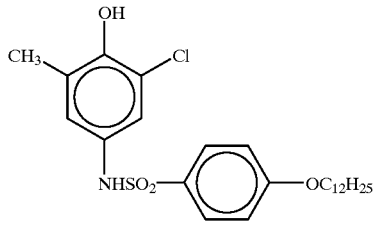

D-8

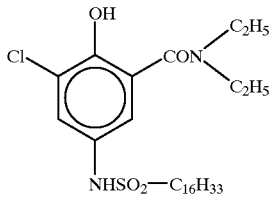

D-9

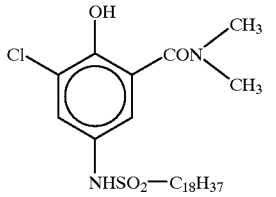

-continued
D-10
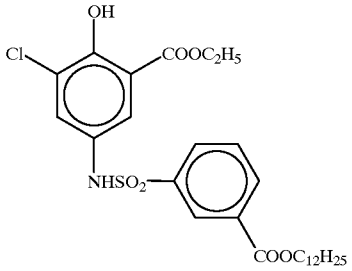
D-11
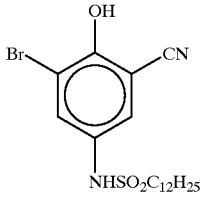
D-12
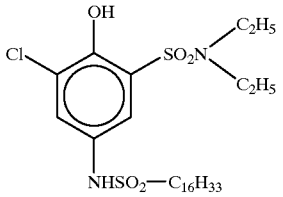
D-13
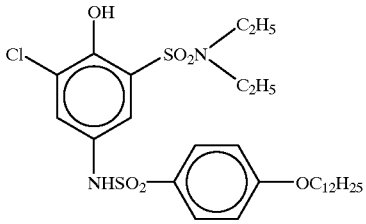
D-14
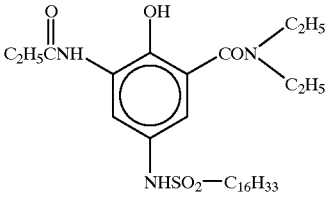
D-15
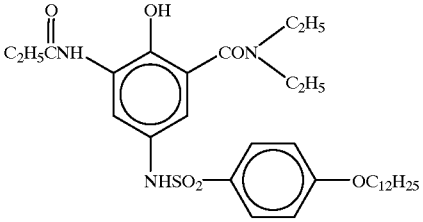

-continued
D-16
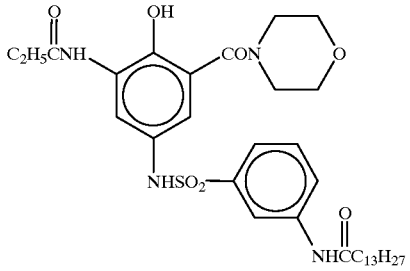
D-17
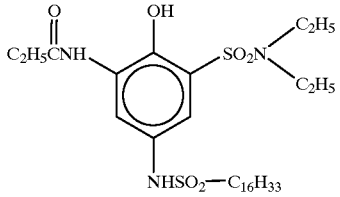
D-18
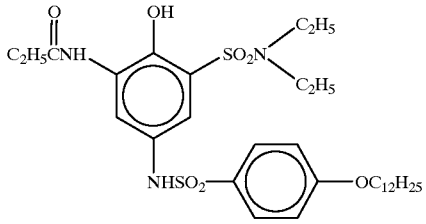
D-19
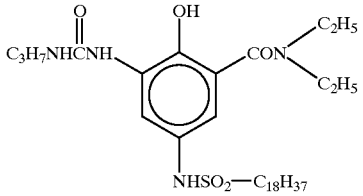
D-20
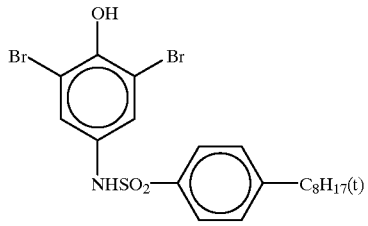
D-21
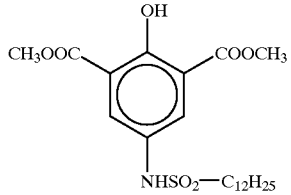

-continued
D-22
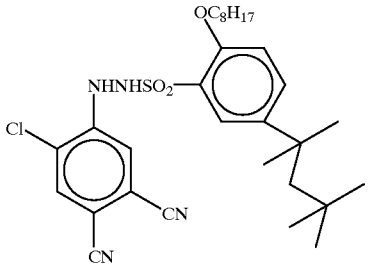
D-23
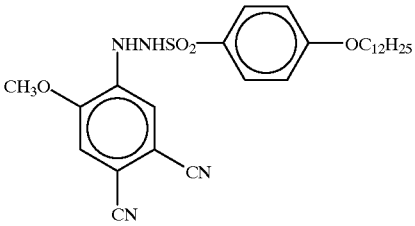
D-24
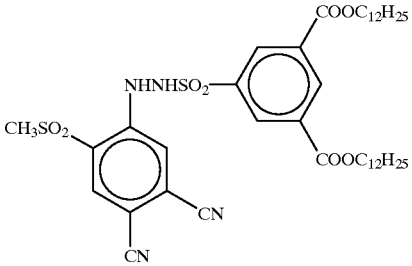
D-25
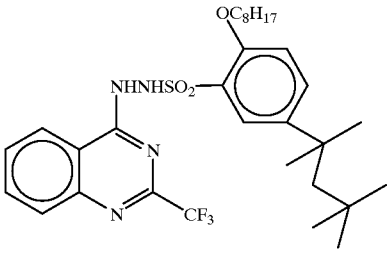
D-26
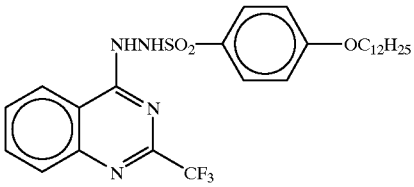
D-27
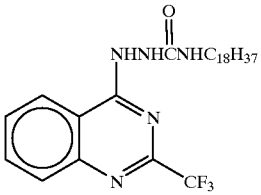

-continued
D-28
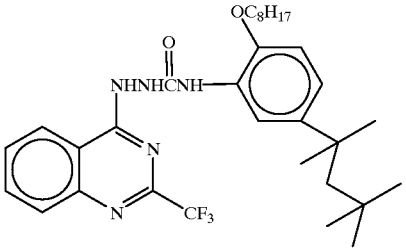
D-29
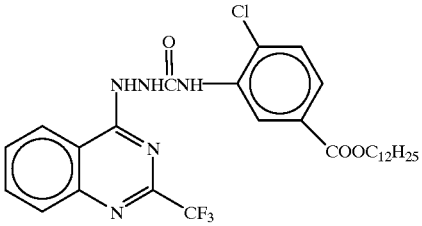
D-30
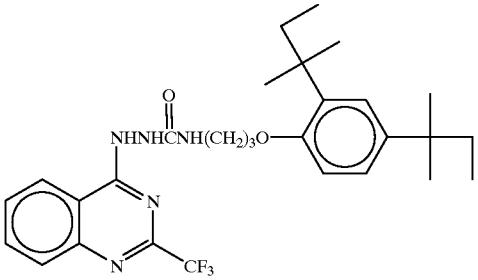
D-31
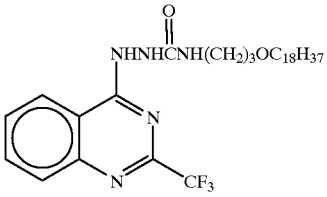
D-32
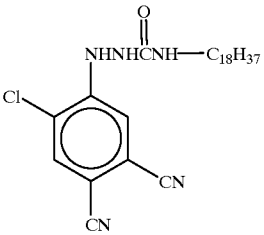
D-33
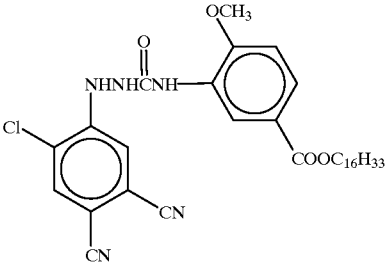

-continued
D-34
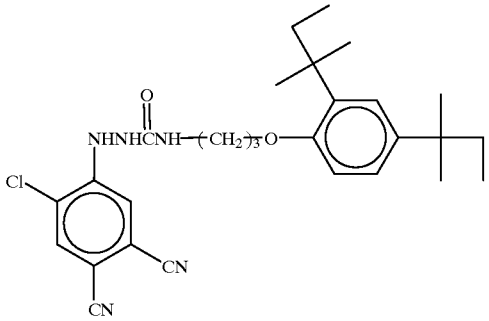
D-35
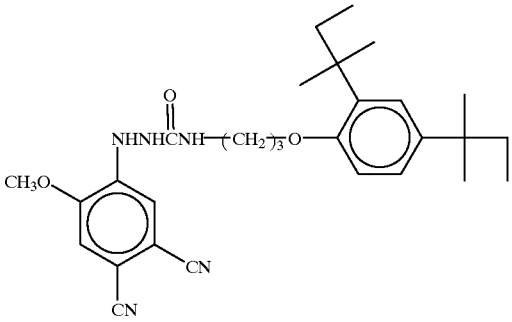
D-36
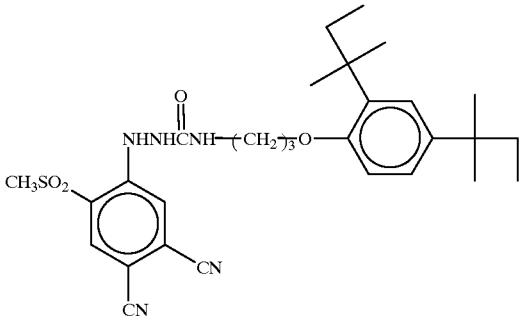
D-37
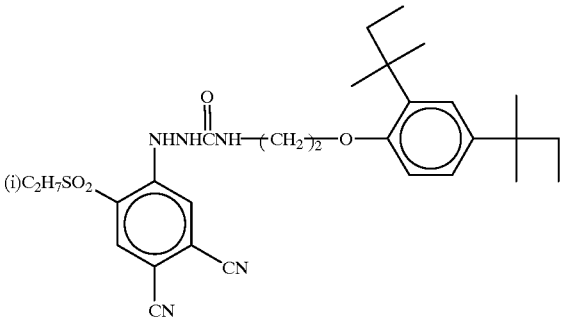
D-38
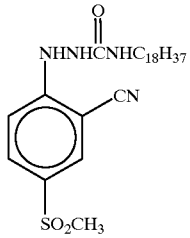

-continued
D-39
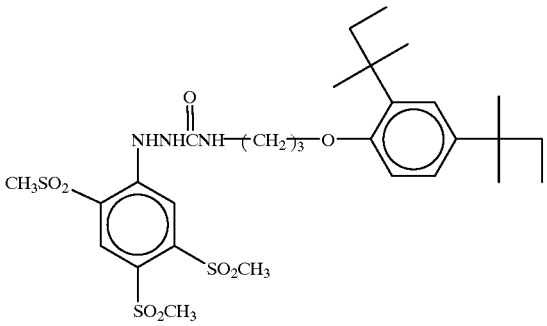
D-40
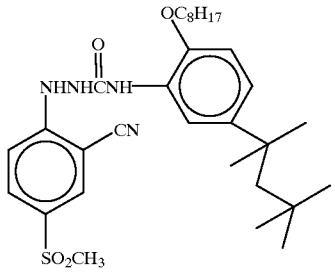
D-41
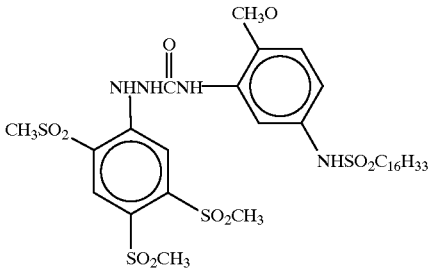
D-42
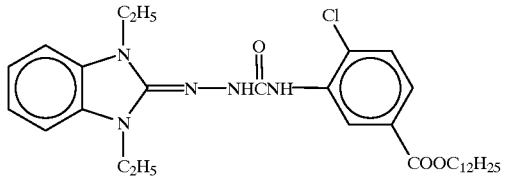
D-43
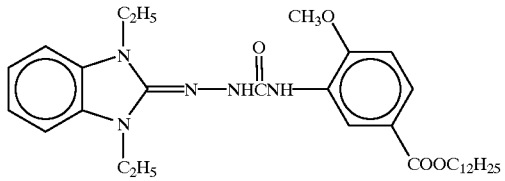
D-44
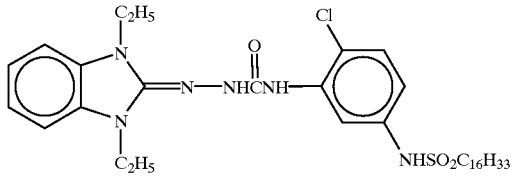

-continued
D-45
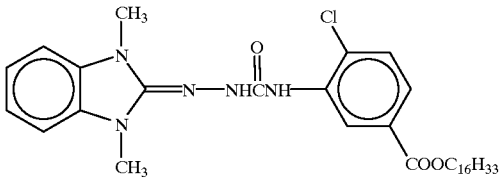
D-46
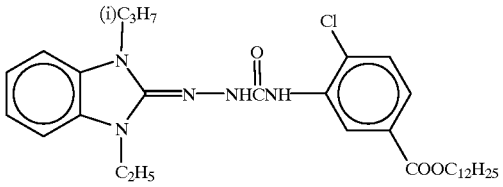
D-47
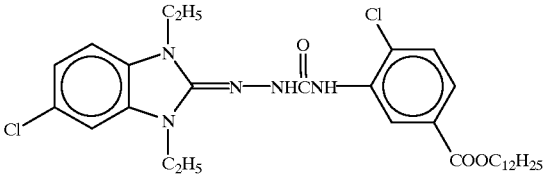
D-48
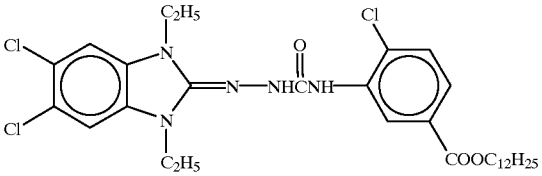
D-49
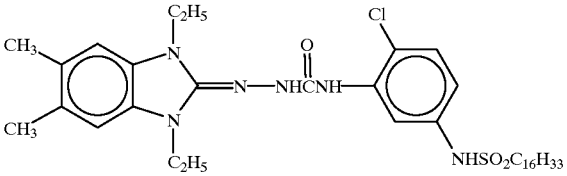
D-50
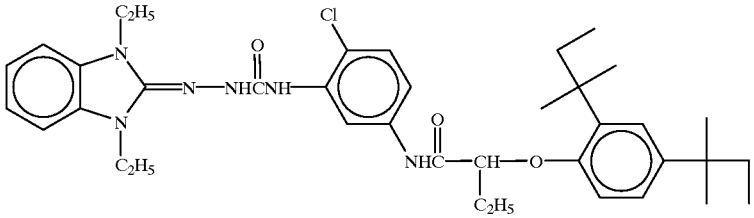
D-51
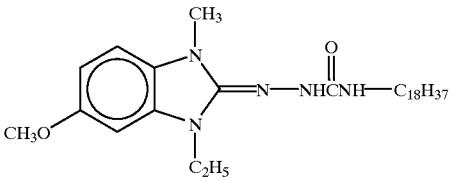
D-52
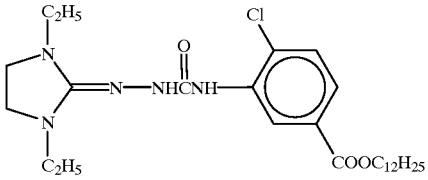

-continued
D-53
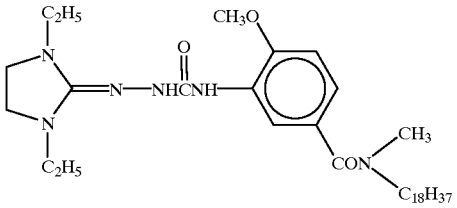
D-54
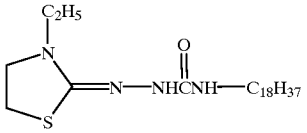
D-55
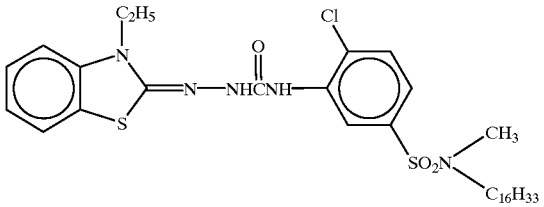
D-56
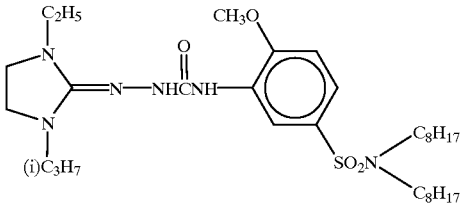
The above compounds can be synthesized by commonly known methods. Pathways for the syntheses are briefly described below.
Synthesis of Developing agent D-2
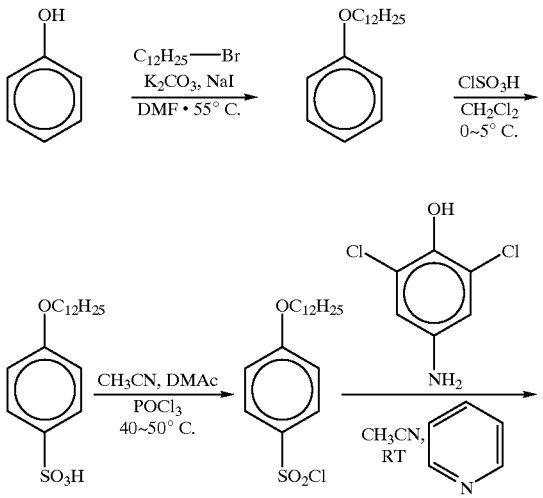
D-2
Synthesis of Developing agent D-27
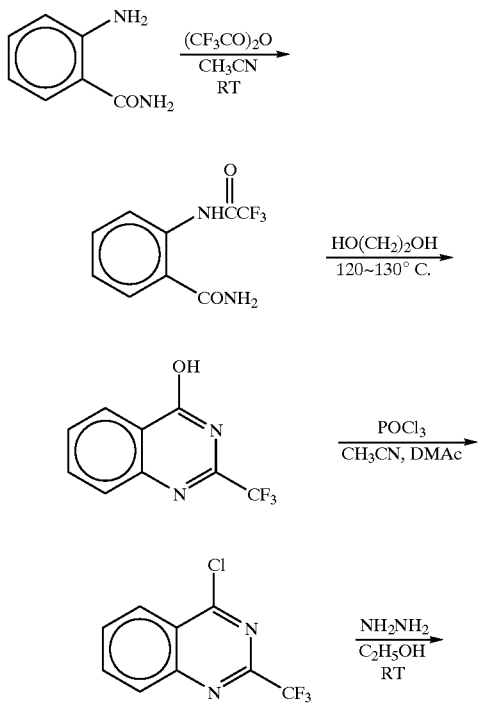

-continued

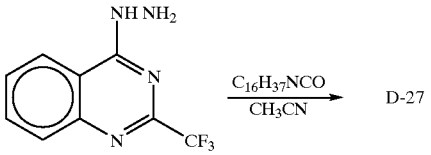

Synthesis of Developing agent D-42

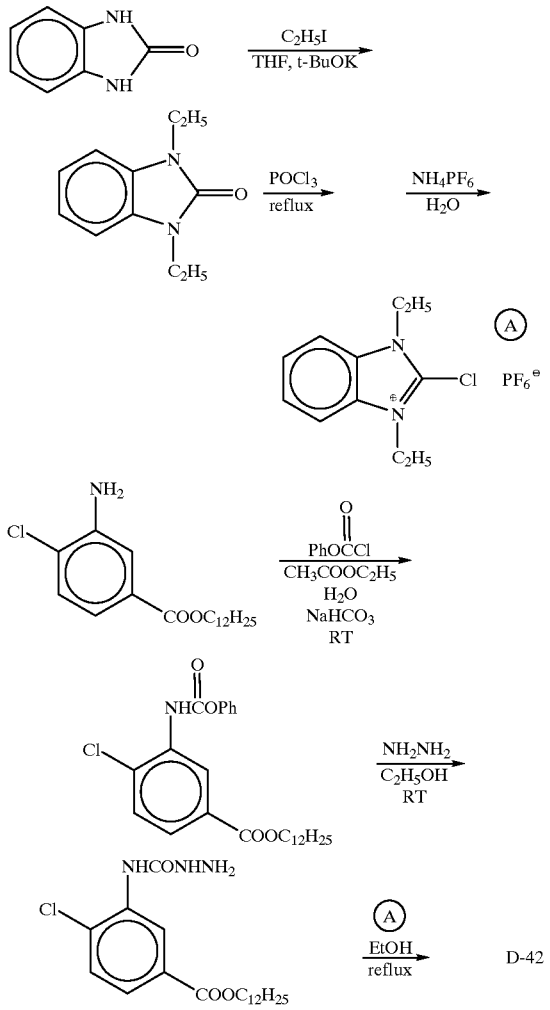

A combination of a developing agent and a coupler can be used in the present invention, and examples of such a combination include a combination of a p-phenylene diamine as a developing agent and a phenol or active methylene coupler described in U.S. Pat. No. 3,531,256, and a combination of a p-aminophenol as a developing agent and an active methylene coupler described in U.S. Pat. No. 3,761,270.

Further, the use of a combination of a sulfonamide phenol and a 4-equivalent coupler in a light-sensitive material, described in U.S. Pat. No. 4,021,240 and JP-A No.60-128,438, is preferable, because this combination assures excellent storage stability of the raw light-sensitive material.

In the present invention, when a developing agent is contained, a precursor of a developing agent may be used, examples of which include an indoaniline-based compound described in U.S. Pat. No. 3,342,597, a Schiff base-type compound described in U.S. Pat. No. 3,342,599 and in Research Disclosure Nos.14,850 and 15,159, an aldol compound described in Research Disclosure No.13,924, a metal salt complex described in U.S. Pat. No. 3,719,492 and a urethane-based compound described in JP-A No.53-135,628.

Other combinations, i.e., a combination of a sulfonamide phenol as a developing agent and a coupler as described in Japanese Patent Application No.7-180,568 and a combination of a hydrazine as a developing agent and a coupler as described in Japanese Patent Application Nos.7-49,287 and 7-63,572, are also preferable for use in the light-sensitive material of the present invention.

In the case where a nondiffusive developing agent is used, if necessary, an electron transport agent and/or a precursor thereof can be used in the light-sensitive material of the present invention in order to accelerate the transportation of electron between the nondiffusive developing agent and the silver halide which is to be developed. Use of electron transport agents and precursors thereof, which are described in U.S. Pat. No. 5,139,919 and in European Patent Application Laid-Open No. 418,743, is particularly preferred in the present invention. Use of methods for introducing the electron transport agent and/or precursor thereof into a layer in a stable manner, which are described in Japanese Patent Application Laid-Open (JP-A) Nos. 2-230,143 and 2-235,044, is particularly preferred in the present invention.

An electron transport agent or a precursor thereof can be selected from the aforesaid developing agents or precursors thereof. The mobility of the electron transport agent or a precursor thereof is preferably greater than that of a nondiffusive developing agent (electron donor). A particularly useful electron transport agents are 1-phenyl-3-pyrazolidones or aminophenols.

A precursor of electron donor, which is described in Japanese Patent Application Laid-Open (JP-A) No. 3-160,443, is also preferable for use in the light-sensitive material of the present invention.

For such purposes as prevention of color mixing, improvement in the color reproduction and the like, a reducing agent may be used in an intermediate layer or in a protective layer. The reducing agents, which are described in European Patent Application Laid-Open Nos. 524,649 and 357,040 and in Japanese Patent Application Laid-Open (JP-A) Nos. 4-249,245, 2-46,450 and 63-186,240, are preferable for use in the present invention. Also usable are development inhibitor releasing reducers which are described in Japanese Patent Application Publication (JP-B) No. 3-63,733, Japanese Patent Application Laid-Open (JP-A) Nos. 1-150,135, 2-46,450, 2-64,634, and 3-43,735 and European Patent Application Laid-Open No. 451,833.

Further, a precursor of a developing agent, which does not have reducing properties per se but which exhibits reducing properties under the influence of a nucleophilic reagent or heat in the process of development, can be used in the light-sensitive material of the present invention.

The silver halide color photographic light-sensitive material of the present invention can contain any of the following reducing agents, examples of which are the reducing agents and precursors thereof described in U.S. Pat. Nos. 4,500,626, columns 49–50, 4,839,272, 4,330,617, 4,590,152, 5,017,454 and 5,139,919, Japanese Patent Application Laid-Open (JP-A) Nos. 60-140,335, pp. 17–18, 57–40,245, 56-138,736, 59-178,458, 59-53,831, 59-182,449, 59-182,450, 60-119,555, 60-128,436, 60-128,439, 60-198,540, 60-181,742, 61-259,253, 62-244,044, 62-131,253, 62-131,256, 64-13,546, pp. 40–57, and 1-120,553 and European Patent Application Laid-Open No. 220,746A2, pp. 78–96.

Further, a combination of reducing agents, which is disclosed in U.S. Pat. No. 3,039,869, can also be used in the present invention.

The light-sensitive material of the present invention should contain a compound (coupler) which forms a dye by a coupling reaction with the oxidation product of the developing agent.

The coupler to be used in the present invention may be a 4-equivalent coupler or a 2-equivalent coupler. In these couplers, the nondiffusive group may form a polymeric chain. Details of the coupler are described, for example, in T. H. James, The Theory of the Photographic Process, 4th edition, pp. 291–334, pp. 354–361, and in Japanese Patent Application Laid-Open (JP-A) Nos. 58-123,533, 58-149,046, 58-149,047, 59-111,148, 59-124,399, 59-174,835, 59-231,539, 59-231,540, 60-2,950, 60-2,951, 60-14,242, 60-23,474, 60-66,249, 8-110,608, 8-146,552 and 8-146,578.

Further, the following couplers are preferably used in the present invention.

Yellow couplers: couplers represented by the formulas (I) and (II) in EP 502,242A; couplers represented by the formulas (1) and (2) in EP 513,496A; couplers represented by the general formula (I) described in claim 1 of Japanese Patent Application Laid-Open (JP-A) No. 5-307,248; couplers represented by the general formula (D) in U.S. Pat. No. 5,066,576, column 1, lines 45 to 55; couplers represented by the general formula (D) in Japanese Patent Application Laid-Open (JP-A) No. 4-274,425, paragraph 008; couplers described in EP 498,381A1, claim 1 on page 40; couplers represented by the formula (Y) in EP 447,969A1, pp. 4; and couplers represented by the general formulas (I) to (IV) in U.S. Pat. No. 4,476,219, column 7, lines 36 to 58.

Magenta couplers: couplers described in Japanese Patent Application Laid-Open (JP-A) Nos. 3-39,737, 6-43,611, 5-204,106 and 4-3,626.

Cyan couplers: couplers described in Japanese Patent Application Laid-Open (JP-A) Nos. 4-204,843, 4-43,345 and Japanese Patent Application No.4-23633.

Polymeric couplers: couplers described in Japanese Patent Application Laid-Open (JP-A) No. 2-44,345.

The couplers described in U.S. Pat. No. 4,366,237, GB 2,125,570, EP 96,570 and DE 3,234,533 are preferable as a coupler which generates a dye having an appropriate diffusive property.

In order to correct the unnecessary absorption of a coloring dye, the silver halide color photographic light-sensitive material in the present invention may contain a functional coupler, for example, the yellow colored cyan coupler and the yellow colored magenta coupler described in EP 456,257A1, the magenta colored cyan coupler described in U.S. Pat. No. 4,833,069 and the colorless masking coupler represented by the formula (2) in U.S. Pat. No. 4,837,136 and by the formula (A) in claim 1 of WO 92/11,575 (compounds shown at pages 36–45 in particular).

In the present invention, it is preferable to use a coupler or other compound which reacts with the oxidation product of a developing agent to release a photographically important compound.

Examples of the compounds (including couplers) which react with the oxidation product of a developing agent to release photographically important compound residues, include a compound which releases a development inhibitor such as compounds represented by the formulas (I) to (IV) described on page 11 in EP 378,236A1, compounds represented by the formula (I) described on page 7 in EP 436,938A2, compounds represented by the formula (1) described in Japanese Patent Application Laid-Open (JP-A) No. 5-307,248, compounds represented by the formulas (I) to (III) described on pages 5 and 6 in EP 440,195A2, compound-ligand releasing compounds represented by the formula (I) described in claim 1 of Japanese Patent Application Laid-Open (JP-A) No. 6-59,411 and compounds represented by LIG-X described in claim 1 of U.S. Pat. No. 4,555,478.

In the present invention, either a 4-equivalent coupler or a 2-equivalent coupler is selected for use depending on the kind of the developing agent. Use of such a combination can prevent color mixing caused by movement of the oxidation product of a developing agent between adjacent layers. Examples of the 4-equivalent couplers and 2-equivalent couplers are described in detail in "Theory of the Photographic Process" (4th edition by T. H. James, Macmillan, 1977), pp. 291–334, pp. 354–361, and in Japanese Patent Application Laid-Open (JP-A) Nos. 58-12,353, 58-149,046, 58-149,047, 59-11,114, 59-124,399, 59-174,835, 59-231,539, 59-231,540, 60-2,951, 60-14,242, 60-23,474 and 60-66,249 in addition to the aforementioned literature and patents.

The silver halide color photographic light-sensitive material of the present invention needs the use of a base or a base precursor in order to promote the development of silver and the dye forming reaction. When the silver halide color photographic light-sensitive material is heated alone for heat development, or when the silver halide color photographic light-sensitive material and the processing material are put together entirely without the use of water and thereafter subjected to heat development, it is preferable to use a base precursor described below.

Preferable examples of the base precursor include a compound which is made reactive by heating and releases a base, for example, a salt of an organic acid and a base capable of decarboxylation by means of heat and a compound capable of releasing an amine by means of an intramolecular neucleophilic substitution reaction, a Lossen rearrangement or a Beckmann rearrangement, and a compound which releases a base by electrolysis or by a complex forming reaction. Examples of the precursor of the former type include a salt of trichloroacetic acid described in British Patent No. 998,949, a salt of α-sulfonylacetic acid proposed as a compound having a better stability and described in U.S. Pat. No. 4,060,420, a salt of propiolacetic acid described in JP-A No.59-185,037, 2-carboxycarboamide derivative described in U.S. Pat. No. 4,088,469, a salt of a thermally degradable acid with a basic component which may be not only an organic base but also an alkali metal and an alkaline earth metal (e.g., JP-A No.59-175,237 and the like), a hydroxamcarbamate utilizing a Lossen rearrangement described in JP-A No. 59-168,440, an aldoxime carbamate which generates a nitrile upon heating described in JP-A No. 59-157,637.

Besides, a base precursor is also useful which is described in British Patent Nos. 998,945 and 2,079,480, JP-A No.59-226,225 and "Known Technologies" No.5 (issued on Mar. 22, 1991, ASTECH Co., Ltd.), pp.55–86.

In addition, also usable as a base precursor in the present invention in which a heat development is performed in the presence of a small amount of water are a combination of a sparingly water-soluble basic metal compound and a compound capable of reacting with the metal contained in the foregoing basic metal compound by use of water as a medium to form a complex compound (hereinafter referred to as a complex forming compound), which is explained later, described in European Patent Application Laid-Open No.210,660, U.S. Pat. No. 4,740,445 and JP-A No.62-129, 848, and also a compound which generates a base by electrolysis described in JP-A No. 61-232,451. The former type, i.e., the above-mentioned combination, is efficient in the generation of a base. As described in the publication cited above, from the viewpoint of storage stability of the light-sensitive material, it is preferable that the sparingly water-soluble metal compound and the complex forming metal compound be contained separately in a silver halide color photographic light-sensitive material and in a processing material.

The amount of the base or the base precursor to be used in the present invention is normally in the range of 0.1 to 20 $g/m^2$, and preferably 1 to 10 $g/m^2$.

Examples of the sparingly water-soluble basic metal compound include oxides, hydroxides, basic carbonates and the like of zinc or aluminum. Among these compounds, zinc oxide, zinc hydroxide, and zinc basic carbonate are particularly preferred.

As described in JP-A No. 59-174,830, the sparingly water-soluble basic metal compound is finely dispersed into a hydrophilic binder. Average grain size of the sparingly water-soluble metal compound is in the range of 0.001 to 5 $\mu$m and preferably in the range of 0.01 to 2 $\mu$m. The amount of the sparingly water-soluble metal compound present in the silver halide color photographic light-sensitive material is in the range of 0.01 to 8 $g/m^2$, and preferably 0.05 to 5 $g/m^2$.

The compound capable of forming a complex with the metal ion of the sparingly water-soluble basic metal compound is a compound known as a chelating compound in analytical chemistry and a compound known as a softener for hard water in photographic chemistry. Details of complexes are described in the specifications of the above-mentioned patents and also in A. Ringbom, "Complex forming reactions", translated by N. Tanaka et al., Sangyo Tosho Co., Ltd.

The complex forming compound preferable for use in the present invention is a water-soluble compound, examples of which include an aminopolycarboxyl acid (including a salt thereof) such as ethylenediaminetetraacetic acid, nitrilotriacetic acid and diethylenetriaminepentaacetic acid, an aminophosphonic acid (salt) such as aminotris (methylenephosphonic) acid and ethylenediaminetetramethylenephosphonic acid, and pyridinecarboxyl acid (salt) such as 2-picolinic acid, pyridine-2, 6-dicarboxyl acid and 5-ethyl-2-picolinic acid. Among these compounds, a pyridinecarboxyl acid (salt) is particularly preferable.

In the present invention, it is preferable to use the aforementioned complex forming compound in the form of a salt which is formed by neutralizing the complex forming compound with a base. Particularly preferable salts are a salt with an organic base such as a guanidine, an amidine or a tetraalkylammonium hydroxide, and a salt with an alkali metal such as sodium, potassium or lithium. Alternatively, a combination of these salts may also be used. Preferred examples of the complex forming compounds are described in, for example, JP-A No. 62-129,848 and European Patent Application Laid-Open No.210,660A2. The amount of the complex forming compound present in the silver halide color photographic light-sensitive material is in the range of 0.1 to 20 $g/m^2$, and preferably 0.1 to 10 $g/m^2$.

The binder for a constituent layer of the silver halide color photographic light-sensitive material is preferably a hydrophilic material, examples of which include those described in the aforesaid Research Disclosure and in Japanese Patent Application Laid-Open (JP-A) No. 64-13,546, pp. 71–75. More specifically, the binder is preferably a transparent or translucent hydrophilic material, exemplified by a naturally occurring compound, such as a protein including gelatin and a gelatin derivative; and a polysaccharide including a cellulose derivative, starch, gum arabic, dextran and pullulane, and by a synthetic polymer such as polyvinyl alcohol, polyvinyl pyrrolidone and acryl amide polymer. Also usable as the binder is a highly water-absorbent polymer described in U.S. Pat. No. 4,960,681 and Japanese Patent Application Laid-Open (JP-A) No. 62-245,260, for example, a homopolymer composed of a vinyl monomer having —COOM or —$SO_3M$ (M stands for a hydrogen atom or an alkali metal), or a copolymer obtained by a combination of these monomers or obtained by a combination of at least one of these monomers and another monomer(s) such as sodium methacrylate and ammonium methacrylate, SUMIKAGEL L-5H manufactured by Sumitomo Chemical Co., Ltd. These binders may be used alone or in a combination of two or more of them. Particularly, a combination of gelatin and any of the above-mentioned non-gelatin binders is preferable. Depending on purposes, a lime-treated gelatin, acid-treated gelatin and delimed gelatin which has undergone a deliming process to decrease the content of calcium and the like can be used. Alternatively, a combination of these treated gelatin substances may be employed.

In the present invention, the coated weight of the binder is preferably 1 to 20 $g/m^2$, and more preferably 2–10 $g/m^2$.

Hydrophobic additives, such as the coupler, the developing agent and the nondiffusive reducing agent which are described above, can be introduced into a layer of a silver halide color photographic light-sensitive material according to a known method such as the method described in U.S. Pat. No. 2,322,027. In this case, an organic solvent having a high boiling point, which is described in U.S. Pat. Nos. 4,555,470, 4,536,466, 4,536,467, 4,587,206, 4,555,476 and 5,599,296 and in Japanese Patent Application Publication (JP-B) No. 3-62,256, can be used, if necessary, together with an organic solvent having a lower boiling point in the range of 50 to 160° C. Besides these color forming compounds, nondiffusive reducing agents, organic solvents having a high boiling point and the like may be used in a combination of two or more of them, respectively.

The amount of the organic solvent having a high boiling point is 10 g or less, preferably 5 g or less, more preferably in the range of 0.1 to 1 g, based on 1 g of the hydrophobic additives to be used. The amount of the organic solvent having a high boiling point is 1 cc or less, preferably 0.5 cc or less, more preferably 0.3 cc or less, based on 1 g of the binder.

Examples of useful methods for introducing a hydrophobic additive into the layer of a light-sensitive material include a dispersion method utilizing a polymer as described in Japanese Patent Application Publication (JP-B) No. 51-39,853 and Japanese Patent Application Laid-Open (JP-A) No. 51-59,943 and a method wherein a hydrophobic additive, which has been converted into a dispersion of fine grains, is added to the layer as described in Japanese Patent Application Laid-Open (JP-A) No. 62-30,242.

In addition to the above methods, in the case where the hydrophobic additive is a compound substantially insoluble in water, the hydrophobic compound may be dispersed in a binder.

When dispersing a hydrophobic compound to form a hydrophilic colloidal dispersion, a variety of surfactants can be used. For example, surfactants, which are described in Japanese Patent Application Laid-Open (JP-A) No. 59-157,636, pp. 37–38, and in aforesaid Research Disclosure, can be used. In addition, a phosphoric ester-type surfactant, which is described in Japanese Patent Application Laid-Open (JP-A) Nos. 7-56,267 and 7-228,589 and in German Patent Application Laid-Open No. 1,932,299A, can also be used in the light-sensitive material of the present invention.

In the present invention, color reproduction according to a color subtraction process can be basically used for the preparation of a silver halide color photographic light-sensitive material to be used for the reproduction of an original scene as a color image. That is, the color information of the original scene can be recorded by means of a color negative film having at least three light-sensitive layers, which have a sensitivity to the blue, green or red wavelength region of light, respectively, and are incorporated, respectively, with a color coupler capable of producing a yellow, magenta or cyan dye as a complementary color of the sensitive wavelength region of the layer. Through the thus obtained color image, color photographic paper, which has a wavelength sensitivity to hue relationship identical to that of the color negative film, is optically exposed to thereby reproduce the original scene. Alternatively, it is also possible to reproduce an image for enjoyment by reading out by means of a scanner the information of the color image obtained by taking a photograph of an original scene.

The light-sensitive material of the present invention can comprise three or more light-sensitive layers, each of which has a sensitivity to light of a wavelength different to the other two. In addition, the relationship between the sensitive wavelength region and hue of layer may be different from the complementary color relationship described above. In this case, it is possible to reproduce the original color information by image processing, e.g., color conversion, of the image information which has been read out as described above.

Preferably, the silver halide color light-sensitive material of the present invention has at least two silver halide emulsions having spectral sensitivity in the same wavelength region and have different average grain projected areas. The term "spectral sensitivity in the same wavelength region" as referred to herein means sensitivity to practically the same wavelength region. Therefore, emulsions with slightly different distributions of spectral sensitivity but having light-sensitive regions which mainly overlap with each other, are deemed to be emulsions having photosensitivity in the same wavelength region.

In the present invention, a plurality of emulsions having spectral sensitivity in the same wavelength region and different in the average grain projected area can be used in different light-sensitive layers separately or the plurality of emulsions may be mixed and incorporated into same light-sensitive layer.

When these emulsions are contained in separate light-sensitive layers, the color coupler to be combined therewith preferably has the same hue, however, couplers of forming color in different hues may be mixed to give different colored hues to respective light-sensitive layers or couplers different in the absorption profile of the colored hue may be used in respective light-sensitive layers.

In the present invention, these emulsions having spectral sensitivity in the same wavelength region must be coated to have a construction such that an emulsion having a larger average grain projected area has a ratio of silver halide grain numbers per unit area of the light-sensitive material larger than the ratio of the values obtained by dividing the coated silver amount of the emulsion by the $3/2^{nd}$ power of average grain projected area. By the above-described construction, it is possible to obtain an image which has an excellent granulation, even when the light-sensitive material is developed at a high temperature. In addition, it is also possible to achieve high develop ability and a broad latitude for exposure.

In a color negative conventionally used in photography, in order to attain a desired level of granulation, a silver halide emulsion has been improved and a so-called DIR coupler which releases, by the reaction with the oxidation product of a developing agent, a compound capable of inhibiting the development has been used. The light-sensitive material according to the present invention provides an excellent level of granulation even if DIR coupler is not used in the light-sensitive material. If the light-sensitive material according to the present invention contains DIR coupler, the level of granulation is further improved.

A non-light-sensitive layer, such as a protective layer, a substratum, an intermediate layer, a yellow filter layer and/or an antihalation layer, may be formed between the photographic light-sensitive layers containing light-sensitive silver halide emulsion of the silver halide color photographic light-sensitive material and/or as a top layer and/or a bottom layer thereof. Further, a supplementary layer, such as a back layer, may be formed on the reverse side of the substrate opposite to the side on which the photographic light-sensitive layer is formed. More specifically, it is possible to form, on the substrate, various layers including the above-mentioned construction, a substratum described in U.S. Pat. No. 5,051,335, an intermediate layer containing a solid pigment described in Japanese Patent Application Laid-Open (JP-A) Nos. 1-167,838 and 61-20,943, an intermediate layer containing a reducing agent or a DIR compound described in Japanese Patent Application Laid-Open (JP-A) Nos. 1-120,553, 5-34,884 and 2-64,634, an intermediate layer containing an electron transport layer described in U.S. Pat. No. 5,017,454 and 5,139,919 and in Japanese Patent Application Laid-Open (JP-A) No. 2-235,044 and a protective layer containing a reducing agent described in Japanese Patent Application Laid-Open (JP-A) No. 4-249,245 as well as a combination of two or more of these layers.

A dye, which can be used in a yellow filter layer or in an antihalation layer, is preferably a dye which loses its color or is eliminated at the time of development so that it exerts no influence on the density of image after the process.

That the dye which is present in the yellow filter layer or in the antihalation layer loses its color or is eliminated at the time of development means that the amount of the dye remaining after the process is less than one third, preferably less than one tenth, of the amount of the dye present before the process. This may be attained by a phenomenon wherein the component of the dye is leached out of the light-sensitive material or is transferred into the processing material at the time of development, or by a phenomenon wherein the component of the dye undergoes a reaction and becomes a colorless compound at the time of development.

A known dye can be used in the silver halide color photographic light-sensitive material of the present invention. For example, employable dyes include a dye, which is soluble in an alkaline solution of a developer, and a dye which becomes colorless as a result of the reaction with an ingredient of the developing solution, sulfite ion, a developing agent or an alkali.

Concrete examples of the dyes include the dye described in European Patent Application EP 549,489A and the dye described in Japanese Patent Application Laid-Open (JP-A) No. 7-152,129, ExF 2–6. A dye which is dispersed in fine solid particles and is described in Japanese Patent Application Laid-Open (JP-A) No. 8-101,487 canalso be used. Although this dye can also be used in the case where the silver halide color photographic light-sensitive material is developed with a processing solution, this dye is particularly suitable to the case where the silver halide color photographic light-sensitive material is subjected to a heat development utilizing a processing material which is described later.

Further, it is also possible to fix a dye to a mordant and a binder. In this case, the mordant and the dye maybe those well known in the field of photography. Examples of the mordants include those described in U.S. Pat. No. 4,500,626, columns 58–59 and in Japanese Patent Application Laid-Open (JP-A) Nos. 61-88,256, pp. 32–41, 62-244,043 and 62-244,036.

Furthermore, it is also possible to use a reducing agent and a compound which reacts with the reducing agent to release a diffusive dye so that the alkali generated at the time of development causes the reaction to release a mobile dye, which will be eliminated either by being dissolved in the processing solution or by being transferred to the processing material. Examples of these compounds and reducing agents are described in U.S. Pat. Nos. 4,559,290 and 4,783,369, European Patent No. 220,746A2, JIII Journal of Technical Disclosure No. 87-6,119 and Japanese Patent Application Laid-Open (JP-A) No. 8-101,487, paragraph 0080–0081.

A leuco dye, which becomes colorless, can also be used in the light-sensitive material of the present invention. For example, Japanese Patent Application Laid-Open (JP-A) No. 1-150,132 discloses a silver halide light-sensitive material containing a leuco dye which is given a color in advance by means of a metal salt of an organic acid as a color developer. Since a complex of a leuco dye and a developer undergoes a reaction by heat or reacts with an alkali to become colorless the use of the combination of a leuco dye and a color developer in the light-sensitive material of the present invention is desirable if the light-sensitive material of the present invention is to be subjected to a heat development.

In the present invention, a known leuco dye can be used, examples of which are described in Moriga and Yoshida, "Senryo to Yakuhin (Dyes and Chemicals)," vol. 9, pp. 84, Association of Chemical Products, "Shinban Senryo Binran (New Handbook of Dyes)", pp. 242, Maruzen Co., Ltd. (1970), R. Garner, "Reports on the Progress of Applied Chemistry," vol. 56, pp. 199 (1971), "Senryo to Yakuhin (Dyes and Chemicals)", vol. 19, pp. 230, Association of Chemical Products (1974), "Shikizai(Color Materials),", vol. 62, pp. 288 (1989) and "Senryo Kogyo (Die Industry)," vol. 32, pp. 208. Preferred color developers are a metal salt of an organic acid in addition to acid clay developers and a phenol/formaldehyde resin. Among metal salts of organic acids, metal salts of salicylic acids, a metal salt of a phenol/salicylic acid/formaldehyde resin, a rhodan salt and a metal salt of xanthogenic acid are preferable. Zinc is particularly preferable among the metals. An oil-soluble zinc salicylate described in U.S. Pat. Nos. 3,864,146 and 4,046,941 and in Japanese Patent Application Publication (JP-B) No. 52-1,327 can be also used as the color developers.

The silver halide color light-sensitive material of the present invention may contain a compound which activates the development and stabilizes the image. Preferred examples of these compounds are described in U.S. Pat. No. 4,500,626, columns 51–52.

An organic metal salt may be used as an oxidant together with a light-sensitive silver halide in the present invention. Among these organic metal salts, an organic silver salt is particularly preferable.

Examples of the organic compounds which can be used for the preparation of the above-mentioned organic silver salts serving as an oxidant include benzotriazoles, fatty acids and other compounds described in U.S. Pat. No. 4,500,626, columns 52–53. The silver acetylide, which is described in U.S. Pat. No. 4,775,613, is also useful. These silver salts may be used alone or in a combination of two or more of them.

The above-mentioned organic silver salt can be used in an amount in the range of 0.01 to 10 mol, and preferably 0.01 to 1 mol, based on 1 mol of the light-sensitive silver halide. The total coated weight of the light-sensitive silver halide and the organic silver salt is in the range of 0.05 to 10 g/m$^2$, and preferably 0.1 to 4 g/m$^2$, based on the weight of silver.

The light-sensitive material of the present invention is preferably hardened by means of a hardener.

Examples of the hardener include those described in U.S. Pat. Nos. 4,678,739, column 41 and 4,791,042, and in Japanese Patent Application Laid-Open (JP-A) Nos. 59-116,655, 62-245,261, 61-18,942 and 4-218,044. More specifically, examples of these hardeners include an aldehyde (e.g., formaldehyde), an aziridine, an epoxy, a vinylsulfone (e.g., N,N'-ethylene-bis(vinylsulfonylacetamide) ethane), a N-methylol compound (e.g., dimethylolurea), boric acid, metaboric acid and a polymeric compound (e.g., a compound described in Japanese Patent Application Laid-Open (JP-A) No. 62-234,157).

The amount of the hardener added is in the range of 0.001 g to 1 g, preferably 0.005 to 0.5 g, based on 1 g of the hydrophilic binder.

The silver halide color photographic light-sensitive material may contain an anti-fogging agent or a photographic stabilizer as well as a precursor thereof, examples of which include the compounds described in the aforesaid Research Disclosure, U.S. Pat. Nos. 5,089,378, 4,500,627 and 4,614,702, Japanese Patent Application Laid-Open (JP-A) No. 64-13,564, pp. 7–9, pp. 57–71 and pp. 81–97, U.S. Pat. Nos. 4,775,610, 4,626,500 and 4,983,494, Japanese Patent Application Laid-Open (JP-A) Nos. 62-174,747, 62-239,148, 1-150,135, 2-110,557, 2-178,650 and RD 17,643 (1978) pp. 24–25.

The amount of these compounds added is preferably in the range of $5\times10^{-6}$ to $1\times10^{-1}$ mol, more preferably $1\times10^{-5}$ to $1\times10^{-2}$ mol, based on 1 mol of silver.

A general thermal process of a silver halide color photographic light-sensitive material is well known in the art. For example, a light-sensitive material for heat development and a heat development process are described in "Syashinkogaku no kiso (Fundamentals of Photographic Engineering)", pp. 553–555, Corona Co., Ltd. (1970), "Eizojoho (Image Information)" (April, 1978), pp. 40, "Nablett's Handbook of Photography and Reprography", 7th Ed. (Vna Nostrand and Reinhold Company), pp. 32–pp. 33, U.S. Pat. Nos. 3,152,904, 3,301,678, 3,392,020 and 3,457,075, U. K. Pat. Nos. 1,131,108 and 1,167,777 and Research Disclosure (June, 1978), pp. 9–15 (RD-17,029).

The light-sensitive material of the present invention can be developed with an activator process or a processing solution containing a developing agent and or a base.

The activator process means a developing process in which a light-sensitive material containing a color developing agent is treated with a processing solution containing no color developing agent. A feature of the activator process is that the processing solution for the process does not contain a color developing agent which is contained in an ordinary developing solution. The processing solution for the activator process may contain components, such as an alkali and a co-developing agent. Examples of the activator processes are described in publicized literatures such as European Patent Nos. 545,491A1 and 565,165A1.

Methods for developing a light-sensitive material by means of a processing solution containing a developing agent and abase are described in RD Nos. 17,643, pp. 28–29, 18,716, pp. 651, left column to right column, and 307,105, pp. 880–881.

Details of the processing material and processing method to be employed in the hot developing process in the present invention are given below.

The light-sensitive material of the present invention may contain a thermal solvent to facilitate heat development, examples of which include polar organic compounds described in U.S. Pat. Nos. 3,347,675 and 3,667,959. Examples of such compounds include amide derivatives (e.g., benzamide), urea derivatives (e.g., methylurea and ethyleneurea), sulfonamide derivatives (e.g., compounds described in Japanese Patent Application Publication (JP-B) Nos. 1-40,974 and 4-13,701), polyol compounds (e.g., a sorbitol and a polyethylene glycol).

Where the thermal solvent is insoluble in water, preferably the thermal solvent is used as a solid dispersion. Depending on the purposes, the thermal solvent may be contained in any of a light-sensitive layer and non-light-sensitive layer.

The amount of the thermal solvent added is in the range of 10 to 500% by weight, preferably 20 to 300% by weight, based on the weight of the binder present in the layer to which the thermal solvent is to be added.

Although the heating temperature of the heat development process is in the range of about 50 to 250° C., the temperature is preferably in the range of 60 to 150° C. The processing material may have other functions, for example, a function to shut out the air at the time of heat development, a function to prevent the vaporization of the components of the light-sensitive material, a function to supply a material other than the base to the light-sensitive material and a function to remove a component of the light-sensitive material which becomes unnecessary after the development process (e.g., YF dye and AH dye) or an unnecessary component which is formed during the development process. The substrate and binder for the processing material can be the same as those for the light-sensitive material.

The processing material may contain a mordant for the removal of the dye as stated above or for other purpose. The mordant can be any of those known in the field of photography, examples of which include the mordants described in U.S. Pat. Nos. 4,500,626, columns 58–59, and in Japanese Patent Application Laid-Open (JP-A) No. 61-88, 256, pp. 32–41, 62-244,043 and 62-244,036. Further, the processing material can contain a dye acceptor polymeric compound described in U.S. Pat. No. 4,463,079, or the above-mentioned thermal solvent.

The processing layer of the processing material contains a base and/or a base precursor. The base may be either an organic base or an inorganic base. The base precursor may be any of those described hereinabove. The amount of the base or the base precursor to be used in the present invention is in the range of 0.1 to 20 g/m$^2$, preferably 1 to 10 g/m$^2$.

At the time when the light-sensitive material of the present invention undergoes the hot developing process utilizing the processing material, a small amount of water is used for such purposes as acceleration of development, acceleration of the transfer of the processing material, or acceleration of the diffusion of unnecessary substances as described in U.S. Pat. Nos. 4,704,245 and 4,470,445 and in Japanese Patent Application Laid-Open (JP-A) No. 61-238, 056. Such compounds as an inorganic salt of an alkali metal, an organic base, a solvent having a low boiling point, a surfactant, an anti-fogging agent, a compound forming a complex with a sparingly water-soluble metal salt, an anti-mold agent and an antibacterial agent may be added to the water.

The water is not particularly specified, and examples of the water include ion exchange water, distilled water, tap water, well water and mineral water. In the hot developing apparatus utilizing the light-sensitive material of the present invention and the processing material, the waste water may be discarded without being reused or may be recycled for repeated use. When using recycled water, the water used accumulates the components leached out of the materials over repeated use. Further, the apparatus and water described in Japanese Patent Application Laid-Open (JP-A) Nos. 63-144,354, 63-144,355, 62-38,460 and 3-210,555 may be used in the present invention.

Water can be supplied to the light-sensitive material or to the processing material or to both of them. The amount of the water to be added ranges preferably from 1/10 to the equivalent of an amount which is required for the maximum swelling of the entire coating layers (not including the back layer) composed of the light-sensitive material and the processing material.

Preferred examples of methods for supplying water to these materials include the methods described in Japanese Patent Application Laid-Open (JP-A) Nos. 62-253,159, pp. 5, and 63-85,544. Further, water in the form of microcapsules or hydrates may be incorporated in advance into the light-sensitive material or the processing material or into both of them.

The temperature of the water to be supplied may be in the range of 30 to 60° C. as described, for example, in Japanese Patent Application Laid-Open (JP-A) No. 63-85,544.

When conducting a heat development of the light-sensitive material in the presence of a small amount of water, it is effective to adopt a method in which a combination of a sparingly water-soluble basic metal compound and a complex forming compound so that a base is generated, as described in and European Patent Application Laid-Open No. 210,660 and in U.S. Pat. No. 4,740,445. In this patrone, it is desirable to incorporate the sparingly water-soluble basic metal compound in the light-sensitive material and to incorporate the complex forming compound in the processing material, from the viewpoint of the storage stability of the raw materials.

Examples of the heating method in the developing process include a method in which the light-sensitive material is brought into contact with a heated block or plate, a method in which the light-sensitive material is brought into contact with such an object as a hot plate, a hot presser, a hot roller, a hot drum, a halogen lamp heater and an infrared or a far infrared lamp heater, and a method in which the light-sensitive material is passed through a hot atmosphere.

As for the method for placing the light-sensitive material and the processing material face to face so that the light-sensitive layer and the processing layer face each other, the methods, which are described in Japanese Patent Application Laid-Open (JP-A) Nos. 62-253,159 and 61-147,244, pp. 27, can be employed.

For the purpose of processing the light-sensitive material and the processing material of the present invention, any known apparatus for heat development can be used. Preferred examples of the apparatus include the apparatus described in Japanese Patent Application Laid-Open (JP-A)

Nos. 59-75,247, 59-177,547, 59-181,353 and 60-18,951, Japanese Utility Model Application Laid-Open (JP-U) No. 62-25,944 and Japanese Patent Application Laid-Open (JP-A) Nos. 6-130,509, 6-95,338, 6-95,267, 8-29,955, and 8-29,954.

In addition, commercially available apparatus such as "Pictrostat" 100, 200, 300, 330 and 50 and "Pictrography" 3000 and 2000, manufactured by Fuji Photo Film Co., Ltd. Can be used in the present invention.

The light-sensitive material and/or the processing material of the present invention may have an electroconductive heat generator layer as a heating means for the heat development. For example, a heat generator layer described in Japanese Patent Application Laid-Open (JP-A) No. 61-145,544 can be used.

In the present invention, although the image information can be read out without removing the silver produced by development, and undeveloped silver halide from the light-sensitive material, it can be read out after removing the silver or silver halide. In the latter patrone, the silver or silver halide can be removed concurrently with or after the development.

In order to remove the developed silver from the light-sensitive material concurrently with the development or in order to complex or solubilize the silver halide, the processing material may contain a silver oxidizing or re-halogenating agent, which serves as a bleaching agent, and a solvent for the silver halide, which serves as a fixing agent, so that these reactions occur at the time of the heat development.

Further, after the developing process, a second processing material which contains a silver oxidizing or re-halogenating agent or a solvent for the silver halide and the light-sensitive material maybe placed face to face in order that the removal of the developed silver or the complexing or solubilizing of the silver halide be carried out.

In the present invention, in so far as the above-mentioned process does not provide adverse effects on the reading out of image information after development, it is preferable that the light-sensitive material be subjected to the above-mentioned process. Since the undeveloped silver halide causes significant haze in gelatin film to an extent that the background density increases, it is preferable to diminish the haze by use of the above-mentioned complexing agent or to solubilize the silver halide so that all or part of the silver halide is removed from the film.

From the viewpoint of reducing haze, it is preferable to use tabular silver halide grains having high aspect ratio or tabular silver halide grains containing silver chloride in high content, as described in the present invention.

In the present invention, a processing material can comprise a commonly used silver bleaching agent. Examples of a silver bleaching agent are described in U.S. Pat. Nos. 1,315,464 and 1,946,640 and in "Photographic Chemistry", vol. 2, chapter 30, Foundation Press, London, England. These bleaching agents effectively oxidize a silver image to make it soluble. Examples of useful silver bleaching agents include an alkali metal salt of dichromic acid and an alkali metal ferricyanide.

Preferred bleaching agents are a water-soluble compound, examples of which include ninhydrin, indandione, hexaketocyclohexane, 2,4-dinitrobenzoic acid, benzoquinone, benzenesulfonic acid and 2,5-dinitrobenzoic acid. The bleaching agents also include an organic complex of a metal, such as an iron (III) salt of cyclohexyldialkylaminetetraacetic acid, an iron (III) salt of ethylenediaminetetraacetic acid and an iron (III) salt of citric acid. The fixing agent can be a solvent for silver halide (i.e., solvent capable of dissolving silver halide) which can be used in the processing material for developing the light-sensitive material (the first processing material). The binder, substrate and other additives usable in the second processing material can also be the same substances as those usable in the first processing material.

The amount of bleaching agent to be added should be determined depending on the amount of silver contained in the light-sensitive material, and is in the range of 0.01 to 10 times, preferably 0.1 to 3 times, and more preferably 0.1 to 2 times the amount (mol) of silver present in the light-sensitive material per unit area.

The solvent for silver halide may be a known compound, examples of which include thiosulfates, such as sodium thiosulfate and ammonium thiosulfate, sulfites, such as sodium sulfite and sodium hydrogen sulfite, thiocyanates, such as potassium thiocyanate and ammonium thiocyanate, thioethers, such as 1,8-di-3,6-dithiaoctane, 2,2'-thiodiethanol, 6,9-dioxa-3,12-dithiatetradecane-1,14-diol as described in Japanese Patent Application Publication (JP-B) No. 47-11,386, a compound having a 5- or 6-membered imido ring, such as urasil and hydantoin as described in Japanese Patent Application Laid-Open (JP-A) No. 8-179,458, and a compound represented by the following general formula (V) as described in Japanese Patent Application Laid-Open (JP-A) No. 53-144,319. A mesoion thiolate compound of trimethyltriazolium thiolate described in "Analytica Chemica Acta", vol. 248, pp. 604 to 614 (1991), is also a preferred compound. A compound which is described in Japanese Patent Application Laid-Open (JP-A) No. 8-69,097 and which is capable of fixing a silver halide to stabilize it can also be used as a solvent for the silver halide. General formula (V)

$$N(R^9)(R^{10})—C(=S)—X—R^{11}$$

where X represents a sulfur atom or an oxygen atom. $R^9$ and $R^{10}$, which may be the same or different, each represent an aliphatic group, an aryl group, a heterocyclic group or an amino group. $R^{11}$ represents an aliphatic group or an aryl group. $R^9$ and $R^{10}$ or $R^{10}$ and $R^{11}$ may join together to form a 5-membered or a 6-membered heterocyclic ring. The above-described solvents for the silver halide may be used alone or in a combination of two or more of them.

Among the above-described compounds, a compound having a 5-membered or 6-membered imido ring, such as urasil or hydantoin, is particularly preferable.

The content of the total amount of the solvent for silver halide in the processing layer is in the range of 0.01 to 100 mmol/$m^2$, preferably 0.1 to 50 mmol/$m^2$, and more preferably 10 to 50 mmol/$m^2$. The total amount of the solvent for the silver halide in the light-sensitive material is in the range of 1/20 to 20 times, preferably 1/10 to 10 times, and more preferably 1/3 to 3 times the amount (mol) of silver present in the light-sensitive material. When using the solvent for silver halide, it may be added to a solvent, such as water, methanol, ethanol, acetone, dimethylformamide or methylpropyl gycol, or to an alkaline or acidic aqueous solution, or otherwise a dispersion comprising fine solid grains of the solvent for the silver halide may be added to a coating solution.

Alternatively, the processing material may contain a physical development nucleus and the solvent for silver halide, so that the solvent for silver halide solubilizes the silver halide contained in the light-sensitive material concurrently with the development and so that the physical development nucleus reduces the soluble silver halide diffused from the light-sensitive material to convert it to physically developed silver which is to be fixed to a processing layer. Any physical development nucleus known as such can be used in the present invention. Examples of the physical development nucleus include colloidal grains of a heavy metal, such as zinc, mercury, lead, cadmium, iron, chromium, nickel, tin, cobalt, copper, and ruthenium, a precious metal, such as palladium, platinum, silver, and gold, a chalcogen compound composed of the foregoing and a substance such as sulfuric acid, selenium or tellurium. These physical development nucleus substances are obtained by reducing a corresponding metal ion utilizing such a reducing agent as ascorbic acid, sodium boron hydride or hydroquinone to produce a colloidal dispersion of metal or by mixing a metal ion with a solution comprising a soluble sulfide, selenide or telluride to produce a colloidal dispersion of insoluble metal sulfide, metal selenide or metal telluride, respectively. These colloidal grains are formed preferably in a hydrophilic binder such as gelatin. The method for preparing colloidal silver grains is described, for example, in U.S. Pat. No. 2,688,601. If necessary, a salt removing process may be conducted in the preparation of the colloidal silver, as is known in a method for preparing silver halide emulsion wherein excessive salt is removed.

The grain diameters of these physical development nuclei are preferably in the range of 2 to 200 nm.

The physical development nuclei are present in an amount ranging normally from $10^{-3}$ to 100 mg/m$^2$, preferably from $10^{-2}$ to 10 mg/m$^2$, in the processing layer.

Although the physical development nucleus may be prepared separately from a coating solution and thereafter the physical development nuclei may be added to the coating solution, the physical development nucleus may be prepared, for example, by the reaction between silver nitrate and sodium sulfide or between gold chloride and a reducing agent in a coating solution containing a hydrophilic binder.

Silver, silver sulfide, palladium sulfide or the like is preferably employed as a physical development nucleus. When using as an image the physically developed silver, which has been transferred to a processing material, it is preferable to use palladium sulfide, silver sulfide and the like, because they have low fogging and high Dmax (maximum density) values.

Both the first processing material and the second processing material can have at least one polymerizable timing layer. The polymerizable timing layer can temporarily retard the bleaching and fixing reaction until the desired reaction among the silver halide, a dye forming compound and a developing agent substantially ends. The timing layer may comprise gelatin, polyvinyl alcohol or a vinyl alcohol/vinyl acetate copolymer. This layer may be a barrier timing layer as described in U.S. Pat. Nos. 4,056,394, 4,061,496 and 4,229,516.

The film thickness of the timing layer is in the range of 5 to 50 $\mu$m, preferably 10 to 30 $\mu$m.

According to the present invention, the light-sensitive material after exposure thereof is bleached and fixed utilizing the second processing material. That is, the process comprises supplying water, in an amount ranging from 1/10 to the equivalent of an amount which is required for the maximum swelling of the total of the light-sensitive material layer and the second processing material layer excepting the back respective layers, to the light-sensitive material or to the second processing material, placing the light-sensitive material and the second processing material so that the light-sensitive layer and processing layer face each other and thereafter heating them to a temperature in the range of 40 to 100° C. for 5 to 60 seconds.

As for the amount of water, kind of water, method of supplying water and method of placing the light-sensitive material and the second processing material face to face, the same as those in the patrone of the first processing material can be employed.

More specifically, the second processing material described in Japanese Patent Application Laid-Open (JP-A) No. 59-136,733, U.S. Pat. No. 4,124,398 and Japanese Patent Application Laid-Open (JP-A) No. 55-28,098 can be used in the present invention.

For such purposes as improvement of the coatability, improvement of the releasability, improvement of the slipperiness, prevention of electrostatic charge and acceleration of developing reaction, a surfactant may be added to the light-sensitive material. Examples of the surfactants include those described in "Known Technologies" No. 5 (issued on Mar. 22, 1991, AZTEC Co., Ltd.), pp. 136–138 and in Japanese Patent Application Laid-Open (JP-A) Nos. 62-173,463 and 62-183,457.

For such purposes as prevention of slip, prevention of electrostatic charge and improvement of the releasability, an organic fluorine-containing compound may be added to the light-sensitive material. Typical examples of the organic fluorine-containing compounds include a fluorine-containing surfactant and a hydrophobic fluorine-containing compound, such as an oily fluorine-containing compound, e.g., fluorocarbon oil, and a solid fluorine-containing resin, e.g., tetrafluoroethylene, described in Japanese Patent Application Publication (JP-B) No. 57-9,053, columns 8–17, Japanese Patent Application Laid-Open (JP-A) Nos. 61-20,944 and 62-135,826.

Preferably, the light-sensitive material has a certain level of slipperiness. For this purpose, the light-sensitive material may contain a slicking agent. It is preferable that a slicking agent is contained both in the light-sensitive layer and in the back layer. A preferred level of slipperiness is indicated by a coefficient of dynamic friction in the range of 0.01 to 0.25, which represents a measured value determined in a test comprising sliding the light-sensitive material at a rate of 60 cm/minute against stainless steel balls having a diameter of 5 mm (25° C., 60% RH). Here, even in the case of the light-sensitive layer, the substantially same level can be obtained.

Examples of usable slicking agents include polyorganosiloxanes, higher aliphatic acid amides, metal salts of higher fatty acid and esters made up of higher fatty acids and higher alcohols. Examples of the polyorganosiloxanes include polydimethylsiloxane, polydiethylsiloxane, polystyrylmethylsiloxane and polymethylphenylsiloxane. Polydimethylsiloxane and an ester having a long alkyl chain are particularly preferable. The layer to which the slicking agent is added is preferably the outermost light-sensitive layer or the back layer.

It is preferable to use an anti-static agent in the present invention. Polymers, which contain carboxylic acid, carboxylic acid salt or a sulfonic acid salt, cationic polymers and ionic surfactants can be used as the anti-static agent.

The most preferred anti-static agent is grains of at least one type of crystalline metal oxide having grain sizes in the range of 0.001 to 1.0 $\mu$m, selected from the group consisting of ZnO, $TiO_2$, $SnO_2$, $Al_2O_3$, $In_2O_3$, $SiO_2$, MgO, BaO, $MoO_3$ and $V_2O_5$ and having a volume resistivity of $10^7$ Ω·cm or less, preferably $10^5$ Ω·cm or less, or grains of a complex oxide thereof, for example, complex of an element such as Sb, P, B, In, S, Si, C and the like and the foregoing metal oxide. The amount of an anti-static agent present in the light-sensitive material is preferably in the range of 5 to 500 mg/m$^2$, more preferably in the range of 10 to 350 mg/m$^2$. The ratio of the electroconductive crystalline oxide or the complex oxide thereof to a binder is preferably in the range of 1/300 to 100/1, more preferably 1/100 to 100/5.

The silver halide color light-sensitive material (including back layers) can contain a polymer latex in order to improve film physical properties such as dimension stability, prevention of curling, prevention of adhering, prevention of film cracking and prevention of pressure-induced sensitization or desensitization. Any and all polymer latices, which are described in Japanese Patent Application Laid-Open (JP-A) Nos. 62-245,258, 62-136,648 and 62-110,066, can be used in the present invention. Particularly, the utilization of a polymer latex having a low glass transition point (40° C. or less) in the mordant layer of the processing material can prevent cracking of the mordant layer, while the utilization of a polymer latex having a high glass transition point in the back layer of the processing material can prevent curling.

Preferably, the silver halide color light-sensitive material of the present invention contains a matting agent. Although the matting agent may be added to either the light-sensitive layer or the back layer, it is particularly preferable that the matting agent be added to the outermost layer on the same side of the substrate as the light-sensitive layer is provided. Although the matting agent may be soluble or insoluble in a processing solution, it is preferable to use a combination of a soluble matting agent and an insoluble matting agent in the present invention. An example of such a combination of matting agents comprises grains of polymethyl methacrylate, poly (methyl methacrylate/methacrylic acid) (in a molar ratio of 9/1 or 5/5) and polystyrene. The matting agent has grain diameters preferably in the range of 0.8 to 10 $\mu$m and preferably has a narrow range of grain diameter distribution. It is preferable that 90% or more of the total number of the grains have a diameter falling in the range of 0.9 to 1.1 times the average grain diameter. Meanwhile, in order to enhance the matting effect, it is also preferable to use fine grains having a grain diameter of 0.8 $\mu$m or less, together with the matting agent having the above-mentioned grain diameter. Examples of fine grains include grains of polymethyl methacrylate (0.2 $\mu$m), grains of poly(methyl methacrylate/methacrylic acid) (in a molar ratio of 9/1, 0.3 $\mu$m ), grains of polystyrene (0.25 $\mu$m) and grains of colloidal silica (0.03 $\mu$m).

Concrete examples of the matting agent are described in Japanese Patent Application Laid-Open (JP-A) No. 61-88, 256, pp. 29. Other examples of the matting agent are such materials as benzoguanamine resin beads, polycarbonate beads and AS resin beads, all of which are described in Japanese Patent Application Laid-Open (JP-A) Nos. 63-274, 944 and 63-274,952. Further, the compounds which are described in the aforesaid Research Disclosure can be employed as the matting agent.

In the present invention, a substrate for the light-sensitive material and the processing material needs to be able to withstand the processing temperature. Generally, examples of the substrate are paper, a synthetic polymer (film) and the like, as described in "Syashinkogaku no kiso—Ginen Syashin Hen (Fundamentals of Photographic Engineering—Silver Salt Photography Section)", pp. 223–240, edited by Photographic Society of Japan, Corona Co., Ltd., 1979. Concrete examples of the substrate include polyethylene terephthalate, polyethylene naphthalate, polycarbonate, polyvinyl chloride, polystyrene, polypropylene, polyimide and cellulose (e.g., triacetylcellulose).

These materials may be used alone. Further, a substrate in which a synthetic polymer such as polyethylene may be laminated to one side or both sides of paper can be used.

Other substrates, which can be used in the present invention, include those described in Japanese Patent Application Laid-Open (JP-A) Nos. 62-253,159, pp. 29–31, 1-161,236, pp. 14–17, 63-316,848, 2-22,651 and 3-56,955 and U.S. Pat. No. 5,001,033.

Where requirements of resistance to heat and curling are stringent, preferred examples of the substrates are those described in Japanese Patent Application Laid-Open (JP-A) Nos. 6-41,281, 6-43,581, 6-51,426, 6-51,437 and 6-51,442 and in Japanese Patent Application Laid-Open (JP-A) Nos. 6-82,961, 6-82,960, 6-123,937, 6-82,959, 6-67,346, 6-266, 050, 6-202,277, 6-175,282, 6-118,561, 7-219,129 and 7-219,144 and U.S. Pat. No. 5,326,689.

Also preferable is a substrate mainly made from a styrene-based polymer having a syndiotactic structure.

In order to bond the photographic layer to the substrate, it is preferable that the substrate be surface-treated. Examples of the surface processes include a chemical process, a mechanical process, a corona discharge process, a flame process, an ultraviolet ray process, a high frequency wave process, a glow discharge process, an activated plasma process, a laser process, a mixed acid process and an ozone-oxidation process. Among these surface processes, an ultraviolet irradiation process, a flame process, a corona discharge process and glow discharge process are particularly preferable.

A substratum may comprise single layer or may comprise two or more layers. Examples of the binder for the substratum include a copolymer, which is made up of a monomer selected from the group consisting of vinyl chloride, vinylidene chloride, butadiene, methacrylic acid, acrylic acid, itaconic acid, maleic anydride and the like, polyethylene imine, an epoxy resin, grafted gelatin, nitrocellulose and gelatin. Examples of the compound, which swells the substrate, include resorcin and p-chlorophenol. Examples of a gelatin-hardening agent which can be used in the substratum include chromates (e.g., chrome alum), aldehydes (e.g., formaldehyde and glutaric aldehdye), isocyanates, active halogen compounds (e.g., 2,4-dichloro-6-hydroxy-s-triazine), an epichlorohydrin resin and active vinylsulfonic compounds. Further, the substratum may contain $SiO_2$, $TiO_2$ grains of an inorganic material or grains of a copolymer of polymethyl methacrylate (0.01 to 10 $\mu$m) as a matting agent.

In addition, it is preferable to record photographic information and the like by use of a substrate which is provided with a magnetic recording layer and is described in Japanese Patent Application Laid-Open (JP-A) Nos. 4-124,645, 5-40, 321, 6-35,092 and 6-317,875.

A magnetic recording layer is formed by coating onto a substrate an aqueous or organic solvent-based coating solution comprising a binder and magnetic grains dispersed therein.

Examples of usable magnetic grains include ferromagnetic iron oxide such as $\gamma$-$Fe_2O_3$, Co-covered $\gamma$-$Fe_2O_3$, Co-covered magnetite, Co-containing magnetite, ferromagnetic chromium dioxide, ferromagnetic metals, ferromagnetic alloys, hexagonal Ba-ferrite, Sr-ferrite, Pb-ferrite and Ca-ferrite. A Co-covered ferromagnetic iron oxide such as Co-covered $\gamma$-$Fe_2O_3$ is preferable. The shape of the magnetic grains may be selected from the group consisting of needles, grains, spheres, cubes and plates. The specific surface area in $S_{BET}$ is preferably 20 m$^2$/g or greater, more preferably 30 m$^2$/g or greater. The saturation magnetization ($\sigma s$) of the ferromagnetics is preferably in the range of $3.0\times10^4$ to $3.0\times10^5$ A/m, more preferably $4.0\times10^4$ to $2.5\times10^5$ A/m. The ferromagnetic grains maybe surface-treated with silica and/or alumina or with an organic substance.

Further, as described in Japanese Patent Application Laid-Open (JP-A) No. 6-161,032, the ferromagnetic grains may be surface-treated with a silane coupling agent or with a titanium coupling agent. Magnetic grains, which are covered with an inorganic or organic substance and are described in Japanese Patent Application Laid-Open (JP-A) Nos. 4-259,911 and 5-81,652, can also be used in the present invention.

As described in Japanese Patent Application Laid-Open (JP-A) No. 4-219,569, the binders usable together with the magnetic grains are thermoplastic resin, thermosetting resin, radiation-curable resins, reactive resins, acid-, alkali- or biodegradable polymers, naturally occurring polymers (e.g., cellulose derivatives and derivatives of saccharides) and mixtures thereof. These resins have a Tg in the range of −40 to 300° C. and a weight-average molecular weight in the range of 2,000 to 1,000,000. Preferred examples of the binder include vinyl-based copolymers, cellulose derivatives, such as cellulose diacetate, cellulose triacetate, cellulose acetate propionate, cellulose acetatebulylate and cellulose tripropionate, acrylic resins, polyvinyl acetal resins and gelatin. Cellulose di(tri)acetate is particularly preferable. The binder may be hardened by use of a crosslinking agent such as an epoxy-type, aziridine-type or isocyanate-type crosslinking agent. Examples of the isocyanate-type crosslinking agent include isocyantes, such as tolylenediisocyanate, 4,4'-diphenylmethanediisocyanate, hexamethylenediisocyanate and xylylenediisocyanate, a reaction product of any of these isocyanates and a polyalcohol (e.g., a tolylenediisocyanate/trimethylol propane in 3/1 molar ratio adduct) and a polyisocyanate produced by a condensation reaction of these isocyanates, all of which are described, for example, in Japanese Patent Application Laid-Open (JP-A) No. 6-59,357.

As described in Japanese Patent Application Laid-Open (JP-A) No. 6-35,092, the aforementioned magnetic grains are dispersed in a binder preferably by means of a kneader, a pin-type mill or an annular mill. A combination of these dispersing means is also preferable. A dispersant, such as the dispersant described in Japanese Patent Application Laid-Open (JP-A) No. 5-88,283 and other known dispersants, may be used in order to disperse the magnetic grains in the binder. The thickness of the magnetic recording layer is in the range of 0.1 to 10 $\mu$m, preferably 0.2 to 5 $\mu$m, and more preferably 0.3 to 3 $\mu$m. The ratio of the weight of the magnetic grains to the weight of the binder is preferably in the range of 0.5:100 to 60:100, more preferably 1:100 to 30:100. The coated weight of the magnetic grains is in the range of 0.005 to 3 g/m$^2$, preferably 0.01 to 2 g/m$^2$, and more preferably 0.02 to 0.5 g/m$^2$. The transmission yellow density of the magnetic recording layer is preferably in the range of 0.01 to 0.50, more preferably 0.03 to 0.20, and most preferably 0.04 to 0.15. The magnetic recording layer may be formed on the entire surface or in a stripe on the reverse side of a photographic substrate by coating or printing the coating solution for forming the magnetic recording layer. Employable methods for forming the magnetic recording layer include an air doctor method, a blade method, an air knife method, squeezing, impregnation, reverse roll coating, transfer roll coating, gravure coating, kissing, casting, spraying, dipping, bar coating and extrusion. The coating solution, which is described, for example, in Japanese Patent Application Laid-Open (JP-A) No. 5-341,436, is preferably used.

The magnetic recording layer may also function in the enhancement of lubrication, control of curling, prevention of electrostatic charge, prevention of adhering and head polishing. Also, another functional layer having any of these functions may be formed. The abrasive grains, which impart a head polishing function to the magnetic recording layer or to another functional layer, preferably contain at least one type of grain having a Moh's hardness of 5 or greater and are non-spherically shaped inorganic grains. Examples of non-spherical inorganic grains include oxides, such as aluminum oxide, chromium oxide, silicon dioxide and titanium dioxide, carbides, such as silicon carbide and titanium carbide, and diamond. The surface of abrasive grains may be treated with a silane coupling agent or with a titanium coupling agent. These grains may be added to the magnetic recording layer. Alternatively, the magnetic recording layer may be overcoated with a coating solution (e.g., a protective layer and lubricating layer) containing these grains. As for the binder in the overcoat, the same binders as those mentioned above may be used, and the binder in the overcoat is preferably the same as that for the magnetic recording layer. The light-sensitive materials having a magnetic recording layer are described in U.S. Pat. Nos. 5,336,589, 5,250,404, 5,229,259 and 5,215,874 and in EP 466,130.

A polyester substrate, which is preferably used in the light-sensitive material having the above-described magnetic recording layer, is described below. Details of the polyester substrate along with a light-sensitive material, a processing procedure, a cartridge and examples in use thereof are shown in JIII Journal of Technical Disclosure No. 94-6,023 (issued on Mar. 15, 1994 from The Japan Institution of Invention and Innovation).

The polyester is made up of a diol and an aromatic dicarboxylic acid. Examples of the aromatic dicarboxylic acid include 2,6-, 1,5-, 1,4- and 2,7-naphthalenedicarboxylic acid, terephthalic acid, isophthalic acid and phthalic acid. Examples of the diol include diethylene glycol, triethylene glycol, cyclohexanedimethanol, bisphenol A and bisphenol. Examples of polymers, which are formed from theses monomers, include homopolymers such as polyethylene terephthalate, polyethylene naphthalate and polycyclohexanedimethanol terephthalate. A polyester, in which 2,6-naphthalenedicarboxylic acid comprises 50 to 100 mol % of the carboxylic acid monomer composition, is preferable, and polyethylene 2,6-naphthalate is particularly preferable. The average molecular weight of the polyester is in the range of about 5,000 to 200,000. Tg of the polyester is 50° C. or greater, preferably 90° C. or greater.

Next, in order to make the polyester substrate low-curling, the polyester substrate is subjected to a heat process at a temperature which is preferably above 40° C. but below Tg, more preferably above (Tg−20)° C. but below Tg. The heat process may be carried out in a continuous manner at a temperature within the above-mentioned range, or it may be carried out discontinuously so that a cooling step is effected between heat-processing steps. The duration of the heat process is preferably in the range of 0.1 to 1,500 hours, more preferably 0.5 to 200 hours. The heat process may be effected while the substrate is held in the shape of a roll, or the heat process may be effected while the substrate is in the shape of a web while being carried. Electroconductive inorganic grains, such as $SnO_2$ and $Sb_2O_5$, may be provided onto the surface of the substrate to impart surface roughness so that the surface condition is improved. Further, it is preferable that the substrate be designed in such a way that the tips of the roll are slightly elevated relative to other parts so that transfer of the cut end mark in the roll core is prevented. Although the heat process may be carried out after film forming, after surface process, after application of back layer (e.g., antistatic agent, slicking agent or the like) and after application of primer, the heat process is carried out preferably after the application of an anti-static agent.

An ultraviolet absorber may be blended into the polyester. Further, in order to prevent light piping, a dye or pigment, commercialized for polyester use under the names of "Diaresin" (from Mitsubishi Chemical Industries, Co., Ltd.) or "Kayaset" (from Nihon Kayaku Co., Ltd.) may be blended into the polyester.

A film patrone (a film case), into which the light-sensitive material of the present invention may be encased, is explained below. The main material of the film patrone may be a metal or a synthetic plastic.

Preferred examples of the plastic material include polystyrene, polyethylene, polypropylene and polyphenyl ether. The film patrone may contain an anti-static agent, examples of which include carbon black, metal oxide grains, surfactants, such nonionic, anionic, cationic orbetaine-based surfactants, and polymers. Examples of the film patrones, which have been rendered antistatic, are described in Japanese Patent Application Laid-Open (JP-A) Nos. 1-312,537 and 1-312,538. The resistivity of the film patrone is preferably $10^{12}$ Ω·cm or less in a condition of 25° C. and 25% RH. Normally, carbon black or a pigment is incorporated into the plastic film patrone in order to afford shading. The size of the film patrone may be the 135 size which is currently employed (the diameter of cartridge of the 135 size is 25 mm). For use in a small-sized camera, a film patrone having a diameter of the cartridge of 22 mm or less may be used. The patrone volume of the film patrone is 30 $cm^3$ or less, preferably 25 $cm^3$ or less. The weight of the plastics for a film patrone is preferably in the range of 5 to 15 g.

A film patrone which feeds out film by the rotation of a spool may be used for the light-sensitive material of the present invention. A film patrone wherein the end of the film is fed from the port of the film patrone to the outside by rotating the spool axis in the direction of the feed of the film can also be used. These film patrones are described in U.S. Pat. Nos. 4,834,306 and 5,226,613.

As for the method to form an image on a sheet of color paper or on a light-sensitive material for heat development, the methods, which are described in Japanese Patent Application Laid-Open (JP-A) Nos. 5-241,251, 5-19,364 and 5-19,363, can be used.

Examples of an employable method for producing a print on a sheet of color paper or on a light-sensitive material for use in heat development by using the above-mentioned silver halide color photographic materials are described in, for example, JP-A Nos. 5-241,251, 5-19,364 and 5-19,363.

EXAMPLES

In order to better explain the present invention, the following examples are given by way of illustration and not by way of limitation.

Example 1

(1) Preparation of Emulsion (tabular silver iodobromide grain emulsion 1-A (a comparative emulsion))

The pH of 1,000 ml of an aqueous solution containing 0.5 g of oxidation-treated gelatin and 0.37 g of KBr was adjusted to 2 by the addition of $H_2SO_4$, and the reaction mixture was stirred at 40° C. To the reaction mixture were simultaneously added 20 ml of a 0.3M $AgNO_3$ aqueous solution (A) and 20 ml of a 0.3M KBr aqueous solution (B) in 40 seconds by means of a double jet. Then, after the pH value of the reaction mixture was adjusted to 5.0 by the addition of NaOH and the pAg value was adjusted to 9.9 by the addition of a KBr solution, the temperature of the reaction mixture was raised to 75° C. in 35 minutes. At this temperature, after the addition of 35 g of oxidation-treated gelatin, 921 ml of a 1.2M $AgNO_3$ aqueous solution (C) and 800 ml of a 1.4M KBr aqueous solution (D) were added in 33 minutes by accelerating the flow rate (final flow rate is 7.2 times the initial flow rate) while keeping pAg at 8.58.

The reaction mixture was cooled down to 55° C., and 80 ml of a 0.4M $AgNO_3$ aqueous solution (E) and 223 ml of a 0.12M KI aqueous solution (F) were added to the reaction mixture in 3 minutes at a constant flow rate. Then, after the pAg value was adjusted to 8.8 by the addition of a KBr aqueous solution, 115 ml of a 1.8M $AgNO_3$ aqueous solution (G) and 131 ml of a 1.8M KBr aqueous solution (H) were added to the reaction mixture.

The temperature of the reaction mixture was then lowered to 35° C., and thereafter the reaction mixture was flocculated in a conventional way by use of a flocculant ("Demole" manufactured by Kao Corporation). After a water washing step, 75 g of gelatin and 10 ml of phenoxyethanol were added to the flocculation product, which was adjusted to pH: 5.5 and pAg: 8.2.

In this way, an emulsion was obtained in which the projected area of tabular grains exceeded 99% of the total projected area of all the grains and the tabular grains were made up of hexagonal tabular grains having an aspect ratio of 23.9, an average equivalent-sphere diameter of 0.76 μm, an average grain thickness of 0.08 μm and an average equivalent-circle diameter of 1.91 μm.

The above-mentioned values of average grain thickness and average equivalent-sphere diameter were obtained from photographs by means of a replica method utilizing a transmission electron microscope.

The following tabular silver iodobromide grain emulsions 1-B~1-D were prepared in the same way as in the case of the tabular silver iodobromide grain emulsion 1-A but with the exceptions described below. The average grain aspect ratio and average equivalent-sphere diameter of the obtained tabular silver iodobromide grain emulsions 1-B~1-D were nearly equal to those of the iodobromide grain emulsions 1-A. (tabular silver iodobromide grain emulsion 1-B (a light-sensitive silver halide emulsion of the present invention))

The procedure for the preparation of the tabular silver iodobromide grain emulsion 1-A was repeated, except that the solution (H) contained tripotassium iridium hexachloride in an amount of $1\times10^{-7}$ mol based on iridium. (tabular silver iodobromide grain emulsion 1-C (a light-sensitive silver halide emulsion of the present invention))

The procedure for the preparation of the tabular silver iodobromide grain emulsion 1-A was repeated, except that the solution (H) contained potassium ferrocyanide in an amount of $6\times10^{-5}$ mol based on iron.

(tabular silver iodobromide grain emulsion 1-D (a comparative emulsion))

The procedure for the preparation of the tabular silver iodobromide grain emulsion 1-A was repeated, except that the solution (H) contained tripotassium rhodium hexabromride in an amount of $2\times10^{-8}$ mol based on rhodium.

(2) Chemical Sensitization

At a temperature of 60° C., a pH of 6.2 and a pAg of 8.4, the spectral sensitization and chemical sensitization of the tabular silver iodobromide grain emulsions 1-A~1-D were performed by adding thereto the following spectrally sensitizing dyes (sensitizing dyes I to III for green-sensitive emulsion), the following compound I and a selenium sensitizer along with potassium thiocyanate, chloroauric acid and sodium thiosulfate. For the purpose of ending the chemical sensitization, the following terminator of chemical sensitization was used.

The amount of the chemical sensitizer (selenium sensitizer) was controlled so that the sensitivity of each of the tabular silver iodobromide emulsions at 1/100 second exposure became a maximum. Besides, in the case of the tabular silver iodobromide emulsions 1-C and 1-D, zinc nitrate was added to the tabular silver iodobromide emulsion at the time when gelatin was dispersed in the emulsion after the stage of water washing.

Sensitizing dye I for green-sensitive emulsion

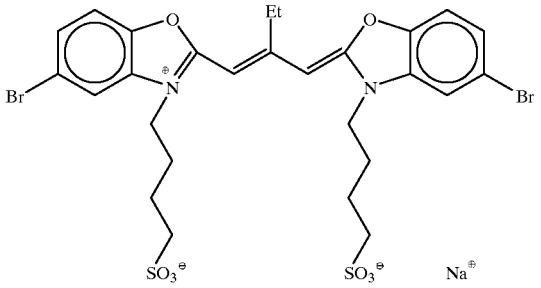

Sensitizing dye II for green-sensitive emulsion

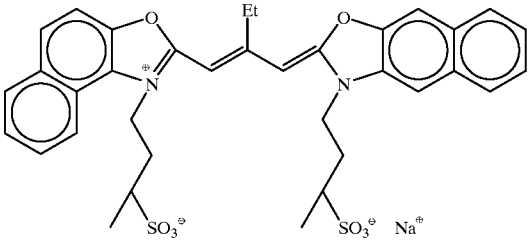

Sensitizing dye III for green-sensitive emulsion

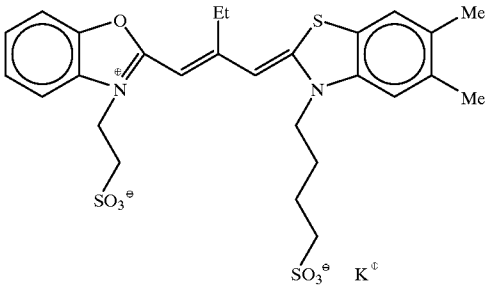

I:II:III=17:4:2 (molar ratio) for blend

Terminator of chemical sensitization

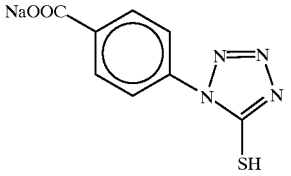

Selenium sensitizer

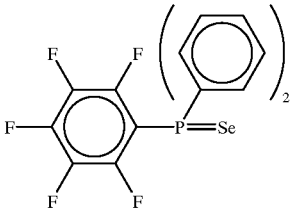

Compound I

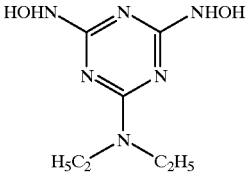

(3)Preparation of Dispersion and Coated Material, and Evaluation Thereof

A dispersion of zinc hydroxide used as the base precursor was prepared.

31 g of zinc hydroxide powder with primary particles having a particle size of 0.2 μm, 1.6 g of carboxymethyl cellulose and 0.4 g of sodium polyacrylate as dispersants, 8.5 g of lime-treated ossein gelatin, and 158.5 ml of water were mixed. Then, the resultant mixture was dispersed for one hour by means of a mill using glass beads. After dispersion, the glass beads were removed and 188 g of a zinc hydroxide dispersion was obtained.

An dispersion of a magenta coupler was prepared.

7.80 g of magenta coupler (a), 5.45 g of developing agent (b), 8.21 g of organic solvent having high boiling point (d), and 24.0 ml of ethyl acetate were dissolved at 60° C. to obtain a solution. The solution previously prepared was added to 150 g of aqueous solution containing 12.0 g of lime-treated gelatin and 0.6 g of sodium dodecylbenzenesulfonate and mixed therewith. Then, the resultant mixture was dispersed for 20 minutes by means of a dissolver agitator at 10,000 r.p.m. After completion of the dispersion, distilled water was added to the resultant dispersion to give a total amount of 300 g and mixed therewith for 10 minutes at 2,000 r.p.m.

Magenta coupler (a):

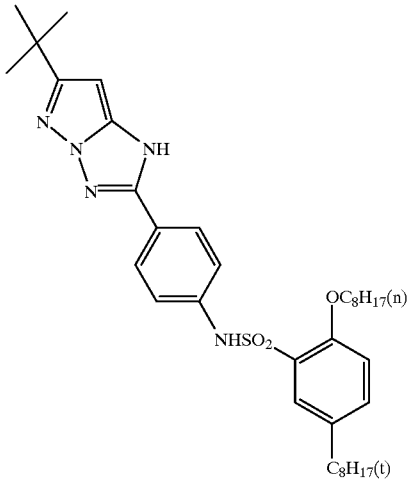

Developing agent (b):

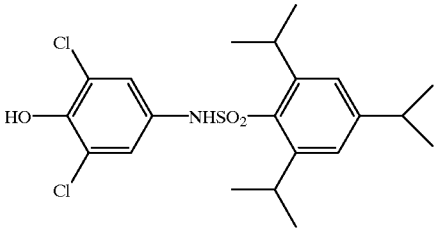

Anti-fogging agent (c):

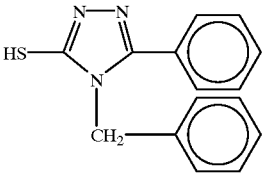

Organic solvent having a high boiling point (d):

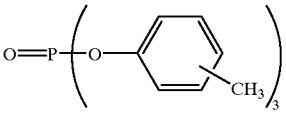

Surfactant (e):

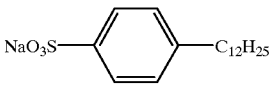

These dispersions were combined with the tabular silver iodobromide emulsion 1-A to prepare the composition shown in Table 1. Then, the composition was applied to a substrate to prepare a single-layered light-sensitive material (Sample 101) containing a developing agent. In a similar way, the silver halide color photographic light-sensitive materials of the present invention (Samples 102 and 103) and a light-sensitive material (104) were prepared by replacing "1-A" with "1-B", "1-C" or "1-D", respectively in Table 1. An anti-fogging agent (c) was added when a coating liquid for a magenta coloring layer was prepared.

TABLE 1

| Layer configuration | Coating material | Coating weight (mg/m$^2$) |
|---|---|---|
| Protective layer | Lime-treated gelatin | 1000 |
| | Matting agent (silica) | 50 |
| | Surfactant (f) | 100 |
| | Surfactant (g) | 300 |
| | Water-soluble polymer (h) | 15 |
| | Hardener (i) | 35 |
| Intermediate layer | Lime-treated gelatin | 375 |
| | Surfactant (g) | 15 |
| | Zinc hydroxide | 1100 |
| | Water-soluble polymer (h) | 15 |
| Magenta dye forming layer | Lime-treated gelatin | 2000 |
| | Emulsion (based on amount of coated silver) | 1726 Emulsions 1-A |
| | Magenta coupler (a) | 637 |
| | Developing agent (b) | 444 |
| | Anti-fogging agent (c) | 4 |
| | Organic solvent having high boiling point (d) | 670.0 |
| | Surfactant (e) | 33 |
| | Water-soluble polymer (h) | 14 |
| Transparent PET base (120 $\mu$m) | | |

Surfactant (f)

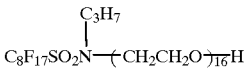

Surfactant (g)

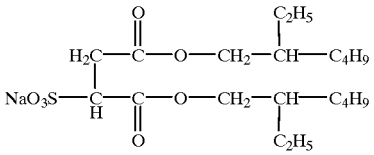

Water-soluble polymer (h)

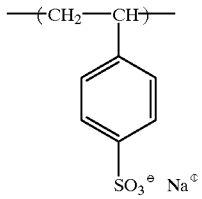

Hardener (i)

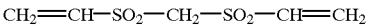

Next, a processing material P-1 of the composition shown in Tables 2 and 3 was prepared.

Table 2 shows the details of the processing layers formed on a substrate Transparent substrate A) for the preparation of a processing material P-1. Table 3 shows the details of the substrate (Transparent substrate A).

TABLE 2

| Constituent layer | Added substance | Amount added (mg/m$^2$) |
|---|---|---|
| 4th layer | Acid-treated gelatin | 220 |
| Protective layer | Water-soluble polymer (j) | 60 |
| | Water-soluble polymer (k) | 200 |
| | Palladium sulfide | 3 |
| | Potassium nitrate | 12 |
| | Matting agent (m) | 10 |
| | Surfactant (g) | 7 |
| | Surfactant (n) | 7 |
| | Surfactant (o) | 10 |

TABLE 2-continued

| Constituent layer | Added substance | Amount added (mg/m$^2$) |
|---|---|---|
| 3rd layer | Lime-treated gelatin | 240 |
| Intermediate layer | Water-soluble polymer (k) | 24 |
| | Hardener (p) | 180 |
| | Surfactant (e) | 9 |
| 2nd layer | Lime-treated gelatin | 2400 |
| Base generating layer | Water-soluble polymer (k) | 360 |
| | Water-soluble polymer (q) | 700 |
| | Water-soluble polymer (s) | 1000 |
| | Organic solvent having a high boiling point (s) | 2000 |
| | Additive (t) | 20 |
| | Potassium hydantoin | 260 |
| | Guanidine Picolinic acid | 2910 |
| | Potassium quinolinate | 225 |
| | Sodium quinolinate | 180 |
| | Surfactant (g) | 24 |
| 1st layer | Lime-treated gelatin | 280 |
| Prime layer | Water-soluble polymer (j) | 12 |
| | Surfactant (g) | 14 |
| | Hardener (p) | 185 |
| Transparent substrate A (63 $\mu$m) | | |

TABLE 3

| Name of layer | Composition | Weight (mg/m$^2$) |
|---|---|---|
| Prime layer on the front side | Gelatin | 100 |
| Polymer layer | Polyethylene terephthalate (PET) | 62500 |
| Prime layer on the reverse side | Methyl methacrylate/styrene/2-ethylhexyl acrylate/methacrylic acid copolymer | 1000 |
| | | 120 |
| | PMMA latex (average particle diameter: 12 $\mu$) | 63720 |

Water-soluble polymer (j): K-carrageenan

Water-soluble polymer (k): Sumikagel L-5H (from Sumitomo Chemical Co., Ltd.)

Matting Agent (m):

SYLOID 79 (from Fuji-Davison Chemical Co., Ltd.)

Surfactant (n):

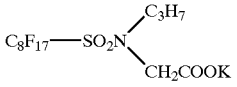

Surfactant (o):

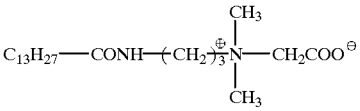

Hardener (p):

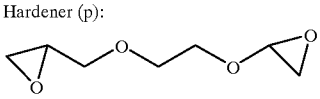

Water-soluble polymer (q):
Dextran (molecular weight: 70,000)

-continued

Water-soluble polymer (s):

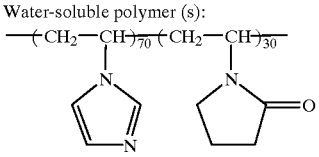

Compound (2)

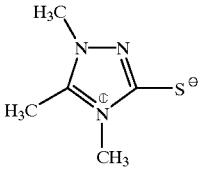

The samples 101 to 104 were exposed to light for 1/10,000 second by means of "Sensitometer MRRKVII" manufactured by EGG Corporation via an optical wedge and a green filter.

After the exposure, heat development was carried out by the procedure comprising supplying 15 ml/m$^2$ of warm water at 40° C. to the light-sensitive layer (magenta coloring layer, intermediate layer and protective layer) of each of the samples, putting together the light-sensitive layer of each of the samples and the processing layer (the first to fourth layers) of a processing material P-1 face to face and thereafter heating the materials to 78° C. to keep them at that temperature for 17 seconds by use of a heat drum. A magenta wedge-shaped image was obtained in the samples when the samples were removed from the processing material P-1 after the first processing of the above-described procedure.

Then, the samples 101 to 104 were subjected to a second processing by use of a second processing material P-2 shown in Table 4. "Compound 2" shown in Table 4 is as described previously. The details of "transparent substrate A" are shown in Table 3.

TABLE 4

| Layer configuration | Coating material | Coating weight (mg/m$^2$) |
|---|---|---|
| Protective layer (Fourth layer) | Acid-treated gelatin | 220 |
| | Water-soluble polymer (j) | 60 |
| | Water-soluble polymer (k) | 200 |
| | Potassium nitrate | 12 |
| | Matting agent (m) | 10 |
| | Surfactant (g) | 7 |
| | Surfactant (n) | 7 |
| | Surfactant (o) | 10 |
| Intermediate layer (Third layer) | Lime-treated gelatin | 240 |
| | Water-soluble polymer (k) | 24 |
| | Hardener (p) | 180 |
| | Surfactant (g) | 9 |
| Base generating layer (Second layer) | Lime-treated gelatin | 2400 |
| | Water-soluble polymer (k) | 360 |
| | Water-soluble polymer (q) | 700 |
| | Water-soluble polymer (s) | 900 |
| | Compound (2) | 6000 |
| | Surfactant (g) | 20 |
| | Guanidine picolinic acid | 1000 |
| Substratum (First layer) | Lime-treated gelatin | 280 |
| | Water-soluble polymer (j) | 12 |
| | Surfactant (g) | 14 |
| | Hardener (p) | 185 |
| Transparent substrate A (63 $\mu$m) | | |

The second processing was carried out by the procedure comprising supplying 10 ml/m$^2$ of water to the processing layer (the first to fourth layers) of the second processing material P-2, putting together face to face the processing layer and the light-sensitive layer of each of the samples 101 to 104 which had undergone the first processing and thereafter heating the materials to 60° C. to keep them at that temperature for 30 seconds.

After the second processing, the samples were subjected to the transmission density measurement to obtain a so-called characteristic curve. The sensitivity was given by a relative value obtained by taking the reciprocal of the exposure amount corresponding to a density higher than fog density by 0.15 and regarding the reciprocal of Sample 101 as 100. The sensitivities of Samples 102 to 104 were expressed in a relative value based on the sensitivity of Sample 101. Then, in order to evaluate the fluctuation of density depending on the variation of the temperature within the light-sensitive material at the time of heat development, the change in density ΔDmin at a heat development temperature of 83° C. was examined at an exposure amount required to produce a density of 1 in a condition of 17 seconds at 78° C. Sensitivity, Dmin, change in density ΔDmin depending on the variation of the temperature and ununiformity by visual inspection of image in the region of intermediate density at processing the heat development at 80° C. were evaluated and shown in Table 5. In Table 5, X means "not acceptable", Δ means "acceptable" and ○ means "OK".

TABLE 5

| Sample | 101 | 102 | 103 | 104 |
|---|---|---|---|---|
| Sensitivity | 100 | 108 | 137 | 137 |
| Dmin | 0.15 | 0.14 | 0.15 | 0.12 |
| ΔDmin | 0.32 | 0.15 | 0.12 | 0.23 |
| Unuiformity of image | x | ○ | ○ | Δ |

It can be seen from the results of Table 5 that the ununiformity of the image corresponds to the change in density depending on the variation of the processing temperature at the heat development, and that the ununiformity of the image is reduced by use of a light-sensitive silver halide emulsion composed of tabular grains containing metal ions etc. which are a shallow electron trap, because a higher sensitivity is obtained and because the temperature dependence of the change in density at the heat development is reduced.

Example 2

A method for preparing an ultrafine silver chloride emulsion 2-(a) for epitaxial junction is given below. To sufficiently stirred aqueous solution of gelatin having the composition shown in Table 6 and a pH value of 4 were simultaneously added Liquid (I) and Liquid (II) of Table 7 over 3 minutes, and 5 minutes thereafter were simultaneously added Liquid (III) and Liquid (IV) of Table 7 over 5 minutes.

TABLE 6

| Composition of the aqueous solution of gelatin | |
|---|---|
| $H_2O$ | 650 cc |
| Lime-processed gelatin | 10 g |
| NaCl | 0.05 g |
| 1 N sulfuric acid | 4 cc |
| N,N'-dimethylimidazoline-2-dion | 0.001 g |
| Temperature | 3.5° C. |

TABLE 7

| | Liquid (I) | Liquid (II) | Liquid (III) | Liquid (IV) |
|---|---|---|---|---|
| $AgNO_3$ | 50 g | — | 50 g | — |
| NaCl | — | 17.8 g | — | 17.9 g |
| Total amount | made up to 244 ml with $H_2O$ | made up to 244 ml with $H_2O$ | made up to 150 ml with $H_2O$ | made up to 150 ml with $H_2O$ |

The reaction mixture was flocculated, rinsed and desalted in a conventional way (flocculant:"Demole" manufactured by Kao Corporation). Then, 22 g of lime-processed gelatin was added to the product, which was adjusted to pH: 6.1 and pAg: 7.1. After the adjustment, phenoxyethanol was added. The thus obtained ultrafine silver chloride emulsion 2-(a) for epitaxial junction was composed of cube shaped grains having an average length of side of 0.06 μm. The yield was 635 g.

(Preparation of a silver iodobromide emulsion 2-A (a comparative emulsion) composed of tabular grains having epitaxial junction)

A procedure for the tabular silver iodobromide emulsion 1-A was repeated, except that 10 minutes after the addition of sensitizing dyes for the chemical sensitization, 35 g of the ultrafine silver chloride emulsion 2-(a) for epitaxial junction was added to the emulsion. Then, to the resultant tabular silver iodobromide grain emulsion were added chloroauric acid, sodium thiosulfate and selenium sensitizer in respective adjusted amounts so that the sensitivity of the resultant tabular silver iodobromide emulsion at 1/10,000 second exposure became a maximum.

(Preparation of a silver iodobromide emulsion 2-B (a light-sensitive silver halide emulsion to be used in the present invention) composed of tabular grains having an epitaxial junction)

A procedure for the tabular silver iodobromide emulsion 1-B was repeated, except that 10 minutes after the addition of sensitizing dyes for the chemical sensitization, 35 g of the ultrafine silver chloride emulsion 2-(a) for epitaxial junction was added to the emulsion. Then, to the resultant tabular silver iodobromide grain emulsion were added chloroauric acid, sodium thiosulfate and selenium sensitizer in respective adjusted amounts so that the sensitivity of the resultant tabular silver iodobromide emulsion at 1/10,000 second exposure became a maximum.

(Preparation of a silver iodobromide emulsion 2-C (a light-sensitive silver halide emulsion to be used in the present invention) composed of tabular grains having epitaxial junction)

A procedure for the tabular silver iodobromide emulsion 1-C was repeated, except that 10 minutes after the addition of sensitizing dyes for the chemical sensitization, 35 g of the ultrafine silver chloride emulsion 2-(b) for epitaxial junction identical to the ultrafine silver chloride emulsion 2-(a) for epitaxial junction excepting that the ultrafine silver chloride emulsion 2-(b) for epitaxial junction contained tripotassium iridium hexachloride in an amount of $4.5\times10^{-7}$ mol based on iridium per mol of silver was added to the emulsion. Then, to the resultant tabular silver iodobromide grain emulsion were added chloroauric acid, sodium thiosulfate and selenium sensitizer in respective adjusted amounts so that the sensitivity of the resultant tabular silver iodobromide emulsion at 1/10,000 second exposure became a maximum.

(Preparation of a silver iodobromide emulsion 2-D (a light-sensitive silver halide emulsion to be used in the present invention) composed of tabular grains having an epitaxial junction)

A procedure for the tabular silver iodobromide emulsion 1-A was repeated, except that 10 minutes after the addition of sensitizing dyes for the chemical sensitization, 35 g of the ultrafine silver chloride emulsion 2-(b) for epitaxial junction was added to the emulsion. Then, to the resultant tabular silver iodobromide grain emulsion were added chloroauric acid, sodium thiosulfate and selenium sensitizer in respective adjusted amounts so that the sensitivity of the resultant tabular silver iodobromide emulsion at 1/10,000 second exposure became a maximum.

(Preparation of a silver iodobromide emulsion 2-E (a light-sensitive silver halide emulsion to be used in the present invention) composed of tabular grains having an epitaxial junction)

A procedure for the tabular silver iodobromide emulsion 1-A was repeated, except that 10 minutes after the addition of sensitizing dyes for the chemical sensitization, 35 g of the ultrafine silver chloride emulsion 2-(c) for epitaxial junction identical to the ultrafine silver chloride emulsion 2-(a) for epitaxial junction excepting that the ultrafine silver chloride emulsion 2-(c) for epitaxial junction contained potassium ferrocyanide in an amount of $1.5\times10^{-3}$ mol based on iron per mol of silver was added to the emulsion. Then, to the resultant tabular silver iodobromide grain emulsion were added chloroauric acid, sodium thiosulfate and selenium sensitizer in respective adjusted amounts so that the sensitivity of the resultant tabular silver iodobromide emulsion at 1/10,000 second exposure became a maximum.

The emulsions 2-A to 2-E were composed of grains each having a configuration in which a hexagonal tabular grain had fine grains attached to the corners thereof by means of an expitaxial junction. The average aspect ratio and average equivalent-sphere diameter of each of the emulsions 2-A to 2-E were nearly equal to those of the emulsion 1-A.

The procedure for the preparation of Sample 101 in Example 1 was repeated, except that the emulsion as used therein was replaced with the emulsions 2-A to 2-E, respectively, in Example 1, and, as a result, Samples 201 to 205 were prepared.

As in Example 1, the samples were processed, exposed and subjected to heat development. The results are shown in Table 8. In Table 8, the criteria for the ununiformity of image are the same as those in Table 5.

TABLE 8

| Sample | 101 | 201 | 202 | 203 | 204 | 205 |
|---|---|---|---|---|---|---|
| Sensitivity | 100 | 134 | 150 | 166 | 156 | 168 |
| Dmin | 0.15 | 0.17 | 0.16 | 0.16 | 0.17 | 0.18 |
| ΔDmin | 0.32 | 0.38 | 0.12 | 0.11 | 0.09 | 0.1 |
| Ununiformity of image | x | x | ○ | ○ | ○ | ○ |

It can be seen from the results of Table 8 that the epitaxial tabular grains have the problem that density variation of image depending on the fluctuation in temperature of heat development increases, although the sensitivity increases and that, if metal ions etc. which are a shallow electron trap are used, the stability to the temperature of heat development increases and the sensitivity further increases.

Example 3

(Preparation of silver chlorobromide (100) tabular grain emulsion 3-A (a comparative emulsion))

1,200 ml of gelatin aqueous solution having a pH value of 4.3, which comprised 25 g of ossein gelatin treated with an alkali dissolved in deionized water and having a methionine content of about 40 μmol/g, 1 g of sodium chloride and 4.5 ml of 1N nitric acid, was placed in a reactor, and thereafter the temperature of the solution was raised to 40° C. To this solution, which was vigorously stirred, there were added 36 ml of an aqueous solution (A) containing 20 g of silver nitrate per 100 ml and 36 ml of an aqueous solution (B) containing 0.71 g of potassium bromide and 6.67 g of sodium chloride per 100 ml simultaneously over a period of 45 seconds. After the completion of the addition, the reaction mixture was stirred for 3 minutes and was admixed with 43.4 ml of an aqueous solution (C) containing 1.1 g of potassium bromide per 100 ml over a period of 30 seconds. After the completion of the addition, the temperature of the reaction mixture was lowered to 30° C. in 3 minutes and was kept at that temperature. Then, 108 ml of the aqueous solution (A) and 108 ml of an aqueous solution (D) containing 7.02 g of sodium chloride per 100 ml were added to the reaction mixture simultaneously over a period of 2 minutes and 15 seconds. After the completion of the addition, the reaction mixture was stirred for 1 minute and was admixed with 20 ml of a 10% sodium chloride aqueous solution and 7 ml of 1N sodium hydroxide aqueous solution so that the reaction mixture had a pH value of 6.5 and a silver potential of 80 mV versus a saturated calomel electrode. After that, 2 ml of a hydrogen peroxide solution (35%) was added to the reaction mixture. The temperature of the reaction mixture was then raised to 75° C., and the reaction mixture was ripened for 5 minutes at 75° C.

Then, to the reaction mixture was added 1,086 g of an ultrafine silver chlorobromide emulsion 3-(a) acting as an epitaxial junction identical to the ultrafine silver chloride emulsion 2-(a) acting as an epitaxial junction except that the ultrafine silver chlorobromide emulsion 3-(a) acting as an epitaxial junction had a silver bromide content of 5 mol % and was added over a period of 45 minutes, while the silver potential of the reaction mixture was maintained at a level of 140 mV. The temperature was then lowered to 35° C., and desalting was performed in a conventional way.

In this way, a silver chlorobromide tabular grain emulsion 3-A was obtained which was composed of silver chlorobromide (100) tabular grains having an average grain size expressed in an average equivalent-sphere diameter of 0.92 μm, an average grain thickness of 0.128 μm, an average aspect ratio of 15.9, and a silver bromide content of 5 mol %.

The chemical sensitization of the silver chlorobromide tabular grain emulsion 3-A was performed as in the case of the tabular silver iodobromide grain emulsion 1-A, except that KI in an amount of $10^{-3}$ mol per mol of silver and a degradation product of ribonucleic acid were added to the emulsion after the addition of the sensitizing dyes.

The following tabular silver chlorobromide grain emulsions 3-B~3-E were prepared in the same way as in the case of the tabular silver chlorobromide grain emulsion 3-A but with the exceptions described below. The average grain aspect ratio and average equivalent-sphere diameter of each of the obtained tabular silver chlorobromide emulsions 3-B~3-E was the same as those of the tabular silver chlorobromide grain emulsion 1-A.

(silver chlorobromide (100) tabular grain emulsion 3-B (a light-sensitive silver halide emulsion of the present invention))

The procedure for the preparation of the tabular silver chlorobromide grain emulsion 3-A was repeated, except that an ultrafine silver chlorobromide emulsion 3-(b) identical to the emulsion 3-(a) excepting that the emulsion 3-(b) contained potassium ferrocyanide in an amount of $2\times10^{-4}$ mol based on iron per mol of silver was added to the emulsion. The thus obtained tabular silver chlorobromide grain emulsion 3-B was subjected to the same chemical sensitization as that for the emulsion 3-A.

(silver chlorobromide epitaxial (100) tabular grain emulsion 3-C (a comparative emulsion))

A procedure for the emulsion 3-A was repeated, except that 10 minutes after the addition of sensitizing dyes for the chemical sensitization, KI was not added, but 35 g of an emulsion 3-(c) identical to the emulsion 2-(a) excepting that the emulsion 3-(c) had a silver bromide content of 100 mol % was added to the emulsion. Then, to the resultant emulsion were added chloroauric acid, sodium thiosulfate and selenium sensitizer.

(silver chlorobromide epitaxial (100) tabular grain emulsion 3-D (a light-sensitive silver halide emulsion to be used in the present invention))

A procedure for the emulsion 3-B was repeated and the emulsion 3-D was prepared, except that 10 minutes after the addition of sensitizing dyes for the chemical sensitization, KI was not added, but 35 g of an emulsion 3-(c) identical to the emulsion 2-(b) except that the emulsion 3-(c) had a silver bromide content of 100 mol % was added to the emulsion. Then, to the resultant emulsion were added chloroauric acid, sodium thiosulfate and selenium sensitizer.

(silver chlorobromide epitaxial (100) tabular grain emulsion 3-E (a light-sensitive silver halide emulsion to be used in the present invention))

A procedure for the emulsion 3-A was repeated and the emulsion 3-E was prepared, except that 10 minutes after the addition of sensitizing dyes for the chemical sensitization, KI was not added, but 35 g of an emulsion 3-(d) identical to the emulsion 3-(c) except that the emulsion 3-(d) contained potassium ferrocyanide in an amount of $5\times10^{-4}$ mol substituted for iron was added to the emulsion. Then, to the resultant emulsion were added chloroauric acid, sodium thiosulfate and selenium sensitizer.

The emulsions 3-C, 3-D and 3-E were composed of grains each having a configuration in which a (100) rectangular tabular grain had fine grains attached to the corners thereof by means of expitaxial junction.

The procedure for the preparation of Sample 101 in Example 1 was repeated, except that the emulsion as used therein was replaced with the emulsions 3-A~3-E, respectively, in Sample 101, and the amount of the antfogging agent (c) was increased to 8 mg/m$^2$, and, as a result, Samples 301~305 were prepared.

As in Example 1, the samples were processed, exposed and subjected to heat development. The results are shown in Table 9. In Table 9, the sensitivities are relative values by regarding the sensitivity of Sample 301 as 100, and the criteria for the ununiformity of image in Table 9 are the same as those in Table 5.

TABLE 9

| Sample | 301 | 302 | 303 | 304 | 305 |
|---|---|---|---|---|---|
| Sensitivity | 100 | 128 | 138 | 177 | 181 |
| Dmin | 0.22 | 0.23 | 0.19 | 0.18 | 0.19 |
| ΔDmin | 0.46 | 0.15 | 0.51 | 0.13 | 0.12 |
| Ununiformity of image | x | ○ | x | ○ | ○ |

It can be seen from the results of Table 9 that the density variation of image depending on the fluctuation in temperature of heat development is significant also in the case of emulsions composed of tabular grains having a high silver chloride content, because the emulsions having a high silver chloride content exhibit a high activity. However, the incorporation of metal ions etc. as a shallow electron trap in the emulsion was clearly found to inhibit effectively the density variation of image depending on the fluctuation in temperature of heat development, while maintaining the high sensitivity of emulsions having a high silver chloride content. This effect is also significant in emulsions composed of grains having an epitaxial junction.

Meanwhile, an emulsion 3-F having a high content of silver chloride and composed of (111) tabular grains containing metal ions etc. as a shallow electron trap was used to prepare a light-sensitive material, which underwent the same heat development. The result was that the light-sensitive material exhibited excellent photographic properties without the formation of ununiformity of image.

The emulsion 3-F having a high silver chloride content and composed of (111) tabular grains was prepared in the following way. 1,200 ml of a gelatin aqueous solution containing 2.1 g of ossein gelatin treated with an alkali dissolved in deionized water and 2 g of sodium chloride was placed in a reactor and the solution was kept at 35° C. To this solution, which was vigorously stirred, there were added 1,100 ml of an aqueous solution (A) containing 165 g of silver nitrate and 1,100 ml of an aqueous solution (B) containing 59.1 g of sodium chloride by an increment of 60 ml of each solution simultaneously over a period of one minute. Meanwhile, 50 ml of an aqueous solution (C) containing 0.285 g of a compound (3) was prepared. One minute after the completion of the addition of the solutions (A) and (B), 40 ml of the solution (C) was added to the reaction mixture, and 30 ml of a 10% sodium chloride aqueous solution was also added to the reaction mixture one minute after the completion of the addition of the solution (C). After the completion of the addition, the temperature of the reaction mixture was raised to 60° C. in 25 minutes, and, 16 minutes later, 260 ml of a gelatin aqueous solution containing 29 g of phthalated gelatin was added to the reaction mixture, and a further 3 minutes later, 10 ml of the solution (C) was added to the reaction mixture. Next, one minute later, 768 ml of the aqueous solution (A) and 768 ml of the aqueous solution (B) were each added to the reaction mixture simultaneously at an initial rate of 2.85 ml/minute and at an acceleration of 0.818 ml/(minute)$^2$. 10 minutes before the completion of the addition of the solutions (A) and (B), the addition of a solution (D), i.e., a 270 ml aqueous solution containing 3.9 g of sodium chloride and 0.1 g of potassium ferrocyanide, started so that the addition of the solution (D) was complete in 10 minutes. Further, 2 minutes before the completion of the addition of the solutions (A) and (B), the addition of 34 ml of a 10% potassium bromide aqueous solution started so that the addition of this solution was complete in 3 seconds. 3 minutes after the completion of the addition of the solutions (A) and (B), 27 ml of a 1% potassium thiocyanate aqueous solution and 45 ml of a liquid, which comprised 100 g of gelatin and having dispersed therein 570 mg of a sensitizing dye I for green-sensitive emulsions, 60 mg of a sensitizing dye II for green-sensitive emulsions and 120 mg of a sensitizing dye III for green-sensitive emulsions, were added to the reaction mixture. One minute after the addition, the temperature of the reaction mixture was raised to 75° C., and this temperature was held for 10 minutes. The temperature of the reaction mixture was then lowered to 40° C., and the desalting of the reaction mixture was performed in a conventional way by use of a flocculant (1). Then, the reaction product was dispersed in 67 g of ossein gelatin, which was treated with an alkali dissolved in deionized water, blended with zinc nitrate and phenoxyethanol to obtain an emulsion, which was adjusted to pH: 6.3 and pAg: 7.7.

It was found that the obtained emulsion 3-F comprised grains made up of (111) tabular silver chlorobromide grains having an average grain size expressed in an equivalent-sphere diameter of 0.74 μm, an average aspect ratio of 8.7, and a silver bromide content of 5 mol %.

The emulsion 3-F was chemically sensitized at 60° C. to impart maximum sensitivity to the emulsion by the successive addition of a compound (4), 4-hydroxy-6-methyl-1,3, 3a, 7-tetraazaindene, sodium thiosulfate, a selenium sensitizer, chloroauric acid and sodium benzenethiosulfonate. The chemical sensitization was terminated by the addition of the compound (4).

Compound (3)

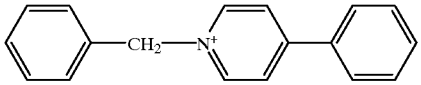

Flocculant (1)

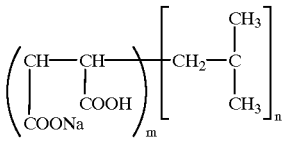

Compound (4)

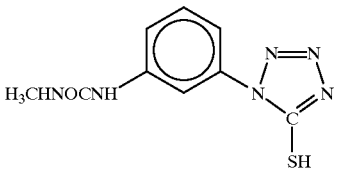

Example 4

(tabular silver iodobromide grain emulsion 4-A (a comparative emulsion))

A mixture of 0.74 g of gelatin having an average molecular weight of 12,000, 0.3 g of KBr and 930 ml of distilled water was placed in a reactor, and thereafter the temperature of the mixture was raised to 35° C. To this solution, which was vigorously stirred, there were added 30 ml of an aqueous solution (A) containing 1.2 g of $AgNO_3$ and 30 ml of an aqueous solution (B) containing 0.82 g of KBr over a period of 20 seconds. After the completion of the addition, the reaction mixture was kept at 40° C. for one minute, and thereafter the temperature of the reaction mixture was raised to 75° C. Then, 27.0 g of oxidation-treated gelatin together with 200 ml of distilled water were added to the reaction mixture. Further, 100 ml of an aqueous solution (C) containing 22.5 g of $AgNO_3$ and 80 ml of an aqueous solution (D) containing 15.43 g of KBr were added over a period of 11 minutes to the reaction mixture in such a manner that the flow rate of the addition was gradually increased. Next, 250 ml of an aqueous solution (E) containing 75.1 g of $AgNO_3$ and 210 ml of an aqueous solution (F) containing KI in a KI:KBr molar ratio of 3:97 (KBr concentration: 26%) were added to the reaction mixture in such a manner that the flow rate of the addition was gradually increased and that the silver potential of the reaction mixture was 0 mV versus a saturated calomel electrode. After the completion of the addition, the reaction mixture was kept at 75° C. for one minute, and thereafter the temperature of the reaction mixture was lowered to 55° C. Then, 120 ml of an aqueous solution (I) containing 8.1 g of $AgNO_3$ and 320 ml of an aqueous solution (J) containing 7.26 g of KI were added over a period of 5 minutes to the reaction mixture. After the completion of the addition, 5.5 g of KBr was added to the reaction mixture and the temperature of the reaction mixture was kept at 55° C. for 1 minute. Further, 180 ml of an aqueous solution (K) containing 44.3 g of $AgNO_3$ and 160 ml of an aqueous solution (L) containing 34.0 g of KBr were added over a period of 8 minutes to the reaction mixture. Then, the temperature of the solution was lowered and desalting was performed in a conventional way.

In this way, a tabular silver iodobromide emulsion 4-A was obtained in which the projected area of tabular grains exceeded 99% of the total projected area of all the grains and the tabular grains had an average equivalent-sphere diameter of 0.66 μm, an average grain thickness of 0.095 μm, an aspect ratio of 14.9 and an average equivalent-circle diameter of 1.4 μm.

(tabular silver iodobromide grain emulsion 4-B (a light-sensitive silver halide emulsion of the present invention))

The procedure for the preparation of the tabular silver iodobromide grain emulsion 4-A was repeated, except that the solution (K) contained potassium ferrocyanide in an amount of $8\times10^{-5}$ mol based on iron. The average aspect ratio and the average equivalent-sphere diameter of the obtained emulsion were the same as those of the emulsion 4-A.

(tabular silver iodobromide grain emulsion 4-C (a comparative emulsion))

A mixture of 12.5 g of gelatin having an average molecular weight of 15,000, 4.35 g of KBr, 0.32 g of KI and 950 ml of distilled water was placed in a reactor, and thereafter the temperature of the mixture was raised to 45° C. To this solution, which was vigorously stirred, there were added 50 ml of an aqueous solution (A) containing 8.3 g of $AgNO_3$ and 50 ml of an aqueous solution (B) containing 2.67 g of KBr over a period of 45 seconds. After the completion of the addition, the reaction mixture was kept at 45° C. for 4 minutes, and thereafter the temperature of the reaction mixture was raised to 63° C. Then, 17.0 g of gelatin together with 130 ml of distilled water were added to the reaction mixture. Further, 150 ml of an aqueous solution (C) containing 51.2 g of $AgNO_3$ and a 24.8% KBr aqueous solution (D) were added over a period of 13 minutes to the reaction mixture in such a manner that the flow rate of the addition was gradually increased and that the silver potential of the reaction mixture was 0 mV versus a saturated calomel electrode. After the completion of the addition, the reaction mixture was kept at 63° C. for two minutes, and thereafter the temperature of the reaction mixture was lowered to 45 ° C. Next, 50 ml of an aqueous solution (E) containing 5.9 g of $AgNO_3$ and 320 ml of an aqueous solution (F) containing 5.82 g of KI were added to the reaction mixture over a period of 5 minutes. Further, 350 ml of an aqueous solution (G) containing 104.3 g of $AgNO_3$ and a 25% KI aqueous solution (H) were added to the reaction mixture over a period of 45 minutes in such a manner that the silver potential of the reaction mixture was 10 mV versus a saturated calomel electrode. After the completion of the addition, 1.4 g of KI and 4 mg of sodium ethylthiosulfonate were added to the reaction mixture, which was kept at 45° C. for 5 minutes. The temperature of the reaction mixture was then lowered, and desalting was performed in a conventional way.

In this way, a tabular silver iodobromide emulsion 4-C was obtained which was composed of hexagonal tabular grains having an average equivalent-sphere diameter of 0.37 μm, and an average aspect ratio of 5.8.

(tabular silver iodobromide grain emulsion 4-D (a light-sensitive silver halide emulsion of the present invention))

The procedure for the preparation of the tabular silver iodobromide grain emulsion 4-A was repeated, except that the solution (H) contained potassium ferrocyanide in an amount of $8\times10^{-5}$ mol based on iron. The average aspect ratio and the average equivalent-sphere diameter of the obtained emulsion were nearly equal to those of the emulsion 4-C.

The chemical sensitization of these emulsions were performed in the same way as for the comparative emulsion 1-A. That is, to the resultant tabular silver iodobromide grain emulsion were added chloroauric acid, sodium thiosulfate and selenium sensitizer in respective adjusted amounts so that the sensitivity of the resultant tabular silver iodobromide emulsion at 1/10,000 second exposure became a maximum. The amounts of the dyes for spectral sensitization and the terminators of chemical sensitization were adjusted proportionally depending on the surface area of the grains of the emulsions.

The sensitization processes for the tabular silver iodobromide grain emulsions for comparison 1-A, 4-A and 4-C as well as for the tabular silver iodobromide grain emulsions for the present invention 1-C, 4-B and 4-Dwere repeated, except that the sensitizing dyes as used therein were changed to sensitizing dyes (a mixture of sensitizing dyes V to VII for red-sensitive emulsions) for red-sensitive emulsions, and thus emulsions 1-A(r), 4-A(r), 4-C(r), 1-C(r), 4-B(r) and 4-D(r) were prepared, respectively. Meanwhile, the sensitization processes for the tabular silver iodobromide grain emulsions for comparison 1-A, 4-A and 4-C as well as for the tabular silver iodobromide grain emulsions for the present invention 1-C, 4-B and 4-D were repeated, except that the sensitizing dyes as used therein were changed to a sensitizing dye (a sensitizing dye IV for blue-sensitive emulsions) for blue-sensitive emulsions, and thus 1-A(b), 4-A(b), 4-C(b), 1-C(b), 4-B(b) and 4-D(b) were prepared, respectively.

A multilayered light-sensitive material (Sample 401) shown in Tables 10 to 12 was prepared by using the emulsions 1-A, 4-A and 4-C for a high-sensitivity layer, a medium-sensitivity layer and a low-sensitivity layer, respectively, in a green-sensitive magenta-coloring layer, and by using the emulsions 1-A(r), 4-A(r) and 4-C(r) for a high-sensitivity layer, a medium-sensitivity layer and a low-sensitivity layer, respectively, in a red-sensitive cyan-coloring layer, and by using the emulsions 1-A(b), 4-A(b) and 4-C(b) for a high-sensitivity layer, a medium-sensitivity layer and a low-sensitivity layer, respectively, in a blue-sensitive yellow-coloring layer.

Although given in 3 separate tables, Tables 10 to 12 were originally one table including these tables in that order.

TABLE 10

| Layer configuration | Coating material | Coating weight (mg/m$^2$) |
|---|---|---|
| Protective layer | Lime-treated gelatin | 1000 |
| | Matting agent (silica) | 50 |
| | Surfactant (f) | 100 |
| | Surfactant (g) | 300 |
| | Water-soluble polymer (h) | 15 |
| | Hardener (l) | 98 |
| Intermediate layer | Lime-treated gelatin | 375 |
| | Surfactant (g) | 15 |
| | Zinc hydroxide | 1100 |
| | Water-soluble polymer (h) | 15 |

TABLE 10-continued

| Layer configuration | Coating material | Coating weight (mg/m$^2$) |
|---|---|---|
| Yellow dye forming layer (High-sensitivity layer) | Lime-treated gelatin | 150 |
| | Emulsion (based on amount of coated silver) | Emulsion 1-A (b) 647 |
| | Yellow coupler (u) | 57 |
| | Developing agent (v) | 41 |
| | Anti-fogging agent (w) | 4 |
| | Organic solvent having high boiling point (d) | 50 |
| | Surfactant (e) | 3 |
| | Water-soluble polymer (h) | 1 |
| Yellow dye forming layer (medium sensitivity layer) | Lime-treated gelatin | 220 |
| | Emulsion (based on amount of coated silver) | Emulsion 4-A (b) 475 |
| | Yellow coupler (u) | 84 |
| | Developing agent (v) | 60 |
| | Anti-fogging agent (w) | 6 |
| | Organic solvent having high boiling point (d) | 74 |
| | Surfactant (e) | 4 |
| | Water-soluble polymer (h) | 2 |
| Yellow dye forming layer (low sensitivity layer) | Lime-treated gelatin | 1400 |
| | Emulsion (based on amount of coated silver) | Emulsion 4-C (b) 604 |
| | Yellow coupler (u) | 532 |
| | Developing agent (v) | 382 |
| | Anti-fogging agent (w) | 40 |
| | Organic solvent having high boiling point (d) | 469 |
| | Surfactant (e) | 23 |
| | Water-soluble polymer (h) | 10 |

TABLE 11

| Layer configuration | Coating material | Coating weight (mg/m$^2$) |
|---|---|---|
| Intermediate layer | Lime-treated gelatin | 750 |
| | Surfactant (e) | 15 |
| | Leuco dye (x) | 303 |
| | Developer (y) | 433 |
| | Water-soluble polymer (h) | 15 |
| Magenta dye forming layer (high sensitivity layer) | Lime-treated gelatin | 150 |
| | Emulsion (based on amount of coated silver) | Emulsion 1-A 647 |
| | Magenta coupler (a) | 48 |
| | Developing agent (b) | 33 |
| | Anti-fogging agent (c) | 1.5 |
| | Organic solvent having high boiling point (d) | 50 |
| | Surfactant (e) | 3 |
| | Water-soluble polymer (h) | 1 |
| Magenta dye forming layer (medium sensitivity layer) | Lime-treated gelatin | 220 |
| | Emulsion (based on amount of coated silver) | emulsions 4-A 475 |
| | Magenta coupler (a) | 70 |
| | Developing agent (b) | 49 |
| | Anti-fogging agent (c) | 2.5 |
| | Organic solvent having high boiling point (d) | 74 |
| | Surfactant (e) | 4 |
| | Water-soluble polymer (h) | 2 |
| Magenta dye forming layer (low sensitivity layer) | Lime-treated gelatin | 1400 |
| | Emulsion (based on amount of coated silver) | Emulsion 4-C 604 |
| | Magenta coupler (a) | 446 |
| | Developing agent (b) | 311 |
| | Anti-fogging agent (c) | 3.5 |
| | Organic solvent having high boiling point (d) | 469 |
| | Surfactant (e) | 23 |
| | Water-soluble polymer (h) | 10 |

TABLE 12

| Layer configuration | Coating material | Coating weight (mg/m$^2$) |
|---|---|---|
| Intermediate layer | Lime-treated gelatin | 900 |
| | Surfactant (e) | 15 |
| | Leuco dye (z) | 345 |
| | Developer (y) | 636 |
| | Zinc hydroxide | 1100 |
| | Water-soluble polymer (h) | 15 |
| Cyan dye forming layer (high sensitivity layer) | Lime-treated gelatin | 150 |
| | Emulsion (based on amount of coated silver) | Emulsion 1-A (r) 647 |
| | Cyan coupler (aa) | 65 |
| | Developing agent (b) | 33 |
| | Anti-fogging agent (c) | 2.0 |
| | Organic solvent having high boiling point (d) | 50 |
| | Surfactant (e) | |
| | Water-soluble polymer (h) | 3 |
| | | 1 |
| Cyan dye forming layer (medium sensitivity layer) | Lime-treated gelatin | 220 |
| | Emulsion (based on amount of coated silver) | Emulsion 4-A (r) 475 |
| | Cyan coupler (aa) | 96 |
| | Developing agent (b) | 49 |
| | Anti-fogging agent (c) | 3.0 |
| | Organic solvent having high boiling point (d) | 74 |
| | Surfactant (e) | |
| | Water-soluble polymer (h) | 4 |
| | | 2 |
| Cyan dye forming layer (low sensitivity layer) | Lime-treated gelatin | 1400 |
| | Emulsion (based on amount of coated silver) | Emulsion 4-C (r) 604 |
| | Cyan coupler (aa) | 610 |
| | Developing agent (b) | 311 |
| | Anti-fogging agent (c) | 4.0 |
| | Organic solvent having high boiling point (d) | 469 |
| | Surfactant (e) | |
| | Water-soluble polymer (h) | 23 |
| | | 10 |
| Anti-halation coating | Lime-treated gelatin | 750 |
| | Surfactant (e) | 15 |
| | Leuco dye (ab) | 243 |
| | Developer (y) | 425 |
| | Water-soluble polymer (h) | 15 |
| Transparent PET base (120 μm) | | |

sensitizing dye IV for blue-sensitive emulsion

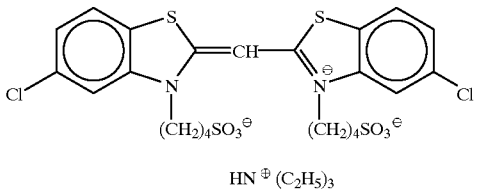

sensitizing dye V for red-sensitive emulsion

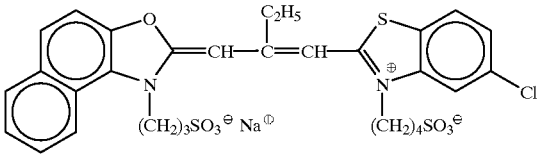

sensitizing dye VI for red-sensitive emulsion

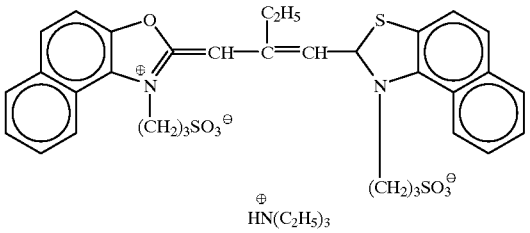

sensitizing dye VII for red-sensitive emulsion

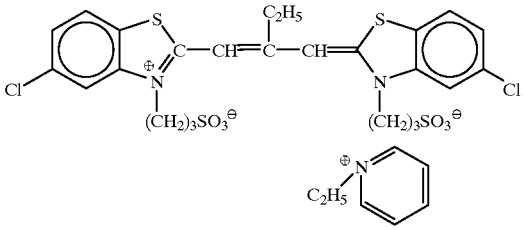

mixture in mole ratio of V:VI:VII=40:2:58 yellow coupler (u)

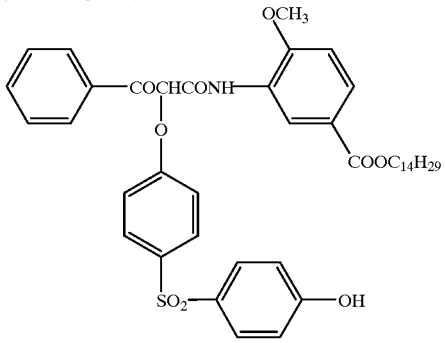

developing agent (v)

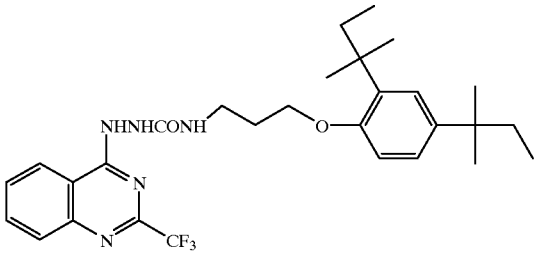

anti-fogging agent (w)

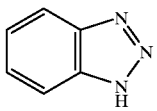

-continued cyan coupler (aa)

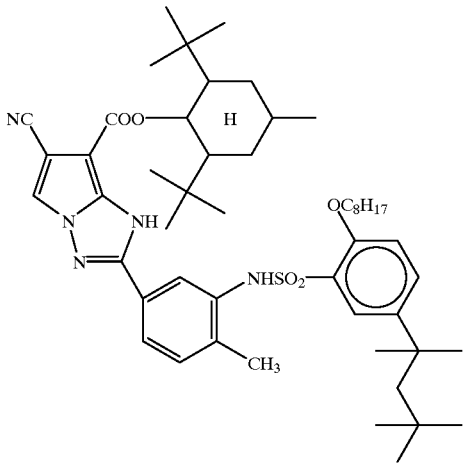

leuco dye (ab)

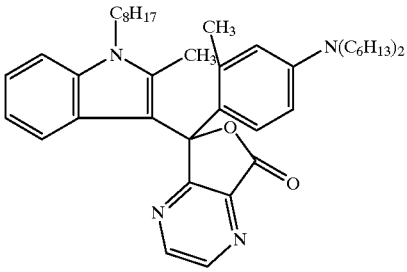

leuco dye (x)

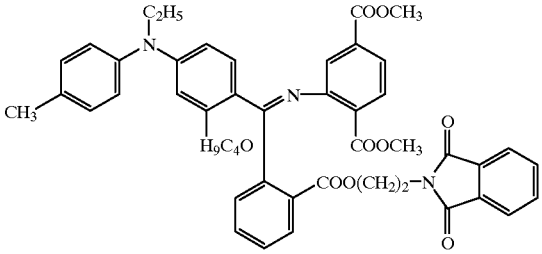

developer (y)

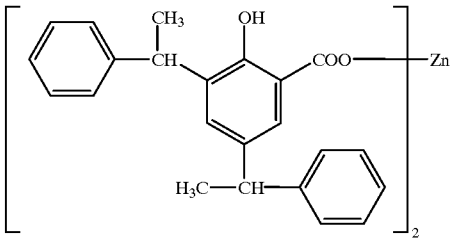

leuco dye (z)

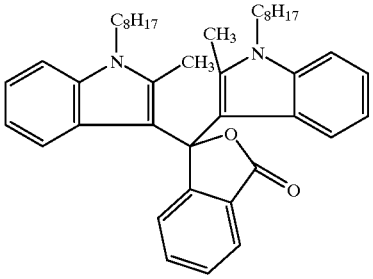

A multicolor silver halide color photographic light-sensitive material (Sample 402) of the present invention was prepared by repeating the procedure for Sample 401, except that the emulsions as used therein were changed as shown below in Sample 401. That is, in the formulation of Sample 401, emulsions 1-A, 4-A and 4-C were changed to emulsions 1-C, 4-B and 4-D, respectively, and the emulsions 1-C, 4-B and 4-D were used for a high-sensitivity layer, a medium-sensitivity layer and a low-sensitivity layer, respectively, in a green-sensitive magenta-coloring layer, the emulsions 1-C(r), 4-B(r) and 4-D(r) were used for a high-sensitivity layer, a medium-sensitivity layer and a low-sensitivity layer, respectively, in a red-sensitive cyan-coloring layer, and the emulsions 1-C(b), 4-B(b) and 4-D(b) were used for a high-sensitivity layer, a medium-sensitivity layer and a low-sensitivity layer, respectively, in a blue-sensitive yellow-coloring layer.

Meanwhile, according to the method for preparing dispersions of couplers as shown in Example 1, a cyan coupler dispersion and a yellow coupler dispersion were prepared. In addition, for the purpose of preparing a color layer capable of losing color at a hot developing process, a colorant dispersion was also prepared by use of a combination of the yellow, magenta and cyan leuco dyes with a zinc complex.

The photographic characteristics of Sample 402 were examined in the same way as in Example 1, except that the filter at the time of exposure was removed.

Sample 402 was exposed to the light for 1/10,000 second by means of "Sensitometer MARKVII" manufactured by EGG Corporation via an optical wedge. After the exposure, heat development was carried out by the procedure comprising supplying 20 ml/m$^2$ of warm water at 40° C. to the light-sensitive layer of Sample 402, putting together the light-sensitive layer and the processing layer of a first processing material P-3 face to face and thereafter heating the materials to 83° C. to keep them at that temperature for 30 seconds by use of a heat drum. Then, Sample 402 was removed from the processing material P-3, and Sample 402 was subjected to a second processing operation by use of a second processing material P-2. The second processing was carried out by the procedure comprising supplying 15 ml/m$^2$ of water to the processing layer of the second processing material P-2, putting together the processing layer and the light-sensitive layer of Sample 402 which had undergone the first processing face to face and thereafter heating the materials to 60° C. to keep them at that temperature for 30 seconds by use of a heat drum. The image of Sample 402 after the above-described processing was subjected to the transmission density measurement of yellow, magenta and cyan wedge images by use of blue, green and red filters to obtain a so-called characteristic curve. Besides, the processing material P-3 was the same as the processing material P-1 in Example 1, except that the amount of guanidine picolinate was changed to 4,500 mg/m$^2$.

As in Example 1, the sensitivity was given by a relative value obtained by taking the reciprocal of the exposure amount corresponding to a density higher than fog density by 0.15 and regarding the reciprocal of Sample 401 as 100. The sensitivities of Sample 402 were expressed in a relative value based on the sensitivities of Sample 401. The results are shown in Table 13.

TABLE 13

| | Sample 401 | | | Sample 402 | | |
|---|---|---|---|---|---|---|
| | B | G | R | B | G | R |
| Sensitivity | 100 | 100 | 100 | 142 | 149 | 139 |
| Dmin | 0.23 | 0.15 | 0.18 | 0.22 | 0.14 | 0.19 |

As is apparent from Table 13, the effect of the present invention characterized by a high sensitivity and very slight ununiformity of image is recognized also in a multilayered, multicolored silver halide color photographic light sensitive material (Sample 402) as in Example 1.

Example 5

A multilayered light-sensitive material (Sample 501) was prepared by repeating the procedure for Sample 401, except that a medium-sensitivity layer and a low-sensitivity layer as used therein were removed from the blue-sensitive yellow-coloring layer, the green-sensitive magenta-coloring layer and the red-sensitive cyan-coloring layer; the emulsion 3-A was used for the high-sensitivity layer of the green-sensitive magenta-coloring layer; the emulsion 3-A(r), identical to the emulsion 3-A excepting that a sensitizing dye for a red-sensitive emulsion was used in the emulsion 3-A(r), was used for the high-sensitivity layer of the red-sensitive cyan-coloring layer; and the emulsion 3-A(b), identical to the emulsion 3-A excepting that a sensitizing dye for a blue-sensitive emulsion was used in the emulsion 3-A(b), was used for the high-sensitivity layer of the blue-sensitive yellow-coloring layer.

Next, a silver halide color photographic light-sensitive material (Sample 502) of the present invention was prepared by repeating the procedure of Example 3, except that use was made of the emulsion 3-D(r) identical to the emulsion 3-D except that a sensitizing dye for a red-sensitive emulsion was used in the emulsion 3-D(r), the emulsion 3-D(b) identical to the emulsion 3-D except that a sensitizing dye for a blue-sensitive emulsion was used in the emulsion 3-D(b), and the emulsion 3-D.

These samples were processed as in Example 4. As a result, the silver halide color photographic light sensitive material (Sample 502) of the present invention exhibited the effect of the present invention characterized by high sensitivity and very slight ununiformity of image. On the other hand, the light-sensitive material (Sample 501) did not exhibit the above-mentioned effect of the present invention.

Example 6

A sample was prepared by repeating the procedure for preparing the multilayered sample 402 in Example 4, except that the substrate (transparent PET base) as used therein was replaced with a substrate prepared in the following way, and the prepared sample was loaded into a cartridge. In the examination of the sample conducted in the same way as in Example 4, the sample provided excellent results as in the case of Sample 402, thus confirming the effect of the present invention characterized by a high sensitivity and very slight ununiformity of image in a light-sensitive material system containing a developing agent by using a metal ion and/or metal complex ion which are a shallow electron trap.

The substrate used in Example 2 was prepared by the method described below.

A PEN film having a thickness of 90 $\mu$m was obtained by the procedure comprising drying 100 parts by weight of a polyethylene 2,6-naphthalate polymer and 2 parts by weight of Tinuvin P.326 (from Ciba-Geigy Co., Ltd.) as an ultraviolet ray absorber, melting them at 300° C., and extruding through a T-shaped die, stretching the extrudate 3.3 times the original length in the machine direction at 140° C., stretching the extrudate 3.3 times the original length in the transverse direction at 130° C. and thermally fixing the stretched film at 250° C. for 6 seconds. Prior to the preparation. An appropriate amount of a blue dye, a magenta dye and a yellow dye (I-1, I-4, I-6, I-24, I-26, I-27 and II-5 described in JIII Journal of Technical Disclosure No. 94-6,023) had been added to the PEN film, respectively. The PEN film was wound on a stainless steel core having a diameter of 20 cm and given a thermal hysteresis at 110° C. for 48 hours to produce a low-curling substrate.

Both sides of the substrate underwent a sequence of processes comprising a corona discharge process, a UV irradiation and a glow discharge process. Then, a substratum was formed on both sides by the application of a substratum forming solution comprising the following materials: gelatin: 0.1 g/m$^2$, sodium $\alpha$-sulfo-di-2-ethylhexyl succinate: 0.01 g/m$^2$, salicylic acid: 0.04 g/m$^2$, p-chlorophenol: 0.2 g/m$^2$, $(CH_2{=}CHSO_2CH_2CH_2NHCO)_2CH_2$: 0.012 g/m$^2$, and a polyamide/epichlorohydrin polycondensation product: 0.02 g/m$^2$ (by use of a 10 cc/m$^2$ bar coater). After the application thereof, the substratum was dried at 115° C. for 6 minutes (all transportation devices including rollers in the drying zone were kept at 115° C.).

One side of the substrate coated with the above-described substratum, was coated with an anti-static layer, a transparent magnetic recording layer and a slicking layer, successively as back layers, and having the following compositions. Application of an anti-static layer An anti-static layer was formed by the application of a solution comprising the following materials: a dispersion of fine grains (having an average grain diameter of secondary grains: 0.08 $\mu$m) made up of a tin-oxide/antimony-oxide complex oxide having an average grain diameter of 0.005 $\mu$m and a resistivity of 5 $\Omega$·cm: 0.2 g/m$^2$, gelatin: 0.05 g/m$^2$, $(CH_2{=}CHSO_2CH_2CH_2NHCO)_2CH_2$: 0.02 g/m$^2$, a polyoxyethylene-p-nonylphenol (degree of polymerization: 10): 0.005 g/m$^2$ and resorcinol. Application of a transparent magnetic recording layer.

A magnetic recording layer having a thickness of 1.2 $\mu$m was formed by coating the substrate with cobalt/$\gamma$-iron oxide grains coated with 3-polyoxyethylene-propyloxytrimethoxysilane (degree of polymerization: 15) (15 weight percent), having a specific surface area of 43 m$^2$/g, a major axis of 0.14 $\mu$m, a minor axis of 0.03 $\mu$m, a saturation magnetization of 89 emu/g, $Fe^{+2}/Fe^{+3}$=6/94 and surface-coated with aluminum oxide/silicon oxide in an amount corresponding to 2 weight percent of the iron oxide: 0.06 g/m$^2$, utilizing diacetylcellulose: 1.2 g/m$^2$ (the dispersion of the iron oxide was carried out by means of an open kneader and a sand mill), $C_2H_5C(CH_2CONH{-}C_6H_3(CH_3)NCO)_3$: 0.3 g/m$^2$ as a hardener together with acetone, methyl ethyl ketone and dibutyl phthalate as solvents, by use of a bar coater. The following were added to the magnetic recording layer: a slicking agent, i.e., $C_6H_{13}CH(OH)C_{10}H_{20}COOC_{40}H_{81}$: 50 mg/m$^2$ a matting agent, i.e., silica grains (1.0 $\mu$m): 50 mg/m$^2$ and an abrasive, i.e., aluminum oxide grains (0.2 $\mu$m and 1.0 $\mu$m) coated with 3-polyoxyethylene-propyloxytrimethoxysilane (degree of polymerization: 15) (15 weight percent):10 mg/m$^2$. After the application thereof, the magnetic recording layer was dried at 115° C. for 6 minutes (all transportation devices including rollers in the drying zone were kept at 115° C.). The magneric recording layer exhibited a color density $D^B$ increment under X-light (blue filter) of about 0.1, a saturation magnetization moment of 4.2 emu/g, a coercive force of $7.3\times10^4$ A/m and a polygonal rate of 65%. Application of a slicking layer.

The substrate was coated with hydroxy ethyl cellulose (25 mg/m$^2$) together with a mixture of $C_6H_{13}CH(OH)C_{10}H_{20}COOC_{40}H_{81}$ (6 mg/m$^2$) and silicone oil BYK-310 (Available from Bic Chemie Japan Co., Ltd.: 1.5 mg/m$^2$). This coating composition was prepared in the following way: melting the above-mentioned mixture in a blend of xylene/propylene glycol monomethyl ether (1/1) at 105° C., emulsifying the product in propylene glycol monomethyl ether (in an amount 10 times that of the mixture) at room temperature, dispersing the resultant emulsion in acetone to prepare a dispersion (having an average grain diameter of 0.01 μm), and adding the dispersion to the hydroxy ethyll cellulose. After the application thereof, the slicking layer was dried at 115° C. for 6 minutes (all transportation devices including rollers in the drying zone were kept at 115° C.) The slicking layer exhibited excellent properties characterized by a coefficient of dynamic friction of 0.10 (utilizing a stainless steel hard ball having a diameter of 5 mm and a load of 100 g at a speed of 6 cm/minute), a coefficient of static friction of 0.08 (clip method) and a coefficient of dynamic friction against an emulsion-coated surface of 0.15, thereby obtaining excellent characteristics.

Example 7

(1) Preparation of Emulsion (tabular silver iodobromide grain emulsion 1-E (a comparative emulsion))

The pH of 1,000 ml of an aqueous solution containing 0.5 g of oxidation-treated gelatin and 0.37 g of KBr was adjusted to 2 by the addition of $H_2SO_4$, and the reaction mixture was stirred at 40° C. To the reaction mixture were simultaneously added 20 ml of a 0.3 M $AgNO_3$ aqueous solution (A) and 20 ml of a 0.3M KBr aqueous solution (B) in 40 seconds by means of a double jet. Then, after the pH value of the reaction mixture was adjusted to 5.0 by the addition of NaOH and the pAg value was adjusted to 9.9 by the addition of a KBr solution, the temperature of the reaction mixture was raised to 75° C. in 35 minutes. At this temperature, after the addition of 35 g of oxidation-treated gelatin, 512 ml of a 1.2M $AgNO_3$ aqueous solution (C) and 440 ml of a 1.4M KBr aqueous solution (D) were added in 33 minutes by accelerating the flow rate (final flow rate is 5.2 times the initial flow rate) while keeping pAg at 8.58.

The reaction mixture was cooled down to 55° C., and 104 ml of a 0.4M $AgNO_3$ aqueous solution (E) and 279 ml of a 0.12M KI aqueous solution (F) were added in 5 minutes at a constant flow rate to the reaction mixture. Then, after the pAg value was adjusted to 8.8 by the addition of a KBr aqueous solution, 110 ml of a 1.8M $AgNO_3$ aqueous solution (C) and 125 ml of a 1.8 M KBr aqueous solution (H) were added to the reaction mixture.

The temperature of the reaction mixture was then lowered to 35° C., and thereafter the reaction mixture was flocculated in a conventional way by use of a flocculant ("Demole" manufactured by Kao Corporation). After a water washing stage, 75 g of gelatin and 10 ml of phenoxyethanol were added to the flocculation product, which was adjusted to pH: 5.5 and pAg: 8.2.

In this way, an emulsion was obtained in which the projected area of tabular grains exceeded 99% of the total projected area of all the grains and the tabular grains were made up of hexagonal tabular grains having an aspect ratio of 29, an average equivalent-sphere diameter of 0.65 μm, an average grain thickness of 0.06 μm and an average equivalent-circle diameter of 1.75 μm.

The above-mentioned values of average grain thickness and average equivalent-circle diameter were obtained from photographs by means of a replica method utilizing a transmission electron microscope.

The following tabular silver iodobromide grain emulsions 1-F~1-H were prepared in the same way as in the case of the tabular silver iodobromide grain emulsion 1-E but with the exceptions described below. The average grain aspect ratio and average equivalent-sphere diameter of the obtained tabular silver iodobromide grain emulsions 1-F~1-H were nearly equal to those of the iodobromide grain emulsions 1-E.

(tabular silver iodobromide grain emulsion 1-F (a comparative emulsion))

The procedure for the preparation of the tabular silver iodobromide grain emulsion 1-E was repeated, except that the solution (D) contained tripotassium iridium hexachloride in an amount of $2\times10^{-8}$ mol based on iridium.

(tabular silver iodobromide grain emulsion 1-G (a comparative emulsion)

The procedure for the preparation of the tabular silver iodobromide grain emulsion 1-E was repeated, except that the solution (H) contained potassium ferrocyanide in an amount of $8\times10^{-5}$ mol based on iron.

(tabular silver iodobromide grain emulsion 1-H (a light-sensitive silver halide emulsion of the present invention))

The procedure for the preparation of the tabular silver iodobromide grain emulsion 1-E was repeated, except that the solution (D) contained tripotassium iridium hexachloride in an amount of $2\times10^{-8}$ mol based on iridium and the solution (H) contained potassium ferrocyanide in an amount of $8\times10^{-5}$ mol based on iron.

(2) Chemical Sensitization

The procedure of the chemical sensitization of Example 1 was repeated, except that the molar ratio therein used of dyes for spectral sensitization (sensitizing dyes I to III for green-sensitive emulsions) was changed to 28:7:1. Besides, in the case of the tabular silver iodobromide grain emulsions 1-G and 1-H, zinc nitrate was added to the emulsions at the dispersion stage of gelatin after the water-washing operation.

Light-sensitive materials (Samples 601 to 603) and the silver halide color photographic light-sensitive material of the present invention (Sample 604) were prepared by replacing "1-A" in Table 1 with "1-E", "1-F", "1-G" and "1-H", respectively. An anti-fogging agent (c) was added when a coating liquid for a magenta coloring layer was prepared.

Light-sensitive materials (Samples 601A to 604A) were prepared by repeating the procedure for preparing Samples 601 to 604, except that the developing agent was not added to the emulsions (Samples 601A to 604A did not contain the developing agent).

The samples 601 to 604 were exposed to the light of 1,000 lux for 1/100 second via an optical wedge and a green filter.

After the exposure, a heat development was carried out by the procedure comprising supplying 15 ml/m$^2$ of warm water at 40° C. to the light-sensitive layer (magenta coloring layer, intermediate layer and protective layer) of each of the samples, putting together the light-sensitive layer of each of the samples and the processing layer (the first to fourth layers) of a processing material P-1 face to face and thereafter heating the materials to 80° C. to keep them at that temperature for 17 seconds by use of a heat drum. A magenta wedge-shaped image was obtained in the samples when the samples were removed from the processing material P-1 after the first processing of the above-described procedure.

The samples 601 to 604 were then subjected to a second processing by use of a second processing material P-2 as in Example 1.

After the second processing, the samples were subjected to the transmission density measurement to obtain a so-called characteristic curve. The sensitivity was given by a relative value obtained by taking the reciprocal of the exposure amount corresponding to a density higher than fog density by 0.15 and regarding the reciprocal of Sample 601 as 100. The sensitivities of Samples 602 to 604 were expressed as a relative value based on the sensitivity of Sample 601. Besides, the samples were stored in an accelerated storing condition (5 days at 60° C. and 40% relative humidity), and were then exposed and processed as described above. The sensitivity Dmin immediately after the coating and the increase ΔDmin in Dmin after the accelerated storage test are shown in Table 14.

TABLE 14

| Sample | 601 | 602 | 603 | 604 |
|---|---|---|---|---|
| Sensitivity | 100 | 81 | 127 | 148 |
| Dmin | 0.15 | 0.14 | 0.15 | 0.14 |
| ΔDmin | 0.32 | 0.08 | 0.38 | 0.08 |

As to the light-sensitive materials (Samples 601A to 604A) which did not contain the developing agent, the samples immediately after the coating and the samples after the accelerated storage test were exposed as described above and thereafter processed by means of a conventional processing bath containing a developing agent (processing agent CN-16 for color negative film) at 38° C. for 165 seconds.

The results are shown in Table 15.

TABLE 15

| Sample | 601A | 602A | 603A | 604A |
|---|---|---|---|---|
| Sensitivity | 92 | 77 | 111 | 128 |
| Dmin | 0.1 | 0.1 | 0.11 | 0.1 |
| ΔDmin | 0.05 | 0.03 | 0.07 | 0.04 |

It can be seen from the results of Table 14 that a higher sensitivity and stability can be obtained and the increase with time of the fogging in particular can be inhibited in the case of the silver halide color photographic light-sensitive material (Sample 604) of the present invention in which a light-sensitive silver halide emulsion is used which is composed of tabular grains containing a metal ion and/or a metal complex ion which are each a shallow electron trap in combination with a metal ion and/or a metal complex ion which are each a relatively deep electron trap and in which developing process is performed by means of a developing agent contained in the light-sensitive material.

It can be seen from the results of Table 15 that the light-sensitive materials (Samples 601A to 604A) which do not contain the developing agent generally exhibit poorer results relative to the light-sensitive materials containing the developing agent. Particularly, although the fogging during storage of Sample 604A is reduced owing to the effect of the light-sensitive silver halide emulsion in the present invention, Sample 604A cannot provide the dramatic and excellent effect of the silver halide color photographic light-sensitive material (Sample 604) containing the developing agent.

Also, as in the case of Samples 601A to 604A, the silver halide color photographic light-sensitive materials (Samples 601 to 604) containing the developing agent were tested. That is, the samples immediately after the coating and the samples after the accelerated storage test were exposed as described above and thereafter processed by means of a conventional processing bath containing a developing agent (processing agent CN-16 for color negative film) at 38° C. for 165 seconds.

The results of the above-described process by means of a bath were nearly the same as those of a heat development of the silver halide color photographic light-sensitive material containing the developing agent, except that the process by means of a bath provided an absolute value of ΔDmin which was lower by about ⅔ two thirds than the case of the heat development. The change in sensitivity after the above-mentioned accelerated storage of Samples 601 to 604 and Samples 601A to 604A were insignificant.

As stated above, the single use of a metal ion and/or a metal complex ion which are each a shallow electron trap leads to the increase in Dmin after the accelerated storage despite the increase in the sensitivity (see Sample 603). On the other hand, the single use of a metal ion and/or a metal complex ion which are each a deep electron trap inhibits the increase in Dmin after the accelerated storage, but a high sensitivity cannot be obtained (see Sample 602). It can be seen, however, from the results (Sample 604) that the increases Dmin due to the developing agent contained in the light-sensitive material after the accelerated storage can be effectively prevented by the light-sensitive silver halide emulsion of the present invention in which the light-sensitive silver halide emulsion is composed of tabular grains containing a metal ion and/or a metal complex ion which are each a shallow electron trap in combination with a metal ion and/or a metal complex ion which are each a relatively deep electron trap.

Example 8

A method for preparing an ultrafine silver chloride emulsion 4-(a) for epitaxial junction is given below. To a sufficiently stirred aqueous solution of gelatin having the composition shown in Table 6 and a pH value of 4 were simultaneously added Liquid (I) and Liquid (II) of Table 7 in 3 minutes, and 5 minutes thereafter were simultaneously added Liquid (III) and Liquid (IV) of Table 7 in 5 minutes.

The reaction mixture was flocculated, water-washed and desalted in a conventional way (by use of a flocculant (1) and pH: 3 adjusted by sulfuric acid). Then, 22 g of lime-processed gelatin was added to the product, which was adjusted to pH: 6.1 and pAg: 7.1. After the adjustment, phenoxyethanol was added. The thus obtained ultrafine silver chloride emulsion 4-(a) for epitaxial junction was composed of cubic grains having an average length of side of 0.06 μm. The yield was 635 g.

(Preparation of a silver iodobromide emulsion 2-F (a comparative emulsion) composed of tabular grains having an epitaxial junction)

A procedure for the tabular silver iodobromide emulsion 1-E was repeated, except that 10 minutes after the addition of sensitizing dyes for the chemical sensitization, 35 g of the ultrafine silver halide emulsion 4-(a) for epitaxial junction was added to the emulsion. Then, to the resultant tabular silver iodobromide grain emulsion were added chloroauric acid, sodium thiosulfate and selenium sensitizer in respective adjusted amounts so that the sensitivity of the resultant tabular silver iodobromide emulsion at 1/100 second exposure became a maximum.

(Preparation of a silver iodobromide emulsion 2-G (a light-sensitive silver halide emulsion to be used in the present invention) composed of tabular grains having an epitaxial junction)

A procedure for the tabular silver iodobromide emulsion 1-H was repeated, except that 10 minutes after the addition of sensitizing dyes for the chemical sensitization, 35 g of the ultrafine silver halide emulsion 4-(a) for epitaxial junction was added to the emulsion. Then, to the resultant tabular silver iodobromide grain emulsion were added chloroauric acid, sodium thiosulfate and selenium sensitizer in respective adjusted amounts so that the sensitivity of the resultant tabular silver iodobromide emulsion at 1/100 second exposure became a maximum.

(Preparation of a silver iodobromide emulsion 2-H (a light-sensitive silver halide emulsion to be used in the present invention) composed of tabular grains having an epitaxial junction)

A procedure for the tabular silver iodobromide emulsion 1-G was repeated except that 10 minutes after the addition of sensitizing dyes for the chemical sensitization, 35 g of the ultrafine silver halide emulsion 4-(b) for epitaxial junction, identical to the ultrafine silver halide emulsion 4-(a) for epitaxial junction excepting that the ultrafine silver halide emulsion 4-(b) for epitaxial junction contained tripotassium iridium hexachloride in an amount of $3.92\times10^{-7}$ mol based on iridium per mol of silver, was added to the emulsion. Then, to the resultant tabular silver iodobromide grain emulsion were added chloroauric acid, sodium thiosulfate and selenium sensitizer in respective adjusted amounts so that the sensitivity of the resultant tabular silver iodobromide emulsion at 1/100 second exposure became a maximum.

(Preparation of a silver iodobromide emulsion 2-I (a light-sensitive silver halide emulsion to be used in the present invention) composed of tabular grains having epitaxial junction)

A procedure for the tabular silver iodobromide emulsion 1-F was repeated, except that 10 minutes after the addition of sensitizing dyes for the chemical sensitization, 35 g of the ultrafine silver halide emulsion 4-(c) for epitaxial junction, identical to the ultrafine silver halide emulsion 4-(a) for epitaxial junction except that the ultrafine silver halide emulsion 4-(c) for epitaxial junction contained potassium ferrocyanide in an amount of $1.5\times10^{-3}$ mol based on iron per mol of silver, was added to the emulsion. Then, to the resultant tabular silver iodobromide grain emulsion were added chloroauric acid, sodium thiosulfate and selenium sensitizer in respective adjusted amounts so that the sensitivity of the resultant tabular silver iodobromide emulsion at 1/100 second exposure became a maximum.

(Preparation of a silver iodobromide emulsion 2-J (a light-sensitive silver halide emulsion to be used in the present invention) composed of tabular grains having epitaxial junction)

A procedure for the tabular silver iodobromide emulsion 1-E was repeated, except that 10 minutes after the addition of sensitizing dyes for the chemical sensitization, 35 g of the ultrafine silver halide emulsion 4-(d) for epitaxial junction, identical to the ultrafine silver halide emulsion 4-(a) for epitaxial junction except that the ultrafine silver halide emulsion 4-(d) for epitaxial junction contained potassium ferrocyanide in an amount of $1.5\times10^{-3}$ mol based on iron per mol of silver and tripotassium iridium hexachloride in an amount of $3.92\times10^{-7}$ mol based on iridium per mol of silver, was added to the emulsion. Then, to the resultant tabular silver iodobromide grain emulsion were added chloroauric acid, sodium thiosulfate and selenium sensitizer in respective adjusted amounts so that the sensitivity of the resultant tabular silver iodobromide emulsion at 1/100 second exposure became a maximum.

The emulsions 2-F to 2-J were composed of grains each having a configuration in which a hexagonal tabular grain had fine grains attached to the corners thereof by means of an expitaxial junction. The average aspect ratio and average equivalent-sphere diameter of each of the emulsions 2-F to 2-J were nearly equal to those of the emulsion 1-E.

The procedure for the preparation of Sample 601 in Example 7 was repeated, except that the emulsion as used therein was replaced with the emulsions 2-F to 2-J, respectively, in Example 7, and, as a result, Samples 701 to 705 were prepared.

As in Example 7, the samples were processed, exposed and subjected to heat development. The results are shown in Table 16.

TABLE 16

| Sample | 601 | 701 | 702 | 703 | 704 | 705 |
|---|---|---|---|---|---|---|
| Sensitivity | 100 | 134 | 162 | 171 | 177 | 160 |
| Dmin | 0.15 | 0.17 | 0.16 | 0.16 | 0.17 | 0.18 |
| ΔDmin | 0.32 | 0.38 | 0.09 | 0.08 | 0.09 | 0.1 |

It can be seen from the results of Table 16 that, also inepitaxial tabular grains, ahigher sensitivity and stability can be obtained and the increase with time of the fogging in particular can be inhibited in the case of the silver halide color photographic light-sensitive material of the present invention in which a light-sensitive silver halide emulsion is used which contains a developing agent and which is composed of tabular grains containing a metal ion and/or a metal complex ion which are each a shallow electron trap in combination with a metal ion and/or a metal complex ion which are each a relatively deep electron trap.

Example 9

(Preparation of a silver chlorobromide tabular grain emulsion 3-G (a comparative emulsion))

1,200 ml of gelatin aqueous solution having a pH value of 4.3, which comprised 25 g of ossein gelatin treated with an alkali dissolved in deionized water and having a methionine content of about 40 μmol/g, 1 g of sodium chloride and 4.5 ml of 1N nitric acid, was placed in a reactor, and thereafter the temperature of the solution was raised to 40° C. To this solution, which was vigorously stirred, there were added 36 ml of an aqueous solution (A) containing 20 g of silver nitrate per 100 ml and 36 ml of an aqueous solution (B) containing 0.71 g of potassium bromide and 6.67 g of sodium chloride per 100 ml simultaneously over a period of 45 seconds. After the completion of the addition, the reaction mixture was stirred for 3 minutes and was admixed simultaneously with 43.4 ml of an aqueous solution (C) containing 1.1 g of potassium bromide per 100 ml and 43.4 ml of the solution (A) over a period of 30 seconds. After the completion of the addition, the temperature of the reaction mixture was lowered to 30° C. in 3 minutes and was kept at that temperature. Then, 108 ml of the aqueous solution (A) and 108 ml of an aqueous solution (D) containing 7.02 g of sodium chloride per 100 ml were added to the reaction mixture simultaneously over a period of 2 minutes and 15 seconds. After the completion of the addition, the reaction mixture was stirred for 1 minute and was admixed with 20 ml of a 10% sodium chloride aqueous solution and 7 ml of 1N sodium hydroxide aqueous solution so that the reaction mixture had a pH value of 6.5 and a silver potential of 80 mV versus a saturated calomel electrode. After that, 2 ml of a hydrogen peroxide solution (35%) was added to the reaction mixture. The temperature of the reaction mixture was then raised to 75° C., and the reaction mixture was ripened for 5 minutes at 75° C.

Then, to the reaction mixture was added 1,086 g of an ultrafine silver chlorobromide emulsion 5-(a) for epitaxial junction identical to the ultrafine silver chloride emulsion 4-(a) for epitaxial junction except that the ultrafine silver chlorobromide emulsion 5-(a) for epitaxial junction had a silver bromide content of 5 mol % over a period of 45 minutes, while keeping the silver potential of the reaction mixture at 140 mV. The temperature was then lowered to 35° C., and desalting was performed in a conventional way.

In this way, a silver chlorobromide tabular grain emulsion 3-G was obtained which was composed of silver chlorobromide (100) tabular grains having an average grain size expressed in an average equivalent-sphere diameter of 0.92 μm, an average grain thickness of 0.128 μm, an average aspect ratio of 15.9, and a silver bromide content of 5 mol %.

The chemical sensitization of the silver chlorobromide tabular grain emulsion 3-G was performed as in the case of the tabular silver iodobromide grain emulsion 1-E, except that KI in an amount of $10^{-3}$ mol per mol of silver and a degradation product of ribonucleic acid were added to the emulsion after the addition of the sensitizing dyes.

The following tabular silver chlorobromide grain emulsions 3-H~3-J were prepared in the same way as in the case of the tabular silver chlorobromide grain emulsion 3-G but with the exceptions described below. The average grain aspect ratio and average equivalent-sphere diameter of each of the obtained tabular silver chlorobromide emulsions 3-H~3-J was the same as those of the tabular silver chlorobromide grain emulsion 1-E.

(silver chlorobromide tabular grain emulsion 3-H (a light-sensitive silver halide emulsion of the present invention))

The procedure for the preparation of the tabular silver chlorobromide grain emulsion 3-G was repeated except that an ultrafine silver chlorobromide emulsion 5-(b), identical to the emulsion 5-(a) except that the emulsion 5-(b) contained tripotassium iridium hexachloride in an amount of $4\times10^{-8}$ mol based on iridium per mol of silver and potassium ferrocyanide in an amount of $2\times10^{-4}$ mol based on iron per mol of silver, was added to the emulsion. The thus obtained emulsion 3-H was subjected to the same chemical sensitization as that for the emulsion 3-G.

(silver chlorobromide epitaxial tabular grain emulsion 3-I (a comparative emulsion))

A procedure for the emulsion 3-G was repeated, except that 10 minutes after the addition of sensitizing dyes for the chemical sensitization, KI was not added, but 35 g of an emulsion 5-(c), identical to the emulsion 4-(a) excepting that the emulsion 5-(c) had a silver bromide content of 100 mol %, was added to the emulsion. Then, to the resultant emulsion were added chloroauric acid, sodium thiosulfate and selenium sensitizer.

(silver chlorobromide epitaxial tabular grain emulsion 3-J (a light-sensitive silver halide emulsion to be used in the present invention))

A procedure for the emulsion 3-G was repeated, except that an emulsion 5-(d), identical to the emulsion 5-(a) except that the emulsion 5-(d) contained potassium ferrocyanide in an amount of $2\times10^{-4}$ mol based on iron per mol of silver, was added to the emulsion. Then, the chemical sensitization procedure of the silver chlorobromide epitaxial tabular grain emulsion 3-I was repeated and emulsion 3-J obtained, except that 35 g of an emulsion 5-(e), identical to the emulsion 5- (c) except that the emulsion 5-(e) contained tripotassium iridium hexabromide in an amount of $1.3\times10^{-6}$ mol based on iridium per mol of silver, was added to the emulsion.

The emulsions 3-I and 3-J were composed of grains each having a configuration in which a rectangular tabular grain had fine grains attached to the corners thereof by means of an expitaxial junction.

The procedure for the preparation of Sample 601 in Example 7 was repeated, except that the emulsion as used therein was replaced with the emulsions 3-G~3-J, respectively, and, as a result, Samples 801~804 were prepared.

Samples 801~804 were processed, exposed and subjected to heat development in the same way as in Example 7, except that the heat development was performed at 75° C. for 10 seconds. The results are shown in Table 17. In Table 17, the sensitivities are relative values given while taking the sensitivity of Sample 801 as 100.

TABLE 17

| Sample | 801 | 802 | 803 | 804 |
|---|---|---|---|---|
| Sensitivity | 100 | 138 | 162 | 197 |
| Dmin | 0.18 | 0.19 | 0.16 | 0.18 |
| ΔDmin | 0.50 | 0.10 | 0.64 | 0.12 |

In comparison with the results of Sample 601 in Example 7, it can also be seen from the results of Table 17 that the fogging due to the contained developing agent increases during the storage of the light-sensitive material and that the increase of the fogging during the storage is more significant in the emulsion having a high content of silver chloride because of a higher activity thereof than in the silver iodobromide emulsions. However, it can be seen from the results that, also in an emulsion having a high silver chloride content, the increase of Dmin due to the contained developing agent can be inhibited very effectively while maintaining a high sensitivity in the case of the silver halide color photographic light-sensitive material having a high silver chloride content in which a light-sensitive silver halide emulsion is used which contains a developing agent and which is composed of tabular grains containing a metal ion and/or a metal complex ion which are each a shallow electron trap in combination with a metal ion and/or a metal complex ion which are each a relatively deep electron trap. It is apparent that the above-mentioned effect is also significant in an emulsion composed of epitaxial tabular grains having a high silver chloride content.

Example 10

(tabular silver iodobromide grain emulsion 4-E (a comparative emulsion))

The pH of 1,000 ml of an aqueous solution containing 0.5 g of oxidation-treated gelatin and 0.37 g of KBr was adjusted to 2 by the addition of $H_2SO_4$, and the reaction mixture was stirred at 40° C. To the reaction mixture were simultaneously added 50 ml of a 0.3M $AgNO_3$ aqueous solution (A) and 50 ml of a 0.3M KBr aqueous solution (B) in 40 seconds by means of a double jet. Then, after the pH value of the reaction mixture was adjusted to 5.0 by the addition of NaOH, the temperature of the reaction mixture was raised to 75° C. in 35 minutes. At this temperature, after the addition of 35 g of oxidation-treated gelatin, 505 ml of a 1.2M $AgNO_3$ aqueous solution (C) and 437 ml of a 1.4M KBr aqueous solution (D) were added in 33 minutes by accelerating the flow rate (final flow rate was 5.2 times the initial flow rate) while keeping pAg at 8.58. The reaction mixture was cooled down to 55° C., and 104 ml of a 0.4M $AgNO_3$ aqueous solution (E) and 279 ml of a 0.12 M KI aqueous solution (F) were added to the reaction mixture in 5 minutes at a constant flow rate. Then, after the pAg value was adjusted to 8.8 by the addition of a KBr aqueous solution, 110 ml of a 1.8 M $AgNO_3$ aqueous solution (G) and 125 ml of a 1.8M KBr aqueous solution (H) were added to the reaction mixture, and thus an emulsion was prepared.

The temperature of the emulsion was then lowered to 35° C., and thereafter the emulsion was flocculated in a conventional way. After a water washing stage, 75 g of gelatin was added to the flocculation product, which was adjusted to pH: 5.5 and pAg: 8.2.

In this way, an emulsion was obtained in which the projected area of tabular grains exceeded 99% of the total projected area of all the grains and the tabular grains had an average equivalent-sphere diameter of 0.50 μm, an average grain thickness of 0.07 μm, an average aspect ratio of 15 and an average equivalent-circle diameter of 1.09 μm.

(tabular silver iodobromide grain emulsion 4-F (a light-sensitive silver halide emulsion of the present invention))

The procedure for the preparation of the tabular silver iodobromide grain emulsion 4-E was repeated, except that the solution (D) contained tripotassium iridium hexachloride in an amount of $3.5\times10^{-8}$ mol based on iridium and the solution (H) contained potassium ferrocyanide in an amount of $8\times10^{-5}$ mol based on iron. The average grain aspect ratio and average equivalent-sphere diameter of the obtained emulsion were nearly equal to those of the emulsion 4-E.

(tabular silver iodobromide grain emulsion 4-G (a comparative emulsion))

A mixture of 12.5 g of gelatin having an average molecular weight of 15,000, 4.35 g of potassium bromide, 0.32 g of potassium chloride, and 950 ml of distilled water was placed in a reactor, and thereafter the temperature of the mixture was raised to 45° C. To this solution, which was vigorously stirred, there were added 50 ml of an aqueous solution (A) containing 8.3 g of silver nitrate and 50 ml of an aqueous solution (B) containing 2.67 g of potassium bromide over a period of 45 seconds. The temperature of the mixture was kept at 45° C. for 4 minutes, and then the temperature of the reaction mixture was raised to 63° C. Then, 17.0 g of gelatin together with 130 ml of distilled water were added to the reaction mixture. After that, 150 ml of an aqueous solution (C) containing 51.2 g of silver nitrate and a 24.80% aqueous solution (D) of potassium bromide were added over a period of 13 minutes to the reaction mixture in such a manner that the flow rate of the addition was gradually increased and that the silver potential of the reaction mixture was 0 mV versus a saturated calomel electrode. After the completion of the addition, the temperature of the mixture was kept at 63° C. for 2 minutes, and then the temperature of the reaction mixture was lowered to 45° C. Then, 50 ml of an aqueous solution (E) containing 5.9 g of silver nitrate and 320 ml of an aqueous solution (F) containing 5.82 g of potassium iodide were added over a period of 5 minutes to the reaction mixture. After that, 350 ml of an aqueous solution (G) containing 104.3 g of silver nitrate and a 25% aqueous solution (H) of potassium bromide were added over a period of 45 minutes to the reaction mixture in such a manner that the silver potential of the reaction mixture was 10 mV versus a saturated calomel electrode. After the completion of the addition, 1.4 g of potassium bromide and 4 mg of sodium ethylsulfonate were added to the solution and the temperature of the solution was kept at 45° C. for 5 minutes. Then, the temperature of the solution was lowered and desalting was performed according to a conventional method.

In this way, an emulsion was obtained which was composed of hexagonal tabular grains having an average equivalent-sphere diameter of 0.37 μm, an average equivalent-circle diameter of 0.18 μm and an average aspect ratio of 5.8.

(tabular silver iodobromide grain emulsion 4-H (a light-sensitive silver halide emulsion of the present invention))

The procedure for the preparation of the tabular silver iodobromide grain emulsion 4-E was repeated except that the solution (D) contained tripotassium iridium hexachloride in an amount of $3.5\times10^{-8}$ mol based on iridium and the solution (H) contained potassium ferrocyanide in an amount of $8\times10^{-5}$ mol based on iron. The average grain aspect ratio and average equivalent-sphere diameter of the obtained emulsion were nearly equal to those of the emulsion 4-G.

The chemical sensitization of these emulsions were performed in the same way as for the comparative emulsion 1-E. That is, to the emulsions were added chloroauric acid, sodium thiosulfate and selenium sensitizer in respective adjusted amounts so that the sensitivity of the emulsions at 1/100 second exposure became a maximum. The amounts of the dyes for spectral sensitization and the terminators of chemical sensitization were adjusted proportionally depending on the surface area of the grains of the emulsions.

The sensitization processes for the tabular silver iodobromide grain emulsions for comparison 1-E, 4-E and 4-G as well as for the tabular silver iodobromide grain emulsions for the present invention 1-H, 4-F and 4-H were repeated, except that the sensitizing dyes were changed to sensitizing dyes (a mixture of sensitizing dyes V to VII for red-sensitive emulsions) for red-sensitive emulsions, and thus emulsions 1-E(r), 4-E(r), 4-G(r), 1-H(r), 4-F(r) and 4-H(r) were prepared, respectively. Meanwhile, the sensitization processes for the tabular silver iodobromide grain emulsions for comparison 1-E, 4-E and 4-G as well as for the tabular silver iodobromide grain emulsions for the present invention 1-H, 4-F and 4-H were repeated, except that the sensitizing dyes were changed to a sensitizing dye (a sensitizing dye IV for blue-sensitive emulsions) for blue-sensitive emulsions, and thus 1-E(b), 4-E(b), 4-G(b), 1-H(b), 4-F(b) and 4-H(b) were prepared, respectively.

A multilayered light-sensitive material (Sample 901) was prepared which had the same construction as that shown in Tables 10 to 12, except that the emulsions 1-E, 4-E and 4-G were used for a high-sensitivity layer, a medium-sensitivity layer and a low-sensitivity layer, respectively, in a green-sensitive magenta-coloring layer; the emulsions 1-E(r), 4-E (r) and 4-G(r) were used for a high-sensitivity layer, a medium-sensitivity layer and a low-sensitivity layer, respectively, in a red-sensitive cyan-coloring layer; and the emulsions 1-E(b), 4-E(b) and 4-G(b) were used for a high-sensitivity layer, a medium-sensitivity layer and a low-sensitivity layer, respectively, in a blue-sensitive yellow-coloring layer.

A multicolor silver halide color photographic light-sensitive material (Sample 902) of the present invention was prepared by repeating the procedure for Sample 901, except that the emulsions as used therein were changed as shown below in Sample 901. That is, in the formulation of Sample 901, emulsions 1-E, 4-E and 4-G were changed to emulsions 1-H, 4-F and 4-H, respectively, and the emulsions 1-H, 4-F and 4-H were used for a high-sensitivity layer, a medium-sensitivity layer and a low-sensitivity layer, respectively, in a green-sensitive magenta-coloring layer; the emulsions 1-H(r), 4-F(r) and 4-H(r) were used for a high-sensitivity layer, a medium-sensitivity layer and a low-sensitivity layer, respectively, in a red-sensitive cyan-coloring layer; and the emulsions 1-H(b), 4-F(b) and 4-H(b) were used for a high-sensitivity layer, a medium-sensitivity layer and a low-sensitivity layer, respectively, in a blue-sensitive yellow-coloring layer.

Meanwhile, according to the method for preparing dispersions of couplers as shown in Example 7, a cyan coupler dispersion and a yellow coupler dispersion were prepared. In addition, for the purpose of preparing a color layer capable of losing color at a hot developing process, a colorant dispersion was also prepared by use of a combination of the yellow, magenta and cyan leuco dyes with a zinc complex.

The photographic characteristics of Sample 902 were examined in the same way as in Example 7, except that the filter at the time of exposure was removed.

Samples 902 was exposed to the light of 1,000 lux for 1/100 second via an optical wedge. After the exposure, a heat development was carried out by the procedure comprising supplying 20 ml/m$^2$ of warm water at 40° C. to the light-sensitive layer of Sample 902, putting together the light-sensitive layer and the processing layer of a first processing material P-3 face to face and thereafter heating the materials to 83° C. to keep them at that temperature for 30 seconds by use of a heat drum. Then, Sample 902 was removed from the processing material P-3, and Sample 902 was subjected to a second processing operation by use of a second processing material P-2. The second processing was carried out by the procedure comprising supplying 15 ml/m$^2$ of water to the processing layer of the second processing material P-2, putting together the processing layer and the light-sensitive layer of Sample 902 which had undergone the first processing face to face and thereafter heating the materials to 60° C. to keep them at that temperature for 30 seconds by use of a heat drum. The image of Sample 902 after the above-described processing was subjected to the transmission density measurement of yellow, magenta and cyan wedge images by use of blue, green and red filters to obtain a so-called characteristic curve. Besides, the processing material P-3 was the same as the processing material P-1 in Example 7, except that the amount of guanidine picolinate was changed to 4,500 mg/m$^2$.

As in Example 7, the sensitivity was given by a relative value obtained by taking the reciprocal of the exposure amount corresponding to a density higher than fog density by 0.15 and regarding the sensitivity of Sample 901 as 100. The sensitivities of Sample 902 were expressed in a relative value based on the sensitivities of Sample 901. The results are shown in Table 18.

TABLE 18

| | Sample 901 | | | Sample 902 | | |
|---|---|---|---|---|---|---|
| | B | G | R | B | G | R |
| Sensitivity | 100 | 100 | 100 | 155 | 157 | 165 |
| Dmin | 0.21 | 0.14 | 0.16 | 0.22 | 0.15 | 0.17 |
| ΔDmin | 0.50 | 0.46 | 0.47 | 0.14 | 0.15 | 0.25 |

As is apparent from Table 18, the effect of the present invention characterized by a high sensitivity and very slight increase in Dmin after the accelerated storage is recognized also in a multilayered, multicolored silver halide color photographic light sensitive material (Sample 902) as in Example 7.

Example 11

A multilayered light-sensitive material 1001 was prepared by repeating the procedure for Sample 901, except that a medium-sensitivity layer and a low-sensitivity layer as used therein were removed from the blue-sensitive yellow-coloring layer, the green-sensitive magenta-coloring layer and the red-sensitive cyan-coloring layer; the emulsion 3-G was used for the high-sensitivity layer of the green-sensitive magenta-coloring layer; the emulsion 3-G(r), identical to the emulsion 3-G except that a sensitizing dye for a red-sensitive emulsion was used in the emulsion 3-G(r), was used for the high-sensitivity layer of the red-sensitive cyan-coloring layer; and the emulsion 3-G(b), identical to the emulsion 3-G except that a sensitizing dye for a blue-sensitive emulsion was used in the emulsion 3-G(b), was used for the high-sensitivity layer of the blue-sensitive yellow-coloring layer.

Next, a silver halide color photographic light-sensitive material (Sample 1002) was prepared as in Example 9, except that use was made of the emulsion 3-J(r) identical to the emulsion 3-J except that a sensitizing dye for a red-sensitive emulsion was used in the emulsion 3-J(r), the emulsion 3-J(b) identical to the emulsion 3-J except that a sensitizing dye for a blue-sensitive emulsion was used in the emulsion 3-J(b) and the emulsion 3-J.

Sample 1002 was processed as in Example 10, except that the second process as implemented therein was omitted and that the hot developing condition of the first process was 17 seconds at 80° C. As a result, the effect of the present invention characterized by a high sensitivity and a very slight decrease in Dmin after the above-mentioned accelerated storage was observed as in Example 10.

Since Sample 1002 produces little haze even if the second processing which is a fixation step is not implemented, Sample 1002 is suitable for simple and rapid use, because the image information does not deteriorate when the image information is read out by means of a scanner.

Example 12

Sample 902, having a multilayered construction prepared in Example 10 and a substrate which was the same as that prepared in Example 6 with the exception that the resorcinol was eliminated from the anti-static layer of the substrate (transparent PET base) of Example 6, was loaded in a cartridge. In the examination of the sample conducted in the same way as in Example 10, the sample was excellent as in the case of Sample 902, thus confirming the effect of the present invention characterized by a high sensitivity and the enhancement of stability in a light-sensitive material system containing a developing agent by using a combination of a metal ion and/or metal complex ion which are a shallow electron trap and a metal ion and/or metal complex ion which are a relatively deep electron trap.

What is claimed is:

1. A silver halide color photographic light-sensitive material comprising a substrate having a photographic constituent layer coated thereon including at least one light-sensitive layer which comprises a light-sensitive silver halide emulsion, a developing agent, a compound capable of forming a dye by a coupling reaction with the oxidation product of the developing agent, and a binder, said silver halide color photographic light-sensitive material after the exposure thereof being put together with a processing material comprising a substrate having a constituent layer coated thereon including a processing layer comprising a base and/or a base precursor, in the presence of water supplied to the light-sensitive layer of the silver halide color photographic light-sensitive material or to the processing layer of said processing material in an amount ranging from 1/10 to the equivalent of an amount which is required for the maximum swelling of the entire coating layers of these materials, so that the light-sensitive layer and said processing layer face each other, and being heated for the purpose of heat development to form a color image in the silver halide color photographic light-sensitive material, wherein said light-sensitive silver halide emulsion contains at least one ion selected from the group consisting of a metal ion and a metal complex ion having respectively an electron trap depth of 0.6 eV or less, and contains at least a group of tabular grains having an average aspect ratio ranging from 4 to 100.

2. The silver halide color photographic light-sensitive material according to claim 1, wherein said metal ion and the metal complex ion having respectively an electron trap depth of 0.6 eV or less are selected from the group consisting of a Pb ion, an ion containing a cyano ligand and an element selected from the group consisting of Re, Os, Ru, Fe, Ir and Co, and an ion comprising a halide ion ligand or a thiocyanate ion ligand and Ir or Pd.

3. The silver halide color photographic light-sensitive material according to claim 1, wherein said developing agent is represented by any of the following formulas I to IV:

formula I

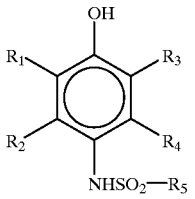

formula II

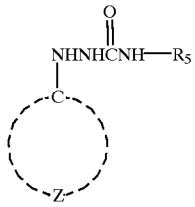

formula III

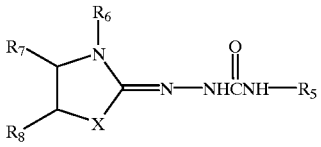

formula IV

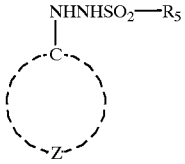

wherein in formulas I to IV, $R_1$ to $R_4$ each represent a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents an alkyl group, an aryl group or a heterocyclic group; Z represents a group of atoms forming a heterocyclic or aromatic ring and the total of Hammett's constants σ of the substituents is 1 or greater if Z represents a group of atoms forming a benzene ring; $R_6$ represents an alkyl group; X represents an oxygen atom, a sulfur atom, a selenium atom or a tertiary nitrogen atom bearing an alkyl or aryl substituent; $R_7$ and $R_8$ respectively represent a hydrogen atom or a substituent; $R_7$ and $R_8$ may join together to form a double bond or a ring; and each of the compounds represented by the formulas I to IV contains at least one ballast group having 8 or more carbon atoms in order to impart oil solubility to the molecule.

4. A silver halide color photographic light-sensitive material comprising a substrate having a photographic constituent layer coated thereon including at least one light-sensitive layer which comprises a light-sensitive silver halide emulsion, a developing agent, a compound capable of forming a dye by a coupling reaction with the oxidation product of the developing agent, and a binder, said silver halide color photographic light-sensitive material after the exposure thereof being put together with a processing material comprising a substrate having a constituent layer coated thereon including a processing layer comprising a base and/or a base precursor, in the presence of water supplied to the light-sensitive layer of the silver halide color photographic light-sensitive material or to the processing layer of said processing material in an amount ranging from 1/10 to the equivalent of an amount which is required for the maximum swelling of the entire coating layers of these materials, so that the light-sensitive layer and said processing layer face each other, and being heated for the purpose of heat development to form a color image in the silver halide color photographic light-sensitive material, wherein said light-sensitive silver halide emulsion contains at least one ion selected from the group consisting of a metal ion and a metal complex ion having respectively an electron trap depth of 0.2 eV or less together with at least one ion selected from the group consisting of a metal ion and a metal complex ion having respectively an electron trap depth of 0.35 eV or more, and said light-sensitive silver halide emulsion contains at least one group of tabular grains having an average aspect ratio ranging from 4 to 100.

5. The silver halide color photographic light-sensitive material according to claim 4, wherein said metal ion and the complex ion having respectively an electron trap depth of 0.2 eV or less are a Pb ion or an ion containing a cyano ligand and an element selected from the group consisting of Re, Os, Ru, Fe, Ir and Co, and said metal ion and the metal complex ion having respectively an electron trap depth of 0.35 eV or more are selected from the group consisting of an ion containing a halide ion ligand or a thiocyanate ion ligand and an element selected from the group consisting of Ir, Rh, Ru and Pd, an ion containing at least one nitrosyl ligand and Ru, and an ion containing a cyano ligand and Cr.

6. A method for forming a color image, comprising the steps of:

putting together a silver halide color photographic light-sensitive material after the exposure thereof and a processing material comprising a substrate having a constituent layer coated thereon including a processing layer comprising a base and/or a base precursor, in the presence of water supplied to the light-sensitive layer of said silver halide color photographic light-sensitive material or to the processing layer of said processing material in an amount ranging from 1/10 to the equivalent of an amount which is required for the maximum swelling of the entire coating layers of these materials, so that said light-sensitive layer of the silver halide color photographic light-sensitive material and said processing layer face each other, and heating these materials for the purpose of heat development to form a color image in the silver halide color photographic light-sensitive material, wherein said silver halide color photographic light-sensitive material is the silver halide color photographic light-sensitive material according to claim 1.

7. The method for forming a color image according to claim 6, wherein said heat development is performed at a temperature of 60° C. or higher.

* * * * *